US010834992B2

(12) United States Patent
Tamm et al.

(10) Patent No.: US 10,834,992 B2
(45) **Date of Patent: *Nov. 17, 2020**

(54) SHOE

(71) Applicant: Adidas AG, Herzogenaurach (DE)

(72) Inventors: Stefan Tamm, Herzogenaurach (DE); Carl Arnese, Herzogenaurach (DE); James Carnes, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/440,883

(22) Filed: Feb. 23, 2017

(65) Prior Publication Data

US 2017/0156434 A1 Jun. 8, 2017

Related U.S. Application Data

(63) Continuation of application No. 14/257,737, filed on Apr. 21, 2014.

(30) Foreign Application Priority Data

Apr. 19, 2013 (DE) ..... 10 2013 207 156

(51) Int. Cl.
*A43B 1/00* (2006.01)
*A43B 1/04* (2006.01)
(Continued)

(52) U.S. Cl.
CPC ..... *A43B 3/106* (2013.01); *A43B 1/00* (2013.01); *A43B 1/04* (2013.01); *A43B 13/14* (2013.01); *A43B 23/0245* (2013.01); *D04B 1/16* (2013.01); *D10B 2403/0114* (2013.01); *D10B 2403/021* (2013.01); *D10B 2403/022* (2013.01); *D10B 2403/0241* (2013.01); *D10B 2403/0243* (2013.01); *D10B 2403/02411* (2013.01);
(Continued)

(58) Field of Classification Search
CPC ..... A43B 1/00; A43B 1/04; A43B 3/106
USPC ..... 36/25 R, 45, 48, 83, 84
See application file for complete search history.

(56) References Cited

U.S. PATENT DOCUMENTS 74,962 A 2/1868 Martin
275,142 A 4/1883 Carter
(Continued)

FOREIGN PATENT DOCUMENTS

AT 386324 8/1988
CA 989720 5/1976
(Continued)

OTHER PUBLICATIONS

Page 1 of Lyden Letter, Apr. 21, 2010.
(Continued)

*Primary Examiner* — Clinton T Ostrup
*Assistant Examiner* — Cameron A Carter
(74) *Attorney, Agent, or Firm* — Kilpatrick Townsend & Stockton LLP

(57) ABSTRACT

Described are shoes, particularly a sports shoe, having an upper and at least one of an outer sole and a midsole connected to the upper. As examples, the outer sole is knitted in a unitary fashion with the upper. As further examples, an insert is positioned within the one-piece knitwear, wherein the insert comprises a profile that increases traction of the outer sole.

15 Claims, 13 Drawing Sheets

(51) Int. Cl.

| | |
|---|---|
| ***A43B 3/10*** | (2006.01) |
| ***A43B 13/14*** | (2006.01) |
| ***A43B 23/02*** | (2006.01) |
| ***D04B 1/16*** | (2006.01) |

(52) U.S. Cl.

CPC .. *D10B 2403/032* (2013.01); *D10B 2501/043* (2013.01); *D10B 2501/061* (2013.01)

(56) References Cited

U.S. PATENT DOCUMENTS 299,934 A 6/1884 Muller
467,091 A 1/1892 Max
578,153 A 3/1897 Lamb
601,192 A 3/1898 Woodside
601,894 A 4/1898 Lamb
D31,023 S 6/1899 Olmsted
757,424 A 4/1904 Vohl
951,033 A 3/1910 Steber
1,215,198 A 2/1917 Rothstein
1,346,516 A 7/1920 Godfrey
1,370,799 A 3/1921 Egerton
1,413,314 A 4/1922 Bosworth
1,413,537 A 4/1922 Jones
1,538,263 A 5/1925 Ackerman
1,597,934 A 8/1926 Stimpson
1,811,803 A 6/1931 Oakley
1,841,518 A 1/1932 Bellak
1,888,172 A 11/1932 Joha
1,902,780 A 3/1933 Holden et al.
RE18,804 E 4/1933 Joha
1,910,251 A 5/1933 Joha
1,972,609 A 9/1934 Arsdale et al.
2,001,293 A 5/1935 Wilson
2,018,275 A 10/1935 Jack
2,024,180 A 12/1935 Parlante
2,038,844 A 4/1936 Dorf
2,042,146 A 5/1936 Deakin
2,047,724 A * 7/1936 Zuckerman ..... D04B 1/24 36/11
2,048,294 A 7/1936 Roberts
2,069,083 A 1/1937 Percy
2,076,285 A 4/1937 Wiggin
2,126,186 A 8/1938 Friedland
2,147,197 A * 2/1939 Glidden ..... A43B 1/02 36/3 A
2,150,730 A 3/1939 Schuessler
2,165,092 A 7/1939 Daniels
2,171,654 A 9/1939 Ralph et al.
2,178,941 A 11/1939 Schuessler
2,257,390 A 9/1941 Roy
2,276,920 A 3/1942 Charles et al.
2,292,455 A 8/1942 Hollier et al.
2,297,028 A 9/1942 Sheeler
2,302,167 A 11/1942 Austin
2,314,098 A 3/1943 Raymond
2,319,141 A 5/1943 Kuehnel
2,330,199 A 9/1943 Basch
2,343,390 A 3/1944 Ushakoff
2,364,134 A 12/1944 Dildilian et al.
2,371,689 A 3/1945 John et al.
2,391,564 A 12/1945 Jon
2,391,594 A 12/1945 Provenzano
2,400,487 A 5/1946 Clark et al.
2,400,692 A 5/1946 Herbert
2,424,957 A 7/1947 Schletter
2,440,393 A 4/1948 Clark
2,460,674 A 2/1949 Lajos
2,464,301 A 3/1949 Francis, Jr.
2,467,237 A 4/1949 Sherman et al.
2,467,821 A 4/1949 Jon
2,516,697 A 7/1950 Haddad
2,538,673 A 1/1951 Ansley
2,569,764 A 10/1951 Jonas
2,584,084 A 1/1952 Rubico
2,586,045 A 2/1952 Hoza
2,603,891 A 7/1952 Gustav
2,608,078 A 8/1952 Anderson
2,623,373 A 12/1952 Vogel
2,641,004 A 6/1953 Whiting et al.
2,675,631 A 4/1954 Doughty
2,679,117 A 5/1954 Reed
2,701,458 A 2/1955 Ducharme
2,712,744 A 7/1955 Miller et al.
2,714,813 A 8/1955 Roscoe
2,783,631 A 3/1957 Sumner
2,811,029 A 10/1957 Conner
2,848,885 A 8/1958 Goodman
2,898,754 A 8/1959 Harms
2,934,839 A 5/1960 Servin
2,948,132 A 8/1960 Gift
2,966,785 A 1/1961 Goff et al.
2,983,128 A 5/1961 Goff et al.
2,994,322 A 8/1961 Cullen et al.
2,995,838 A 8/1961 Servin
3,004,354 A 10/1961 Lewis
3,013,564 A 12/1961 Harold
3,015,943 A 1/1962 Guy
3,035,291 A 5/1962 Bingham, Jr.
3,063,074 A 11/1962 Scholl
3,070,909 A 1/1963 Hermann et al.
3,078,699 A 2/1963 Huntley
3,093,916 A 6/1963 Hiestand et al.
3,138,880 A 6/1964 Kunzli
3,159,988 A 12/1964 Reymes
3,217,336 A 11/1965 Joseph
3,228,819 A 1/1966 Bingham, Jr.
3,298,204 A 1/1967 Hoffecker
3,324,220 A 6/1967 Stansfield
3,370,363 A 2/1968 Kaplan
3,383,782 A 5/1968 McGinnity
3,416,174 A * 12/1968 Novitske ..... A43B 13/32 12/142 E
3,425,246 A 2/1969 Knohl
3,550,402 A 12/1970 Colton
3,583,081 A 6/1971 Hayashi
3,616,149 A 10/1971 Wincklhofer et al.
3,620,892 A 11/1971 Wincklhofer et al.
3,635,051 A 1/1972 Betts et al.
3,656,323 A 4/1972 Brown
3,694,940 A 10/1972 Stohr
3,695,063 A 10/1972 Betts et al.
3,704,474 A 12/1972 Winkler
3,766,566 A 10/1973 Tadokoro et al.
3,769,723 A 11/1973 Masterson et al.
3,778,856 A 12/1973 Christie et al.
3,785,173 A 1/1974 Hanney et al.
3,838,583 A 10/1974 Rumi et al.
3,863,272 A 2/1975 Guille
3,867,248 A 2/1975 Bauer
3,884,052 A 5/1975 Findlay et al.
3,952,427 A 4/1976 Von den Benken et al.
3,967,390 A 7/1976 Anfruns
3,971,234 A 7/1976 Taylor
3,972,086 A 8/1976 Belli et al.
3,985,003 A 10/1976 Reed et al.
3,985,004 A 10/1976 Johnson et al.
4,027,402 A 6/1977 Liu et al.
4,028,910 A 6/1977 Wignall et al.
4,031,586 A 6/1977 Von den Benken et al.
4,038,699 A 8/1977 Burn
4,038,840 A 8/1977 Castello et al.
4,068,395 A 1/1978 Senter
4,075,383 A 2/1978 Anderson et al.
4,111,008 A 9/1978 Robinson et al.
4,120,101 A 10/1978 Drew
4,133,118 A 1/1979 Khalsa et al.
4,144,727 A 3/1979 Duhl et al.
4,183,156 A 1/1980 Rudy et al.
4,211,806 A 7/1980 Civardi et al.
4,219,945 A 9/1980 Rudy et al.
4,232,458 A 11/1980 Bartels
4,233,758 A 11/1980 Auberry
4,255,949 A 3/1981 Thorneburg

(56) References Cited

U.S. PATENT DOCUMENTS 4,258,480 A 3/1981 Famolare et al.
4,265,954 A 5/1981 Romanek
4,276,671 A 7/1981 Melton
4,279,049 A 7/1981 Coiquaud
4,282,657 A 8/1981 Antonious
4,306,315 A 12/1981 Castiglia
4,306,929 A 12/1981 Menikheim et al.
4,317,292 A 3/1982 Melton
4,324,752 A 4/1982 Newton et al.
4,354,318 A 10/1982 Frederick et al.
4,356,643 A 11/1982 Kester et al.
4,373,361 A 2/1983 Thorneburg
4,430,811 A 2/1984 Okada
4,447,967 A 5/1984 Zaino
4,465,448 A 8/1984 Aldridge et al.
4,467,626 A 8/1984 Coble et al.
4,523,346 A 6/1985 Auberry et al.
4,531,525 A 7/1985 Richards
4,592,154 A 6/1986 Oatman
4,607,439 A 8/1986 Harada
4,610,685 A 9/1986 Raley
4,624,115 A 11/1986 Safrit et al.
4,642,915 A 2/1987 Pfander
4,651,354 A 3/1987 Petrey
4,658,515 A 4/1987 Oatman
4,663,946 A 5/1987 Wright
4,669,126 A 6/1987 Jones
4,682,479 A 7/1987 Pernick
4,722,202 A 2/1988 Imboden
4,729,179 A 3/1988 Quist et al.
4,737,396 A 4/1988 Kamat
4,750,339 A 6/1988 Simpson et al.
4,756,098 A 7/1988 Boggia
4,783,355 A 11/1988 Mueller
4,785,558 A 11/1988 Shiomura
4,813,158 A 3/1989 Brown
4,813,161 A 3/1989 Lesley
4,852,272 A 8/1989 Chilewich et al.
4,899,465 A 2/1990 Bleimhofer et al.
4,941,331 A 7/1990 Cournoyer et al.
4,960,135 A 10/1990 Nelson
5,031,423 A 7/1991 Ikenaga et al.
5,052,130 A 10/1991 Barry et al.
5,095,720 A 3/1992 Tibbals
5,117,567 A 6/1992 Berger et al.
5,125,116 A 6/1992 Gaither et al.
5,152,025 A 10/1992 Hirmas et al.
5,157,791 A 10/1992 Woodson et al.
5,181,278 A 1/1993 Peleg et al.
5,192,601 A 3/1993 Neisler
5,240,773 A 8/1993 Dunn et al.
5,253,434 A 10/1993 Curley, Jr. et al.
5,291,671 A 3/1994 Caberlotto et al.
5,319,807 A 6/1994 Brier
5,323,627 A 6/1994 Lonati et al.
5,343,639 A 9/1994 Kilgore et al.
5,345,638 A 9/1994 Nishida
5,353,523 A 10/1994 Kilgore et al.
5,353,524 A 10/1994 Brier
5,371,957 A 12/1994 Gaudio et al.
5,385,036 A 1/1995 Spillane et al.
5,388,430 A 2/1995 Essig
5,426,869 A 6/1995 Gore et al.
5,461,884 A 10/1995 McCartney et al.
5,479,791 A 1/1996 Osborne
5,484,646 A 1/1996 Mann
5,505,011 A 4/1996 Bleimhofer et al.
5,511,323 A 4/1996 Dahlgren
5,513,450 A 5/1996 Aviles
5,519,894 A 5/1996 Imboden et al.
5,526,584 A 6/1996 Bleimhofer et al.
5,553,468 A 9/1996 Osborne
5,560,227 A 10/1996 Depoe et al.
5,572,860 A 11/1996 Mitsumoto et al.
5,575,090 A 11/1996 Condini
5,581,817 A 12/1996 Hicks
5,592,836 A 1/1997 Schuster et al.
5,605,060 A 2/1997 Osborne
5,606,808 A 3/1997 Gilliard et al.
5,617,585 A 4/1997 Fons et al.
5,623,734 A 4/1997 Pugliatti
5,623,840 A 4/1997 Roell
5,709,107 A 1/1998 Jeffcoat
5,711,093 A 1/1998 Aumann
5,711,168 A 1/1998 Proctor et al.
5,722,262 A 3/1998 Proctor et al.
5,729,918 A 3/1998 Smets et al.
5,735,145 A 4/1998 Pernick
5,737,857 A 4/1998 Aumann
5,737,943 A 4/1998 Bernhardt
5,746,013 A 5/1998 Fay
5,765,296 A 6/1998 Ludemann et al.
5,774,898 A 7/1998 Malpee
5,784,806 A 7/1998 Wendt
5,787,503 A 8/1998 Murphy
5,791,163 A 8/1998 Throneburg
5,836,179 A 11/1998 Van
5,850,745 A 12/1998 Albright
5,855,123 A 1/1999 Albright
5,884,419 A 3/1999 Davidowitz et al.
5,896,608 A 4/1999 Whatley
5,896,683 A 4/1999 Foxen et al.
5,896,758 A 4/1999 Rock et al.
5,906,007 A 5/1999 Roberts
5,996,189 A 12/1999 Wang et al.
6,021,585 A 2/2000 Cole
6,029,376 A 2/2000 Cass
6,032,387 A 3/2000 Johnson
6,052,921 A 4/2000 Oreck
6,088,936 A 7/2000 Bahl et al.
6,109,068 A 8/2000 Stoll et al.
6,128,835 A 10/2000 Ritter et al.
6,151,802 A 11/2000 Reynolds et al.
6,158,253 A 12/2000 Frank et al.
6,170,175 B1 1/2001 Funk et al.
6,173,589 B1 1/2001 Hayes, Jr. et al.
6,192,717 B1 2/2001 Rabinowicz
6,196,030 B1 3/2001 Stoll et al.
6,227,010 B1 5/2001 Roell
6,231,946 B1 5/2001 Brown, Jr. et al.
6,250,115 B1 6/2001 Suzuki
6,272,888 B1 8/2001 Fujita et al.
6,286,233 B1 9/2001 Gaither
6,287,168 B1 9/2001 Rabinowicz
6,299,962 B1 10/2001 Davis et al.
6,301,759 B1 10/2001 Langer et al.
6,308,438 B1 10/2001 Throneburg et al.
6,330,814 B1 12/2001 Fujiwara et al.
6,333,105 B1 12/2001 Tanaka et al.
6,401,364 B1 6/2002 Burt et al.
6,415,632 B1 7/2002 Vesnaver
6,430,844 B1 8/2002 Otis et al.
6,449,878 B1 9/2002 Lyden
6,539,752 B1 4/2003 Apollonio
6,558,784 B1 5/2003 Norton et al.
6,588,237 B2 7/2003 Cole et al.
6,622,312 B2 9/2003 Rabinowicz
6,662,469 B2 12/2003 Belley et al.
6,665,955 B1 12/2003 Mizrahi et al.
6,708,348 B1 3/2004 Romay
6,735,988 B1 5/2004 Honeycutt
6,754,983 B2 6/2004 Hatfield et al.
6,779,369 B2 8/2004 Shepherd et al.
6,871,515 B1 3/2005 Starbuck et al.
6,886,367 B2 5/2005 Mitchell et al.
6,899,591 B2 5/2005 Mitchell
6,910,288 B2 6/2005 Dua
6,922,917 B2 8/2005 Kerns et al.
6,931,762 B1 8/2005 Dua
6,944,975 B2 9/2005 Safdeye et al.
6,984,596 B2 1/2006 Dickerson
6,986,183 B2 1/2006 Delgorgue et al.
6,986,269 B2 1/2006 Dua
D517,297 S 3/2006 Jones et al.

(56) References Cited

U.S. PATENT DOCUMENTS 7,016,867 B2 3/2006 Lyden
7,037,571 B2 5/2006 Fish et al.
7,043,942 B2 5/2006 Chapman
7,047,668 B2 5/2006 Burris et al.
7,051,460 B2 5/2006 Orei et al.
7,055,267 B2 6/2006 Wilson et al.
7,056,402 B2 6/2006 Koerwien et al.
7,081,221 B2 7/2006 Paratore et al.
7,107,235 B2 9/2006 Lyden
7,131,296 B2 11/2006 Dua et al.
7,179,414 B2 2/2007 Safdeye et al.
7,207,125 B2 4/2007 Jeppesen et al.
7,207,196 B2 4/2007 Lonati et al.
7,207,961 B1 4/2007 Benton et al.
7,240,522 B2 7/2007 Kondou et al.
7,346,935 B1 3/2008 Patterson et al.
7,347,011 B2 3/2008 Dua et al.
7,356,946 B2 4/2008 Hannon et al.
7,441,348 B1 10/2008 Dawson et al.
7,484,318 B2 2/2009 Finkelstein
7,543,397 B2 6/2009 Kilgore et al.
7,568,298 B2 8/2009 Kerns et al.
7,637,032 B2 12/2009 Sokolowski et al.
7,650,705 B2 1/2010 Donnadieu et al.
7,677,061 B2 * 3/2010 Mori ..... A41B 11/02 66/185
7,682,219 B2 3/2010 Falla
7,721,575 B2 5/2010 Yokoyama
7,774,956 B2 8/2010 Dua et al.
7,805,859 B2 10/2010 Finkelstein
7,805,860 B2 10/2010 Fliri et al.
7,814,598 B2 10/2010 Dua et al.
7,854,076 B2 12/2010 Keppler et al.
7,882,648 B2 2/2011 Langvin
8,028,440 B2 10/2011 Sokolowski et al.
8,042,288 B2 10/2011 Dua et al.
8,099,881 B2 1/2012 Yamamoto
8,196,317 B2 6/2012 Dua et al.
8,209,883 B2 7/2012 Lyden
8,215,132 B2 7/2012 Dua et al.
8,225,530 B2 7/2012 Sokolowski et al.
8,266,749 B2 9/2012 Dua et al.
8,296,970 B2 10/2012 Jessiman et al.
D673,765 S 1/2013 Parker et al.
8,448,474 B1 5/2013 Tatler et al.
8,464,383 B2 6/2013 Sing et al.
8,490,299 B2 7/2013 Dua et al.
8,522,577 B2 9/2013 Huffa
8,590,345 B2 * 11/2013 Sokolowski ..... A43B 1/04 66/170
8,595,878 B2 12/2013 Farris et al.
8,621,891 B2 1/2014 Shaffer et al.
8,647,460 B1 * 2/2014 Koo ..... A43B 13/02 156/242
8,650,916 B2 2/2014 Thomas et al.
8,683,718 B2 4/2014 Fliri et al.
8,701,232 B1 4/2014 Droege et al.
8,745,895 B2 6/2014 Sokolowski et al.
8,745,896 B2 6/2014 Shaffer et al.
8,800,172 B2 8/2014 Dua et al.
8,839,532 B2 9/2014 Shaffer et al.
8,881,430 B2 11/2014 Baines et al.
8,898,932 B2 12/2014 Molyneux et al.
8,899,079 B2 12/2014 Podhajny et al.
8,959,800 B2 2/2015 Sokolowski et al.
8,959,959 B1 2/2015 Podhajny et al.
8,973,410 B1 3/2015 Podhajny et al.
8,978,422 B2 3/2015 Podhajny et al.
8,997,529 B1 4/2015 Podhajny et al.
8,997,530 B1 4/2015 Podhajny
9,003,836 B1 4/2015 Podhajny et al.
9,010,157 B1 4/2015 Podhajny et al.
9,027,260 B2 5/2015 Shaffer et al.
9,032,763 B2 5/2015 Meir et al.
9,060,562 B2 6/2015 Meir et al.
9,072,335 B1 7/2015 Podhajny
9,078,488 B1 7/2015 Podhajny et al.
9,084,449 B2 7/2015 Huffman et al.
9,095,187 B2 8/2015 Molyneux et al.
9,132,601 B2 9/2015 Beye et al.
9,139,938 B2 9/2015 Podhajny et al.
9,145,629 B2 9/2015 Podhajny
9,150,986 B2 10/2015 Shaffer et al.
9,192,204 B1 11/2015 Klug et al.
9,226,540 B2 1/2016 Podhajny et al.
9,297,097 B2 3/2016 Turner
9,301,567 B2 4/2016 Roulo et al.
9,339,076 B2 5/2016 Podhajny et al.
9,353,469 B2 5/2016 Meir et al.
9,357,813 B2 6/2016 Lyden
9,365,959 B2 6/2016 Turner
9,375,046 B2 6/2016 Meir
9,398,784 B2 7/2016 Baudouin et al.
9,498,023 B2 11/2016 Craig
9,723,890 B2 8/2017 Long et al.
9,839,255 B2 12/2017 Adami et al.
10,070,671 B2 9/2018 Moran
10,098,412 B2 10/2018 Hoffer et al.
2001/0016993 A1 8/2001 Cagner
2001/0024709 A1 9/2001 Yoneda et al.
2001/0032399 A1 10/2001 Litchfield et al.
2001/0054240 A1 12/2001 Bordin et al.
2001/0055684 A1 12/2001 Davis et al.
2002/0000002 A1 1/2002 Hatch et al.
2002/0002780 A1 1/2002 Barthelemy et al.
2002/0007570 A1 1/2002 Girard
2002/0012784 A1 1/2002 Norton et al.
2002/0026730 A1 3/2002 Whatley
2002/0035796 A1 3/2002 Knoche et al.
2002/0053148 A1 * 5/2002 Haimerl ..... A43B 7/12 36/55
2002/0078599 A1 6/2002 Delgorgue et al.
2002/0092199 A1 7/2002 Fish et al.
2002/0148142 A1 10/2002 Oorei et al.
2002/0148258 A1 10/2002 Cole et al.
2002/0152638 A1 10/2002 Safdeye et al.
2002/0157281 A1 10/2002 Safdeye et al.
2003/0009908 A1 1/2003 Sheets et al.
2003/0009919 A1 1/2003 Stein
2003/0033837 A1 2/2003 Higgins
2003/0039882 A1 2/2003 Wruck et al.
2003/0051372 A1 3/2003 Lyden
2003/0069807 A1 4/2003 Lyden
2003/0079374 A1 5/2003 Belley et al.
2003/0097766 A1 5/2003 Morgan
2003/0106171 A1 6/2003 Issler
2003/0121179 A1 7/2003 Chen et al.
2003/0126762 A1 7/2003 Tseng
2003/0131499 A1 7/2003 Silverman
2003/0191427 A1 10/2003 Jay et al.
2003/0192351 A1 10/2003 Meckley et al.
2003/0226280 A1 12/2003 Paratore et al.
2003/0227105 A1 12/2003 Paratore et al.
2004/0009731 A1 1/2004 Rabinowicz
2004/0045955 A1 3/2004 Rock et al.
2004/0083622 A1 5/2004 Mizrahi et al.
2004/0107603 A1 6/2004 Wei et al.
2004/0111920 A1 6/2004 Cretinon
2004/0111921 A1 6/2004 Lenormand
2004/0118018 A1 6/2004 Dua
2004/0139628 A1 7/2004 Wiener et al.
2004/0139629 A1 7/2004 Wiener et al.
2004/0143995 A1 7/2004 Mcclelland
2004/0163280 A1 8/2004 Morris et al.
2004/0181972 A1 9/2004 Csorba
2004/0198178 A1 10/2004 Mitchell et al.
2004/0205982 A1 10/2004 Challe
2004/0216332 A1 11/2004 Wilson et al.
2004/0226113 A1 11/2004 Wright et al.
2004/0255486 A1 * 12/2004 Pawlus ..... A43B 3/0047 36/10
2004/0261467 A1 12/2004 Chapman
2005/0016023 A1 * 1/2005 Burris ..... A43B 5/02 36/45

(56) References Cited

U.S. PATENT DOCUMENTS

2005/0028405 A1 2/2005 Wilson et al.
2005/0055843 A1 3/2005 Morlacchi
2005/0081402 A1 4/2005 Orei et al.
2005/0091725 A1 5/2005 Alley et al.
2005/0102863 A1 5/2005 Hannon et al.
2005/0108898 A1 5/2005 Jeppesen et al.
2005/0115281 A1 6/2005 Mitchell et al.
2005/0115284 A1* 6/2005 Dua ..... A43B 1/04 66/178 R
2005/0127057 A1 6/2005 Rock et al.
2005/0138845 A1 6/2005 Haimerl et al.
2005/0155137 A1 7/2005 Berger
2005/0160626 A1 7/2005 Townsend
2005/0166426 A1 8/2005 Donnadieu et al.
2005/0166427 A1 8/2005 Greene et al.
2005/0193592 A1* 9/2005 Dua ..... A43B 1/04 36/45
2005/0208857 A1 9/2005 Baron et al.
2005/0210704 A1 9/2005 Connolly
2005/0268497 A1 12/2005 Alfaro et al.
2005/0273988 A1 12/2005 Christy et al.
2005/0284000 A1 12/2005 Kerns
2006/0006168 A1 1/2006 Rock et al.
2006/0016099 A1 1/2006 Marco et al.
2006/0021258 A1 2/2006 Beck
2006/0048413 A1 3/2006 Sokolowski et al.
2006/0059715 A1 3/2006 Aveni
2006/0059716 A1 3/2006 Yamashita et al.
2006/0117607 A1 6/2006 Pare et al.
2006/0130359 A1 6/2006 Dua et al.
2006/0162187 A1 7/2006 Byrnes et al.
2006/0179549 A1 8/2006 Huggins et al.
2006/0243000 A1 11/2006 Turlan et al.
2007/0000027 A1 1/2007 Ganzoni et al.
2007/0003728 A1 1/2007 Hannon et al.
2007/0022627 A1* 2/2007 Sokolowski ..... A43B 1/04 36/3 A
2007/0074334 A1 4/2007 Steel et al.
2007/0144039 A1 6/2007 Fliri
2007/0180730 A1 8/2007 Greene et al.
2007/0204482 A1 9/2007 Gibson-Collinson et al.
2007/0234593 A1* 10/2007 Beck ..... A43B 17/03 36/44
2007/0271817 A1* 11/2007 Ellis ..... A43B 3/0005 36/28
2008/0000108 A1* 1/2008 Ellis ..... A43B 3/0005 36/113
2008/0010860 A1 1/2008 Gyr
2008/0017294 A1 1/2008 Bailey et al.
2008/0032580 A1 2/2008 Fukuoka et al.
2008/0066499 A1 3/2008 Andrieu et al.
2008/0078102 A1 4/2008 Kilgore et al.
2008/0110048 A1* 5/2008 Dua ..... A43B 1/04 36/45
2008/0110049 A1* 5/2008 Sokolowski ..... A43B 3/0031 36/50.1
2008/0189830 A1 8/2008 Egglesfield et al.
2008/0235877 A1 10/2008 Murray et al.
2008/0250668 A1 10/2008 Marvin et al.
2008/0263893 A1 10/2008 Hernandez et al.
2008/0295230 A1 12/2008 Wright et al.
2008/0313939 A1 12/2008 Ardill et al.
2009/0068908 A1 3/2009 Hinchcliff et al.
2009/0071036 A1 3/2009 Hooper et al.
2009/0107012 A1 4/2009 Cheney et al.
2009/0126225 A1 5/2009 Jarvis
2009/0126229 A1* 5/2009 Fuerst ..... A43B 1/0027 36/88
2009/0134145 A1 5/2009 Rock et al.
2009/0172971 A1* 7/2009 Peikert ..... A43B 7/125 36/88
2009/0241374 A1 10/2009 Sato et al.
2009/0297794 A1 12/2009 Lin
2009/0300823 A1 12/2009 Connaghan et al.
2010/0018075 A1 1/2010 Meschter et al.
2010/0037483 A1 2/2010 Meschter et al.
2010/0043253 A1 2/2010 Dojan et al.
2010/0051132 A1 3/2010 Glenn et al.
2010/0064453 A1 3/2010 Haimerl
2010/0107346 A1* 5/2010 Aveni ..... A43B 1/0027 12/146 R
2010/0107443 A1* 5/2010 Aveni ..... A41D 19/01547 36/84
2010/0154256 A1* 6/2010 Dua ..... A43B 1/04 36/25 R
2010/0162590 A1 7/2010 Bönigk et al.
2010/0170651 A1 7/2010 Scherb et al.
2010/0175276 A1 7/2010 Dojan et al.
2010/0229429 A1 9/2010 Longuet
2010/0269372 A1 10/2010 Dua et al.
2010/0299962 A1 12/2010 Fliri
2011/0030244 A1 2/2011 Motawi et al.
2011/0061148 A1 3/2011 Egozi et al.
2011/0061149 A1 3/2011 Polacco et al.
2011/0061265 A1 3/2011 Lyden
2011/0078921 A1 4/2011 Greene et al.
2011/0088282 A1 4/2011 Dojan et al.
2011/0099845 A1 5/2011 Miller
2011/0154689 A1* 6/2011 Chung ..... A43B 7/22 36/28
2011/0154693 A1 6/2011 Oberschneider et al.
2011/0179677 A1 7/2011 Jessiman et al.
2011/0219643 A1 9/2011 Tai et al.
2011/0283567 A1 11/2011 Yin
2011/0302727 A1 12/2011 Sokolowski et al.
2011/0302810 A1 12/2011 Borel et al.
2011/0308108 A1 12/2011 Berns et al.
2011/0308110 A1 12/2011 Berns et al.
2012/0023686 A1 2/2012 Huffa et al.
2012/0023778 A1 2/2012 Dojan et al.
2012/0055044 A1 3/2012 Dojan et al.
2012/0090077 A1 4/2012 Brown
2012/0114883 A1 5/2012 Kapur et al.
2012/0144698 A1 6/2012 McDowell
2012/0144699 A1 6/2012 Eggert et al.
2012/0159813 A1 6/2012 Dua et al.
2012/0180195 A1 7/2012 Shull et al.
2012/0198730 A1 8/2012 Burch et al.
2012/0204448 A1 8/2012 Bracken
2012/0216423 A1 8/2012 Lyden
2012/0216430 A1* 8/2012 Stohr ..... A43B 1/04 36/25 R
2012/0233878 A1 9/2012 Hazenberg et al.
2012/0233879 A1 9/2012 Dojan et al.
2012/0233880 A1 9/2012 Chao et al.
2012/0233882 A1 9/2012 Huffa et al.
2012/0233883 A1 9/2012 Spencer et al.
2012/0233884 A1 9/2012 Greene
2012/0233885 A1 9/2012 Shaffer et al.
2012/0233886 A1 9/2012 Madore et al.
2012/0233887 A1 9/2012 Baker et al.
2012/0233888 A1 9/2012 Baker et al.
2012/0234051 A1 9/2012 Huffa
2012/0234052 A1 9/2012 Huffa et al.
2012/0234111 A1 9/2012 Molyneux et al.
2012/0234467 A1 9/2012 Rapaport et al.
2012/0235322 A1 9/2012 Greene et al.
2012/0238376 A1 9/2012 Knight et al.
2012/0238910 A1 9/2012 Nordstrom
2012/0240429 A1 9/2012 Sokolowski et al.
2012/0246973 A1* 10/2012 Dua ..... A43B 23/0235 36/83
2012/0255201 A1* 10/2012 Little ..... A43B 1/04 36/84
2012/0272548 A1 11/2012 Downard et al.
2012/0279260 A1 11/2012 Dua et al.
2012/0285039 A1 11/2012 Lazaris et al.
2012/0285043 A1* 11/2012 Dua ..... A43B 1/04 36/84
2012/0297557 A1 11/2012 Koo et al.
2012/0297642 A1 11/2012 Schaefer et al.
2012/0297643 A1 11/2012 Shaffer et al.

(56) References Cited

U.S. PATENT DOCUMENTS

2012/0297645 A1 11/2012 Berbert et al.
2012/0318026 A1* 12/2012 Dua ..... A43B 1/04 66/170
2013/0031801 A1 2/2013 Hatfield et al.
2013/0036629 A1 2/2013 Bramani et al.
2013/0047471 A1 2/2013 Liang
2013/0055590 A1 3/2013 Mokos
2013/0061405 A1 3/2013 Haimerl
2013/0074364 A1 3/2013 Lim
2013/0091741 A1* 4/2013 Frank ..... A43B 3/101 36/59 R
2013/0118031 A1 5/2013 Chenciner et al.
2013/0139407 A1* 6/2013 Brongers ..... A43B 1/0045 36/44
2013/0145652 A1 6/2013 Podhajny et al.
2013/0152424 A1 6/2013 Dojan
2013/0160323 A1* 6/2013 Hsiao ..... A43B 3/248 36/45
2013/0174449 A1 7/2013 Koyess et al.
2013/0219749 A1 8/2013 Dojan et al.
2013/0232820 A1 9/2013 Bramani et al.
2013/0239438 A1 9/2013 Dua et al.
2013/0255103 A1 10/2013 Dua et al.
2013/0260104 A1 10/2013 Dua et al.
2013/0260629 A1 10/2013 Dua et al.
2013/0263468 A1 10/2013 Ciccarelli
2013/0269209 A1 10/2013 Lang et al.
2014/0068968 A1 3/2014 Podhajny et al.
2014/0082965 A1 3/2014 Greene et al.
2014/0101824 A1 4/2014 Spanks et al.
2014/0123409 A1 5/2014 Huffa et al.
2014/0130373 A1 5/2014 Baines et al.
2014/0130374 A1 5/2014 Minami et al.
2014/0130375 A1 5/2014 Baines et al.
2014/0130376 A1 5/2014 Fahmi et al.
2014/0137433 A1 5/2014 Craig et al.
2014/0137434 A1* 5/2014 Craig ..... A43B 1/04 36/54
2014/0144190 A1 5/2014 Tatler et al.
2014/0150292 A1 6/2014 Podhajny et al.
2014/0150295 A1 6/2014 Dua et al.
2014/0150296 A1 6/2014 Dua et al.
2014/0157831 A1 6/2014 Huffa et al.
2014/0196314 A1 7/2014 Beye et al.
2014/0209233 A1 7/2014 Dua et al.
2014/0223777 A1 8/2014 Whiteman et al.
2014/0237855 A1 8/2014 Podhajny et al.
2014/0237856 A1 8/2014 Podhajny et al.
2014/0238082 A1 8/2014 Meir et al.
2014/0238083 A1 8/2014 Meir et al.
2014/0245544 A1 9/2014 Huffa et al.
2014/0245546 A1 9/2014 Huffa et al.
2014/0245547 A1 9/2014 Molyneux et al.
2014/0245633 A1 9/2014 Podhajny et al.
2014/0245634 A1 9/2014 Podhajny et al.
2014/0245636 A1 9/2014 Seamarks et al.
2014/0245637 A1 9/2014 Fahmi et al.
2014/0245639 A1 9/2014 Dua et al.
2014/0245643 A1 9/2014 Huffa et al.
2014/0310983 A1 10/2014 Tamm et al.
2014/0310984 A1 10/2014 Tamm et al.
2014/0310985 A1* 10/2014 Tran ..... A43B 1/00 36/84
2014/0310986 A1 10/2014 Tamm et al.
2014/0338226 A1 11/2014 Zavala
2014/0352082 A1 12/2014 Shaffer et al.
2014/0352173 A1 12/2014 Bell et al.
2015/0013080 A1 1/2015 Thomas et al.
2015/0013188 A1 1/2015 Baines et al.
2015/0013394 A1 1/2015 Huffa
2015/0013395 A1 1/2015 Huffa
2015/0040431 A1 2/2015 Molyneux et al.
2015/0047225 A1 2/2015 Dealey et al.
2015/0059209 A1 3/2015 Dekovic et al.
2015/0059211 A1 3/2015 Podhajny et al.
2015/0075031 A1 3/2015 Podhajny et al.
2015/0101212 A1 4/2015 Dekovic et al.
2015/0143716 A1 5/2015 Savage et al.
2015/0143720 A1 5/2015 Avar et al.
2015/0216254 A1 8/2015 Podhajny et al.
2015/0216255 A1 8/2015 Podhajny
2015/0216257 A1 8/2015 Meir et al.
2015/0223552 A1 8/2015 Love et al.
2015/0250256 A1 9/2015 Podhajny et al.
2015/0264995 A1 9/2015 Hilderbrand, IV
2015/0272261 A1 10/2015 Huffman et al.
2015/0342285 A1 12/2015 Bell et al.
2015/0359290 A1 12/2015 Podhajny et al.
2015/0366293 A1 12/2015 Clarkson et al.
2016/0029736 A1 2/2016 Meir
2016/0088894 A1 3/2016 Podhajny et al.
2016/0088899 A1 3/2016 Klug et al.
2016/0090670 A1 3/2016 Meir
2016/0095377 A1 4/2016 Tamm
2016/0198797 A1 7/2016 Ikenaka
2016/0206039 A1 7/2016 Cross et al.
2016/0206040 A1 7/2016 Cross et al.
2016/0206042 A1 7/2016 Cross et al.
2016/0206046 A1 7/2016 Cross et al.
2016/0278481 A1 9/2016 Le et al.
2016/0295971 A1 10/2016 Arnese et al.
2017/0311650 A1 11/2017 Hupperets et al.
2018/0064201 A1 3/2018 Tran et al.
2018/0092432 A1 4/2018 Hoffer et al.

FOREIGN PATENT DOCUMENTS

CA 2387640 4/2003
CN 2044806 9/1989
CN 1067566 1/1993
CN 2187379 1/1995
CN 2438730 7/2001
CN 1392833 1/2003
CN 1411762 4/2003
CN 1429512 7/2003
CN 1155597 6/2004
CN 1960650 5/2007
CN 101316526 12/2008
CN 201356120 12/2009
CN 102939023 2/2013
CN 104413996 3/2015
DE 71153 4/1893
DE 627878 7/1936
DE 870963 3/1953
DE 1736512 12/1956
DE 1785183 3/1959
DE 1084173 7/1960
DE 1910713 7/1970
DE 1785183 11/1971
DE 2044031 3/1972
DE 1685690 1/1973
DE 2162456 6/1973
DE 2305693 8/1973
DE 2505537 8/1976
DE 2801984 7/1979
DE 3820094 12/1989
DE 4400739 7/1995
DE 68922952 11/1995
DE 4419802 12/1995
DE 4419803 12/1995
DE 4441555 6/1996
DE 19629317 10/1997
DE 19738433 4/1998
DE 19728848 1/1999
DE 4443002 2/1999
DE 19855542 6/2000
DE 19910785 9/2000
DE 10022254 11/2001
DE 10037728 2/2002
DE 10145073 4/2003
DE 10228143 11/2003
DE 3903242 7/2004
DE 4138836 7/2004

(56) References Cited

FOREIGN PATENT DOCUMENTS

| | | | |
|---|---|---|---|
| DE | 19910785 | | 12/2004 |
| DE | 602004000536 | | 12/2006 |
| DE | 102005030651 | | 1/2007 |
| DE | 10316979 | | 2/2007 |
| DE | 60031821 | | 9/2007 |
| DE | 102006009974 | | 9/2007 |
| DE | 102006022494 | | 11/2007 |
| DE | 202007011165 | | 1/2008 |
| DE | 202009010225 | | 2/2010 |
| DE | 202009011928 | | 2/2010 |
| DE | 102009018942 | | 11/2010 |
| DE | 102009028627 | | 5/2011 |
| DE | 102010037585 | | 3/2012 |
| DE | 102011055154 | | 5/2012 |
| DE | 202012100938 | | 5/2012 |
| DE | 202007019490 | | 1/2013 |
| DE | 202009018763 | | 4/2013 |
| DE | 202009018765 | | 4/2013 |
| DE | 102012206062 | | 10/2013 |
| DE | 202012013113 | | 11/2014 |
| DE | 202012013114 | | 11/2014 |
| DE | 202012013118 | | 11/2014 |
| DE | 202012013119 | | 11/2014 |
| DE | 202012013120 | | 11/2014 |
| EP | 0037629 | | 10/1981 |
| EP | 45372 | | 2/1982 |
| EP | 0105773 | | 4/1984 |
| EP | 279950 | | 8/1988 |
| EP | 0383685 | A1 | 8/1990 |
| EP | 0384059 | | 8/1990 |
| EP | 446583 | | 9/1991 |
| EP | 0472743 | | 3/1992 |
| EP | 499710 | | 8/1992 |
| EP | 508712 | | 10/1992 |
| EP | 0664092 | | 7/1995 |
| EP | 448714 | | 7/1996 |
| EP | 728860 | | 8/1996 |
| EP | 0733732 | | 9/1996 |
| EP | 758693 | | 2/1997 |
| EP | 845553 | | 6/1998 |
| EP | 864681 | | 9/1998 |
| EP | 898002 | | 2/1999 |
| EP | 0959704 | | 12/1999 |
| EP | 1004829 | | 5/2000 |
| EP | 1031656 | | 8/2000 |
| EP | 1091033 | | 4/2001 |
| EP | 0758693 | | 10/2001 |
| EP | 0833000 | | 5/2002 |
| EP | 1219191 | | 7/2002 |
| EP | 1233091 | | 8/2002 |
| EP | 1273693 | | 1/2003 |
| EP | 1275761 | | 1/2003 |
| EP | 1437057 | | 7/2004 |
| EP | 1148161 | | 4/2005 |
| EP | 1563752 | | 8/2005 |
| EP | 1602762 | | 12/2005 |
| EP | 1352118 | | 10/2006 |
| EP | 1972706 | | 9/2008 |
| EP | 2023762 | | 2/2009 |
| EP | 2079336 | | 7/2009 |
| EP | 2088887 | | 8/2009 |
| EP | 1571938 | | 11/2009 |
| EP | 2248434 | | 11/2010 |
| EP | 2378910 | | 10/2011 |
| EP | 1919321 | | 8/2012 |
| EP | 2485619 | | 8/2012 |
| EP | 2520188 | | 11/2012 |
| EP | 1571938 | | 5/2013 |
| EP | 2088887 | | 5/2013 |
| EP | 2591694 | | 5/2013 |
| EP | 2649898 | | 10/2013 |
| EP | 2716177 | | 7/2014 |
| EP | 2803283 | | 1/2015 |
| EP | 1773149 | B1 | 6/2015 |
| EP | 2904920 | | 8/2015 |
| EP | 2952346 | | 12/2015 |
| EP | 2977205 | | 1/2016 |
| EP | 2686467 | | 4/2016 |
| EP | 2713793 | | 6/2016 |
| EP | 2505092 | | 8/2016 |
| FR | 858875 | | 12/1940 |
| FR | 862088 | | 2/1941 |
| FR | 2171172 | | 9/1973 |
| FR | 2491739 | | 9/1982 |
| FR | 2506576 | | 12/1984 |
| FR | 2504786 | | 1/1986 |
| FR | 2648684 | | 12/1990 |
| FR | 2776485 | | 4/2000 |
| FR | 2780619 | | 9/2000 |
| FR | 2784550 | | 1/2001 |
| FR | 2848807 | | 7/2013 |
| GB | 109091 | | 8/1917 |
| GB | 273968 | | 7/1927 |
| GB | 323457 | | 1/1930 |
| GB | 413279 | | 7/1934 |
| GB | 538865 | | 8/1941 |
| GB | 674835 | | 7/1952 |
| GB | 761519 | | 11/1956 |
| GB | 782562 | | 9/1957 |
| GB | 832518 | | 4/1960 |
| GB | 1102447 | | 2/1968 |
| GB | 1219433 | | 1/1971 |
| GB | 1328693 | | 8/1973 |
| GB | 1539886 | | 2/1979 |
| GB | 2018837 | | 10/1979 |
| GB | 1572493 | | 7/1980 |
| GB | 1581999 | | 12/1980 |
| GB | 1603487 | | 11/1981 |
| GB | 2044073 | | 3/1983 |
| GB | 2131677 | | 6/1984 |
| GB | 2133273 | | 7/1984 |
| GB | 2214939 | | 4/1992 |
| GB | 317184 | | 8/2003 |
| GB | 413017 | | 7/2004 |
| GB | 2408190 | | 5/2005 |
| JP | S39-16845 | | 6/1939 |
| JP | S59-166706 | U | 11/1984 |
| JP | S63-057909 | | 4/1988 |
| JP | 02079336 | | 3/1990 |
| JP | H02-116806 | U | 9/1990 |
| JP | H03-003203 | U | 1/1991 |
| JP | H05-176804 | A | 7/1993 |
| JP | H06-008722 | Y2 | 3/1994 |
| JP | 06113905 | | 4/1994 |
| JP | H06-154001 | A | 6/1994 |
| JP | H06-248501 | A | 9/1994 |
| JP | H06-296507 | A | 10/1994 |
| JP | 3005269 | | 12/1994 |
| JP | H07-059604 | | 3/1995 |
| JP | H07-025804 | | 5/1995 |
| JP | H07-148004 | A | 6/1995 |
| JP | H07-246101 | A | 9/1995 |
| JP | 08109553 | | 4/1996 |
| JP | H09-047302 | A | 2/1997 |
| JP | H09-238701 | A | 9/1997 |
| JP | H10-000103 | A | 1/1998 |
| JP | H10-130991 | A | 5/1998 |
| JP | H10-155504 | A | 6/1998 |
| JP | H10-179209 | A | 7/1998 |
| JP | H03-064834 | U | 5/1999 |
| JP | H11-229253 | A | 8/1999 |
| JP | 11302943 | | 11/1999 |
| JP | 2000-015732 | | 1/2000 |
| JP | 2000-279201 | A | 10/2000 |
| JP | 2001017206 | | 1/2001 |
| JP | 2001-104091 | A | 4/2001 |
| JP | 2001-164407 | A | 6/2001 |
| JP | 2001-164444 | A | 6/2001 |
| JP | 2002-088512 | | 3/2002 |
| JP | 2002146654 | | 5/2002 |
| JP | 2004-230151 | | 8/2004 |
| JP | 2004-283586 | | 10/2004 |
| JP | 2006-150064 | A | 6/2006 |
| JP | 2006-249586 | A | 9/2006 |

(56) References Cited

FOREIGN PATENT DOCUMENTS

| | | | |
|---|---|---|---|
| JP | 3865307 | B2 | 1/2007 |
| JP | 2007-204864 | | 8/2007 |
| JP | 2007-236612 | | 9/2007 |
| JP | 2007-239151 | | 9/2007 |
| JP | 4376792 | | 12/2009 |
| JP | 2010-030289 | A | 2/2010 |
| JP | 2010-163712 | A | 7/2010 |
| JP | 2010-275649 | A | 12/2010 |
| JP | 2011-256506 | A | 12/2011 |
| JP | 2012-500071 | A | 1/2012 |
| JP | 4851688 | B2 | 1/2012 |
| JP | 2012062615 | | 3/2012 |
| JP | 2012-512698 | A | 6/2012 |
| JP | 2012-522551 | A | 9/2012 |
| JP | 2012533404 | | 12/2012 |
| JP | 2013-151783 | A | 8/2013 |
| JP | 2015-025223 | A | 2/2015 |
| NL | 7304678 | | 10/1974 |
| NL | 7505389 | | 11/1975 |
| WO | 9003744 | | 4/1990 |
| WO | 9221806 | | 12/1992 |
| WO | 1997/046127 | A1 | 12/1997 |
| WO | 9843506 | | 10/1998 |
| WO | 9914415 | | 3/1999 |
| WO | 9943229 | | 9/1999 |
| WO | 0032861 | | 6/2000 |
| WO | 0033694 | | 6/2000 |
| WO | 0112003 | | 2/2001 |
| WO | 0112004 | | 2/2001 |
| WO | 0231247 | | 4/2002 |
| WO | 0241721 | | 5/2002 |
| WO | 2002072325 | | 9/2002 |
| WO | 2004064558 | | 8/2004 |
| WO | 2004066770 | | 8/2004 |
| WO | 2004098333 | | 11/2004 |
| WO | 2005004656 | | 1/2005 |
| WO | 2005025841 | | 3/2005 |
| WO | 2005055754 | | 6/2005 |
| WO | 2005074737 | | 8/2005 |
| WO | 2007005459 | | 1/2007 |
| WO | 2009143000 | | 11/2009 |
| WO | 2010020391 | | 2/2010 |
| WO | 2010090923 | | 8/2010 |
| WO | 2011108954 | | 9/2011 |
| WO | 2011138639 | | 11/2011 |
| WO | 2012018731 | | 2/2012 |
| WO | 2012125473 | | 9/2012 |
| WO | 2012125483 | | 9/2012 |
| WO | 2012125490 | | 9/2012 |
| WO | 2012138488 | | 10/2012 |
| WO | 2012151408 | | 11/2012 |
| WO | 2012166602 | | 12/2012 |
| WO | 2012166607 | | 12/2012 |
| WO | 2013086145 | | 6/2013 |
| WO | 2013126314 | | 8/2013 |
| WO | 2013192363 | | 12/2013 |
| WO | 2014078152 | | 5/2014 |
| WO | 2014078158 | | 5/2014 |
| WO | 2014078160 | | 5/2014 |
| WO | 2014078161 | | 5/2014 |
| WO | 2014081680 | | 5/2014 |
| WO | 2014085205 | | 6/2014 |
| WO | 2014085206 | | 6/2014 |
| WO | 2014113352 | | 7/2014 |
| WO | 2014134236 | | 9/2014 |
| WO | 2014134237 | | 9/2014 |
| WO | 2014134239 | | 9/2014 |
| WO | 2014134242 | | 9/2014 |
| WO | 2014134244 | | 9/2014 |
| WO | 2014134247 | | 9/2014 |
| WO | 2014137825 | | 9/2014 |
| WO | 2015030914 | | 3/2015 |
| WO | 2015076893 | | 5/2015 |
| WO | 2015134648 | | 9/2015 |
| WO | 2016018904 | | 2/2016 |

OTHER PUBLICATIONS

Clothing Technology, Excerpt of Hannelore Eberle, 2002, 3 pages.
Compendium Warp Knitting, Magazine, Aug. 1, 1978, 8 pages.
Duolastic—an elastic fabric sets new standards, HKS 1 MSU E-Magazine, Aug. 4, 1989, 8 pages.
Fabric Pictures, Internet, 7 pages.
ISO 8117:2003(E) Textile Machinery—Knitting Machines—Nominal diameters of circular machines, Second Edition, Feb. 15, 2003, 6 pages.
Jacquard Rashchel machine for the Production of Curtains, Magazine, Jan. 12, 1996, 4 pages.
Knitting Wear, Santoni S.p.A. publication, SM8 Top 1, 2 pages.
MRSS 42 SU: for producing the finest Ices with ground in 22 dtex monofilaments, Magazine, Aug. 4, 1988, 14 pages.
Multibar Jacquard Raschel Machine for Lace, Net Curtains and Patterned Elastic Products, Magazine, Aug. 4, 1978, 6 pages.
*U.S. Appl. No. 14/257,737, Final Office Action dated Jun. 16, 2016, 15 pages.
*U.S. Appl. No. 14/257,737, Final Office Action dated Jul. 8, 2015, 16 pages.
*U.S. Appl. No. 14/257,737, Non Final Office Action dated Dec. 19, 2016, 18 pages.
*U.S. Appl. No. 14/257,737, Non-Final Office Action dated Dec. 26, 2014, 16 pages.
*U.S. Appl. No. 14/257,737, Non-Final Office Action dated Jan. 22, 2016, 17 pages.
Decision on Appeal in U.S. Reexam Application 95/001,320, filed as Exhibit 2008 on Dec. 28, 2012, 37 pages.
Anand, Technical Fabric Structures—2. Knitted Fabrics, Handbook of Technical Textiles, Woodhead Publishing, 2000, 5 pages.
Burall, CoID Design Awards, Design, Jun. 1969, pp. 46-47.
Case No. 3:14-CV-1586 MO, Original Complaint, *Robert M. Lyden* v. *adidas America, Inc., adidas AG, adidas International Marketing B.V., The Finish Line, Inc., and Dick's Sporting Goods, Inc.*, United States District Court, District of Oregon, Portland Division, filed Oct. 8, 2014, 54 pages.
Chinese Application No. CN201410160626.9, Office Action dated May 10, 2016, 9 pages.
Ebrlle et al., Clothing Technology, Sixth German Edition and Third English Edition, Veriag Europa-Lehrmittel, Nourney, Vollmer GmbH & Co., D-42781 Haa-Guriten, ISBN 3-8085-6223-4, Nov. 28, 2012, 20 pages.
Freshness Magazine, The Story Behind Nike Flyknit Technology, The Story Behind Nike Flyknit Technology (video), available online at http://web.archive.org/web/20120225004803/http://www.freshnessmag.com/2012/02/21/the-story-behind-nike-flyknit-technology-video, available to the public at least as early as Feb. 21, 2012, 3 pages.
R. Shishoo, Chapter 16 of Textiles in Sport filed as Exhibit 2004 in IPR2013-00067 filed on Nov. 28, 2012, 22 pages.
Decision Institution of Inter Partes Review 37 C.F.R. § 42.108 filed in IPR2013-00067 on May 17, 2013, 38 pages.
Decision Motion to Withdraw § 42.10(e), filed in IPR2013-00067 on Oct. 30, 2013, 3 pages.
Declaration and Curriculum Vitae of Dr. Edward C. Frederick, filed as Exhibit 1001 in IPR2013-00067on Nov. 28, 2012, 178 pages.
Declaration Edward C. Frederick with note, filed as Exhibit 2002 in IPR2013-00067 on Aug. 19, 2013, 23 pages.
Declaration of Raymond Tonkel, filed as Exhibit 2010 in IPR2013-00067 on 101 pages.
Edward Frederick Deposition Transcript, filed as Exhibit 2009 in IPR2013-00067 on Jul. 23, 2013, 187 pages.
Errata Sheet from Edward Frederick Deposition, filed as Exhibit 2013 in IPR2013-00067 on Aug. 29, 2013, 1 page.
Excerpts from Man-Made Fiber and Textile Dictionary, filed as Exhibit 2011 in IPR2013-00067 on Aug. 19, 2013, 12 pages.
Cross Examination Deposition of Raymond Tonkel, filed as Exhibit 1015 in IPR2013-00067 on Nov. 12, 2013, 114 pages.
Exhibit 1016, Declaration of Sabut Adanur Ph.D. filed in IPR2013-00067 on Nov. 12, 2013, 57 pages.
Exhibit 1017, Excerpt of Knitted Fabrics filed in IPR2013-00067on Nov. 12, 2013, 73 pages.

(56) References Cited

OTHER PUBLICATIONS

Exhibit 1018, Excerpt of Bharat J. Gaijar, Wrap Knit Fabrics filed in IPR2013-00067 on Nov. 12, 2013, 16 pages.
Exhibit 1019, J. Watel, the Milanese Machine: Little Progress Made in Development of Milanese Fabric filed in IPR2013-00067 on Nov. 12, 2013, 4 pages.
Exhibit 1023, Supplemental Declaration of Edward C. Frederick filed in IPR2013-00067 on Nov. 12, 2013, 18 pages.
Exhibit 2007, U.S. Pat. No. 7,347,011 with markings filed in IPR2013-00067 on Aug. 19, 2013, 22 pages.
Exhibit 2015, Excerpts from Celanese Corporation Man-Made Fiber and Textile Dictionary filed in IPR2013-00067 on Dec. 11, 2013, 5 pages.
Exhibit 2016, Excerpts from Hoechst Celanese Dictionary of Fiber & Textile Technology filed in IPR2013-00067 on Dec. 11, 2013, 4 pages.
Exhibit 2017, Excerpts from Celanese Corporation Man-Made Fiber and Textile Dictionary filed in IPR2013-00067 on Dec. 11, 2013, 10 pages.
Exhibit 2018, Excerpts from Hoechst Celanese Dictionary of Fiber & Textile Technology filed in IPR2013-00067 on Dec. 11, 2013, 11 pages.
Exhibit 2020, transcript of Dec. 3, 2013, second cross-examination deposition of Edward C. Frederick filed in IPR2013-00067 on Dec. 11, 2013, 59 pages.
Exhibit 2021, transcript of Dec. 3, 2013, cross-examination deposition of Sabit Adanur filed in IPR2013-00067 on Dec. 11, 2013, 139 pages.
Exhibit 2022, signature page for transcript of Dec. 3, 2013, Frederick deposition (Ex. 2020) filed in IPR2013-00067 on Jan. 7, 2014, 1 page.
Exhibit 2023, signature page for transcript of Dec. 3, 2013, Adanur deposition (Ex. 2021) filed in IPR2013-00067 on Jan. 7, 2014, 1 page.
Exhibit 3001 filed in IPR2013-00067 on Apr. 28, 2014, 3 pages.
Exhibit 3002 filed in IPR2013-00067 on Apr. 28, 2014, 4 pages.
File History for U.S. Pat. No. 7,347,011, filed as Exhibit 1003 in IPR2013-00067 on Nov. 28, 2012, 201 pages.
Final Written Decision filed in IPR2013-00067 on Apr. 28, 2014, 43 pages.
Hunter, Billy, viewpoint: Nike Flyknit Quantum Leap for Flat Knitting, www.knittingindustry.com filed as Exhibit 1024 in IPR2013-00067 on Nov. 12, 2013, 5 pages.
Hunter, Billy, viewpoint: Nike Flyknit Ready, Steady, Go, www.knittingindustry.com as Exhibit 1025 in IPR2013-00067 on Nov. 12, 2013, 5 pages.
Nike, Inc. Notice of Appeal filed in IPR2013-00067 on Jun. 30, 2014, 5 pages.
Nike's Motion to Amend filed in IPR2013-00067 on Aug. 19, 2013, 19 pages.
Notice of Filing Date Accorded to Petition and Time for Filing Patent Owner Preliminary Response entered in IPR2013-00067 dated Dec. 4, 2012, 8 pages.
Oral Hearing Transcript filed in IPR2013-00067 on Mar. 5, 2014, 41 pages.
Order Conduct of the Proceeding entered in IPR2013-00067 on Jun. 19, 2013, 4 pages.
Order Conduct of the Proceeding entered in IPR2013-00067 on Aug. 2, 2013, 5 pages.
Order Conduct of the Proceeding § 42.5 filed in IPR2013-00067 on Jan. 23, 2014, 3 pages.
Order Trial Hearing filed in IPR2013-00067 on Jan. 13, 2014, 4 pages.
Patent Owner Corrected Certificate of Service, filed in IPR2013-00067 on Aug. 19, 2013, 3 pages.
Patent Owner Opposition to Motion to Exclude filed in IPR2013-00067 on Jan. 21, 2014, 8 pages.
Patent Owner's Motion to Amend U.S. Pat. No. 7,347,011, filed in IPR2013-00067 on Aug. 19, 2013, 19 pages.
Patent Owner's Preliminary Response to Petition filed in IPR2013-00067 on Feb. 28, 2013, 8 pages.
Patent Owner's Reply to Petitioner's Opposition to Motion to Amend filed in IPR2013-00067 on Dec. 11, 2013, 9 pages.
Patent Owner's Trial Hearing Demonstratives filed in IPR2013-00067 on Feb. 6, 2014, 47 pages.
Petition for Inter Partes Review Under 35 U.S.C. 311-319 and 37 CFR 42.100 et seq., filed in IPR2013-00067 on Nov. 28, 2012, 66 pages.
Petitioner's Amended Notice of Cross Examination of Raymond Tonkel filed in IPR2013-00067 on Nov. 1, 2013, 3 pages.
Petitioner's Opposition to Patent Owner's Motion to Amend filed in IPR2013-00067 on Nov. 12, 2013, 20 pages.
Petitioner's Motion to Exclude Evidence filed in IPR2013-00067 on Jan. 7, 2014, 8 pages.
Petitioner's Opposition to Patent Owner Motion to Amend filed in IPR2013-00067 on Nov. 12, 2013, 20 pages.
Petitioner's Reply to Patent Owner's Opposition to Petitioner's Motion to Exclude Evidence filed in IPR2013-00067 on Jan. 28, 2014, 8 pages.
Random House Webster Dictionary Excerpts filed as Exhibit 2012 in IPR2013-00067 on Aug. 19, 2013, 4 pages.
Revised Petition for Inter Partes Review Under 35 U.S.C. §§ 311-319 and 37 C.F.R. § 42.100 filed in IPR2013-00067 on Dec. 10, 2012, 63 pages.
Submission of Patent Owner's Trial Hearing Demonstratives filed in IPR2013-00067 on Feb. 6, 2014, 3 pages.
U.S. Pat. No. 2,147,197 with markings, filed as Exhibit 2006 in IPR2013-00067 on Aug. 19, 2013, 5 pages.
U.S. Pat. No. 4,354,318, filed as Exhibit 2003 in IPR2013-00067 on Aug. 19, 2013, 6 pages.
IPR2016-00920, Exhibit 1003, Declaration of Lenny M. Holden, Apr. 19, 2016, 166 pages.
IPR2016-00920, Petition for Inter partes Review of U.S. Pat. No. 8,042,288 filed in Apr. 19, 2016, 67 pages.
IPR2016-00921, Petition for Inter Partes Review of U.S. Pat. No. 7,814,598 filed on Apr. 19, 2016, 57 pages.
IPR2016-00921 and -00922, Exhibit 1003, Declaration of Lenny M. Holden, Apr. 19, 2016, 154 pages.
IPR2016-00922, Petition for Inter Partes Review of U.S. Pat. No. 8,266,749 filed on Apr. 19, 2016, 67 pages.
Reissue U.S. Appl. No. 95/002,094, Rebuttal on filed Sep. 3, 2014, 40 pages.
Reissue U.S. Appl. No. 95/002,094, Rebuttal on filed Sep. 22, 2014, 25 pages.
Spencer, Knitting Technology, Woodhead Publishing Limited, 1989 and 2001, 413 pages.
Underwood , The Design of 3D Shape Knitted Preforms, Ph.D. Thesis for School of Fashion and Textile, Design and Social Context Portfolio, RMIT University, Nov. 2009, 201 pages.
Chinese Patent Application No. 2005800066703, Office Action dated Jun. 13, 2008, 17 pages.
Chinese Patent Application No. 2005800066703, Office Action dated Jul. 27, 2007, 18 pages.
Chinese Patent Application No. 2005800066703, Office Action dated Aug. 21, 2009, 19 pages.
Chinese Patent Application No. 2005800066703, Office Action dated Feb. 15, 2008, 6 pages.
Chinese Patent Application No. 2009101783949, Office Action dated May 13, 2011, 13 pages.
International Patent Application No. PCT/US2005/004776, International Search Report and Written Opinion dated May 19, 2005, 15 pages.
PCT Patent Application No. PCT/US2009/056795, International Search Report and Written Opinion dated Apr. 20, 2010, 16 pages.
PCT Patent Application No. PCT/US2012/028576, International Search Report and Written Opinion dated Oct. 1, 2012, 10 pages.
PCT Patent Application No. PCT/US2012/028534, International Search Report and Written Opinion dated Oct. 17, 2012, 14 pages.
PCT Patent Application No. PCT/US2012/028559, International Search Report and Written Opinion dated Oct. 19, 2012, 9 pages.
PCT Patent Application No. PCT/US2012/028534, International Preliminary Report on Patentability dated Sep. 17, 2013, 8 pages.

(56) References Cited

OTHER PUBLICATIONS

PCT Patent Application No. PCT/US2012/028576, International Preliminary Report on Patentability dated Sep. 17, 2013, 7 pages.
European Patent Application No. 13161357.2, Extended European Search Report dated Aug. 5, 2013, 6 pages.
From Fiber to Fabric: Silk, Clothing and Textiles, Utah State University Cooperative Extension, http://extension.usu.edu./files/publications/factsheet/FC_Clothing&Textiles_2012-25pr.pdf, 2011, 3 pages.
Petition for Inter Partes Review Under 35 U.S.C. §§ 311-319 and 37 C.F.R. § 42.100 ET SEQ. with Exhibit 1003, Declaration of Lenny M. Holden, Inter Partes Review No. 2017-00263, Nov. 14, 2016.
Petition for Inter Partes Review Under 35 U.S.C. §§ 311-319 and 37 C.F.R. § 42.100 ET SEQ. with Exhibit 1003, Declaration of Lenny M. Holden, Inter Partes Review No. 2017-00264, Nov. 14, 2016.
Federal Circuit Case Nos. 18-1180 & 18-1181, Appellant s Reply in Support of Motion to Remand, Jun. 5, 2018, 16 pages.
Federal Circuit Case Nos. 18-1180 & 18-1181, Appellant s Motion for Remand to PTAB, May 24, 2018, 19 pages.
Federal Circuit Case Nos. 18-1180 & 18-1181, Appellee s Opposition to Motion to Remand to PTAB, Jun. 1, 2018, 21 pages.
Federal Circuit Case Nos. 18-1180 & 18-1181, Federal Circuit Decision to Remand to PTAB, Jul. 2, 2018, 4 pages.
Federal Circuit Case Nos. 18-1180 & 18-1181, Appellant s Reply Brief, May 1, 2018, 41 pages.
Federal Circuit Case Nos. 18-1180 & 18-1181, Appellee s Corrected Response Brief, Apr. 12, 2018, 75 pages.
Federal Circuit Case Nos. 18-1180 & 18-1181, Appellant s Opening Brief, Feb. 26, 2018, 79 pages.
IPR2016-00921 & IPR2016-00922, Exhibit 1013, Analyzing the Color, Design and Texture of Fabric, 8 pages.
IPR2016-00921 & IPR2016-00922, Exhibit 1014, Merriam-Webster Dictionary Definition of Impart, 11 pages.
IPR2016-00921 & IPR2016-00922, Exhibit 2004, Transcript of Deposition of Lenny Holden, 226 pages.
IPR2016-00921 & IPR2016-00922, Exhibit 3001, Random House Webster s College Dictionary Definition of Impart and Texture, 4 pages.
IPR2016-00921 & IPR2016-00922, Record of Oral Hearing, Jul. 26, 2017, 74 pages.
IPR2016-00921 & IPR2016-00922, Exhibit 1016, Adidas s Oral Hearing Demonstratives, 84 pages.
"Knitting Machine Wins Design Award—Textile Institute & Industry" , EBSCO Host,Textile Institute & Industry, vol. 7, Issue 7, Jul. 1969, 3 pages.
"Polyamide 6.6 Emana Yarn" , 5 pages.
U.S. Appl. No. 14/257,737, Final Office Action , dated Oct. 3, 2017, 15 pages.
U.S. Appl. No. 14/257,737, Non-Final Office Action , dated Mar. 9, 2018, 13 pages.
Aibibu et al., "Textile Cell-free Scaffolds for in Situ Tissue Engineering Applications" , Journal of Materials Science: Materials in Medicine, vol. 27, No. 3, Mar. 2016, 20 pages.
Atalay et al., "Knitted Strain Sensors: Impact of Design Parameters on Sensing Properties" , Sensors, vol. 14, No. 3, 2014, 8 pages.
Atalay et al., "Textile-Based Weft Knitted Strain Sensors: Effect of Fabric Parameters on Sensor Properties , Sensors (Basel)", vol. 13, No. 8, Aug. 21, 2013, 6 pages.
Barton et al., "Development and Evaluation of a Tool for the Assessment of Footwear Characteristics" , Journal of Foot and Ankle Research, vol. 2, 2009, 13 pages.
Office Action, German Patent Application No. 102013207156.6 , dated Mar. 24, 2014, 5 pages (see transmittal for summary).
Office Action, European Patent Application No. 14165042.4 , dated Jun. 26, 2018, 6 pages.
Federal Circuit Case No. 14-1719 , Appellant s Opening Brief to Federal Circuit, Dec. 15, 2014, 47 pages.
Federal Circuit Case No. 14-1719 , Appellant s Reply Brief, May 27, 2015, 38 pages.
Federal Circuit Case No. 14-1719 , Appellee s Response Brief to Federal Circuit, Apr. 10, 2015, 76 pages.
Federal Circuit Case No. 14-1719 , Federal Circuit Decision, Feb. 11, 2016, 41 pages.
Federal Circuit Case No. 14-1719 , Federal Circuit Mandate to PTAB, Apr. 4, 2016, 1 page.
Federal Circuit Case No. 14-1719 , United States Patent and Trademark Office s Solicitor s Brief to Federal Circuit, Apr. 9, 2015, 27 pages.
Hamlin , "The Hamlin Cleanroom Bootie" , MO-LA Inc., Technical Developments, vol. 18, Mar. 1993, 2 pages.
IPR2013-00067 , Excerpts from Man-Made Fiber and Textile Dictionary, Exhibit 2011, Aug. 19, 2013, 12 pages.
IPR2013-00067 , Decision on Remand, Sep. 18, 2018, 65 pages.
IPR2013-00067 , Exhibit 1027, Petitioner s Oral Hearing Demonstratives Slides, 25 pages.
IPR2013-00067 , Exhibit 3003, Email regarding Aqua Products Conference Call, 3 pages.
IPR2013-00067 , Order Conduct of Remand Proceeding, Aug. 10, 2016, 4 pages.
IPR2013-00067 , Patent Owner s Notice of Appeal, Jun. 30, 2014, 5 pages.
IPR2013-00067 , Patent Owner s Response Brief, Nov. 16, 2017, 12 pages.
IPR2013-00067 , Petitioner s Opening Brief, Nov. 6, 2017, 12 pages.
IPR2013-00067 , Petitioner s Reply Brief on Remand, Nov. 22, 2017, 6 pages.
IPR2016-00920 , Decision Denying Institution of Inter Partes Review, Oct. 20, 2016, 8 pages.
IPR2016-00921 , Petitioner s Notice of Supplemental Evidence in Response to Patent Owner s Objection to Evidence, May 12, 2017, 4 pages.
IPR2016-00921 , Decision on Institution of Inter Partes Review, Oct. 21, 2016, 24 pages.
IPR2016-00921 , Final Written Decision, Oct. 19, 2017, 49 pages.
IPR2016-00921 , Order Modifying Institution Decision and Granting Request for Additional Briefing, Aug. 24, 2018, 14 pages.
IPR2016-00921 , Patent Owner s Objection to Admissability of Evidence, Apr. 28, 2017, 4 pages.
IPR2016-00921 , Patent Owner s Response Brief, Jan. 23, 2017, 64 pages.
IPR2016-00921 , Patent Owner s Response Brief Addressing the Newly Instituted Ground, Sep. 24, 2018, 14 pages.
IPR2016-00921 , Petitioner s Brief Addressing Newly Instituted Ground, Sep. 10, 2018, 12 pages.
IPR2016-00921 , Petitioner s Notice of Appeal, Nov. 13, 2017, 4 pages.
IPR2016-00921 , Petitioner s Reply to Patent Owner Response, Apr. 21, 2017, 32 pages.
IPR2016-00922 , Decision on Institution of Inter Partes Review, Oct. 21, 2016, 24 pages.
IPR2016-00922 , Petitioner s Notice of Supplemental Evidence in Response to Patent Owner s Objections to Evidence 37 C.F.R. § 42.64(B)(1), May 12, 2017, 4 pages.
IPR2016-00922 , Final Written Decision, Oct. 19, 2017, 52 pages.
IPR2016-00922 , Order Modifying Institution Decision and Granting for Additional Briefing, Aug. 24, 2018, 14 pages.
IPR2016-00922 , Patent Owner s Objection to Admissability of Evidence, Apr. 28, 2017, 4 pages.
IPR2016-00922 , Patent Owner s Response Brief, Jan. 23, 2017, 66 pages.
IPR2016-00922 , Patent Owner s Response Brief Addressing Newly Instituted Ground, Sep. 24, 2018, 14 pages.
IPR2016-00922 , Petitioner s Brief Addressing Newly Instituted Ground , Sep. 10, 2018, 12 pages.
IPR2016-00922 , Petitioner s Notice of Appeal , Nov. 13, 2017, 4 pages.
IPR2016-00922 , Petitioner s Reply Brief , Apr. 21, 2017, 34 pages.
IPR2017-00263 , Decision Denying Institution of Inter Partes Review , Jun. 7, 2017, 11 pages.
IPR2017-00263 , Decision Denying Request for Rehearing , Jul. 20, 2017, 12 pages.

(56) References Cited

OTHER PUBLICATIONS

IPR2017-00263 , Patent Owner s Corrected Preliminary Response , Mar. 27, 2017, 24 pages.
IPR2017-00263 , Patent Owner s Preliminary Response , Mar. 9, 2017, 24 pages.
IPR2017-00263 , Petitioner s Request for Rehearing , Jul. 7, 2017, 17 pages.
IPR2017-00264 , Decision Denying Institution of Inter Partes Review , Jun. 7, 2017, 12 pages.
IPR2017-00264 , Decision Denying Request for Rehearing , Jul. 20, 2017, 12 pages.
IPR2017-00264 , Patent Owner s Corrected Preliminary Response , Mar. 27, 2017, 24 pages.
IPR2017-00264 , Patent Owner s Preliminary Response , Mar. 9, 2017, 24 pages.
IPR2017-00264 , Petitioner s Request for Rehearing , Jul. 7, 2017, 17 pages.
Lo et al., "Effects of Custom-Made Textile Insoles on Plantar Pressure Distribution and Lower Limb Emg Activity During Turning" , Journal of Foot and Ankle Research, vol. 9, Jul. 13, 2016, 11 pages.
Office Action , German Patent Application No. 102013207156.6 , dated Sep. 19, 2017, 8 pages (see transmittal for summary).
Office Action , Japanese Patent Application No. 2014-077414 , dated Feb. 27, 2018.
Saenz-Cogollo et al., "Pressure Mapping Mat for Tele-Home Care Applications" , Sensors, vol. 16, No. 3, E365, Mar. 11, 2016, 9 pages.
Singh et al., "Medical Textiles as Vascular Implants and Their Success to Mimic Natural Arteries" , Journal of functional biomaterials, vol. 6, No. 3, Sep. 2015, 15 pages.
Stoppa et al., "Wearable Electronics and Smart Textiles: A Critical Review" , Sensors, vol. 14, No. 7, 2014, 20 pages.
Photograph of Adizero Prime SP Olympia, 2012.
Photograph of Adios, 2012.
Buckley et al., "New Textile Concepts for Use in Control of Body Environments", Presented at RTO HFM Symposium on "Blowing Hot and Cold: Protecting Against Climatic Extremes", Dresden, Germany, Oct. 8-10, 2001, 7 pages.
Hong et al., "The Development of 3D Shaped Knitted Fabrics for Technical Purposes on a Flat Knitting Machine", Indian Journal of Fibre & Textile Research, vol. 19, pp. 189-194, Sep. 1994, 6 pages.
Lu et al. , "The Development of the Flat-Knitted Shaped Uppers Based on Ergonomics", AUTEX Research Journal, vol. 16, No. 2, pp. 67-74, Jun. 2016, 8 pages.
U.S. Appl. No. 14/257,668 , Final Office Action, dated Feb. 1, 2019, 29 pages.
U.S. Appl. No. 14/257,719 , Final Office Action, dated Jan. 24, 2019, 15 pages.
U.S. Appl. No. 14/257,737 , Final Office Action, dated Jan. 2, 2019, 15 pages.
U.S. Appl. No. 14/619,586 , Non-Final Office Action, dated Jan. 14, 2019, 10 pages.
Federal Circuit Case No. 19-1262, Appellee Adidas AG's Response Brief, Aug. 9, 2019, 60 pages.
IPR 19-1787, Appellant Adidas AG's Opening Brief, Aug. 30, 2019, 319 pages.
Notice of Opposition, European Patent Application No. 13161357.2, Apr. 1, 2019, 49 pages.
Office Action, Japanese Patent Application No. 2014-077414, dated Aug. 13, 2019, 8 pages.
European Extended Search Report, European Patent Application No. 14165042.4, dated Jul. 16, 2014, 7 pages.
Office Action, Japanese Patent Application No. 2014-077414, dated Dec. 25, 2018, 10 pages.
Office Action, Chinese Patent Application No. 201410160626.9, dated Jul. 23, 2015, 19 pages.
Office Action, Chinese Patent Application No. 201410160626.9, dated Dec. 27, 2016, 21 pages.
Summons to Attend Oral Hearing, European Patent Application No. 14165042.4, Mar. 1, 2019, 6 pages.
U.S. Appl. No. 14/257,737, Advisory Action, dated May 14, 2019, 6 pages.
IPR2016-00922, Petitioner adidas AG's Notice of Appeal, Apr. 19, 2019, 75 pages.
IPR2016-00922, Decision on Remand—35 USC 144 and 37 CFR 42.5(a), Feb. 19, 2019, 71 pages.
IPR2016-00921-00922, Transcript of Hearing Held Oct. 15, 2018, Oct. 17, 2018, 44 pages.
IPR2016-00921-00922, Petitioner's Demonstratives for Supplemental Oral Hearing, Nov. 7, 2018, 21 pages.
IPR2016-00921-00922, Patent Owner Nike's Demonstratives Jul. 11, 2017, 27 pages.
IPR2016-00921-00922, Nike's Demonstratives for Additional Oral Hearing Nov. 7, 2018, 21 pages.
IPR2016-00921-00922, Hearing Transcript, Nov. 29, 2018, 37 pages.
IPR2016-00921, Petitioner adidas AG's Notice of Appeal Apr. 19, 2019, 71 pages.
IPR2016-00921, Decision on Remand—35 USC 144 and 37 CFR42.5(a), Feb. 19, 2019, 67 pages.
IPR2013-00067, Nike's Notice of Appeal, Nov. 20, 2018, 69 pages.
Federal Circuit Case No. 19-1262, Principal Brief of Appellant Nike, Inc., May 17, 2019, 59 pages.
Eberle, et al., "Clothing Technology", Third English Edition, 2002.
Federal Circuit Case No. 19-1262, Reply Brief of Appellant Nike, Inc., Sep. 13, 2019, 38 pages.
Federal Circuit Case No. 19-1787, Reply Brief for Appellant Adidas AG, Dec. 23, 2019, 40 pages.
Federal Circuit Case No. 19-1787, Joint Appendix, Dec. 30, 2019, 582 pages.
Federal Circuit Case No. 19-1787, Appellee Nike, Inc.'s Response Brief, Nov. 25, 2019, 77 pages.
Federal Circuit Case No. 19-1262, Appellant's Citation of Supplemental Authority Pursuant to Rule 28(j), Jan. 29, 2020, 11 pages.
Decision on Appeal, Federal Circuit Case No. 19-1262, Apr. 9, 2020, 17 pages.
Judgment, Federal Circuit Case No. 19-1262, Apr. 9, 2020, 1 page.
Chamberlain , "Knitted Fabrics", 1919, pp. 80-103, Sir Isaac Pitman & Sons, Ltd., London.
Chamberlain , "Principles of Machine Knitting", 1951, pp. 54-57, The Textile Institute, Manchester.
Wignall , "Knitting", 1964, pp. 99-101, 116-129, Pitman Publishing, London.
U.S. Appl. No. 16/372,055, Final Office Action, dated Feb. 27, 2020, 19 pages.
Advisory Action, U.S. Appl. No. 16/372,055, dated May 27, 2020, 5 pages.
Advisory Action, U.S. Appl. No. 16/197,189, dated May 20, 2020, 8 pages.
Appellee Nike's Response to Citation of Supplemental Authority, Federal Circuit Case No. 19-1987, May 20, 2020, 3 pages.
Federal Circuit Case No. 19-1787, Appellant Adidas's Citation of Supplemental Authority, May 15, 2020, 31 pages.
Federal Circuit Case Nos. 19-1787 and 19-1788, Opinion, Jun. 25, 2020, 8 pages.
Non-Final Office Action, U.S. Appl. No. 16/197,181, dated May 27, 2020, 21 pages.
Notice of Allowance, U.S. Appl. No. 14/257,737, dated Jun. 19, 2020, 9 pages.
Order—Conduct of the Proceeding on Remand, IPR Case No. 2013-00067, Jul. 24, 2020, 6 pages.
U.S. Appl. No. 16/372,055, Non Final Office Action, dated Jul. 22, 2020, 23 pages.
European Search Report, European Patent Application No. 20165825.9, dated Aug. 13, 2020, 9 pages.
IPR2013-00067, Petitioner's Opening Brief on Remand, Aug. 20, 2020, 12 pages.
IPR2013-00067, Exhibit 2024, Intervenor's Petition for Panel Hearing, Appeal No. 2015-1928, Feb. 5, 2018, 38 pages.
IPR2013-00067, Petitioner's Response Brief on Remand, Sep. 3, 2020, 7 pages.

(56) References Cited

OTHER PUBLICATIONS

IPR2013-00067, Patent Owner's Reply Brief on Second Remand, Sep. 3, 2020, 7 pages.
IPR2013-00067, Patent Owner's Opening Brief on Second Remand, Aug. 20, 2020, 12 pages.

* cited by examiner

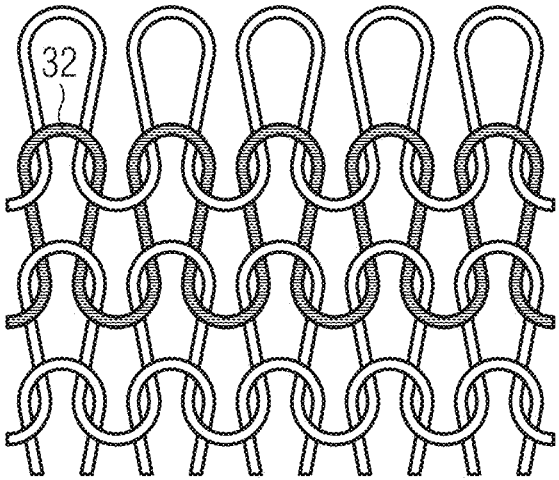
Fig. 3a
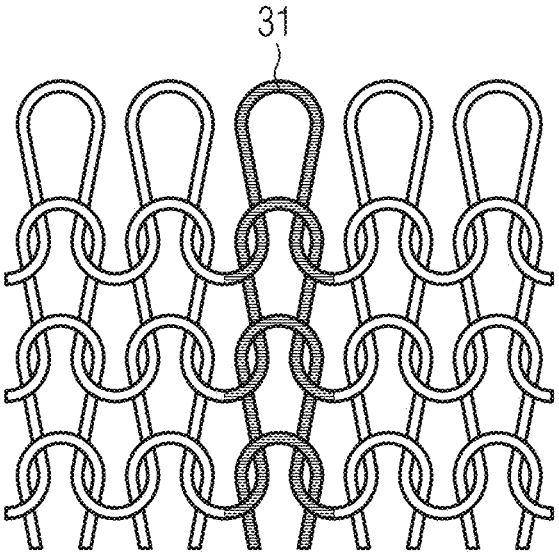
Fig. 3b
Fig. 4
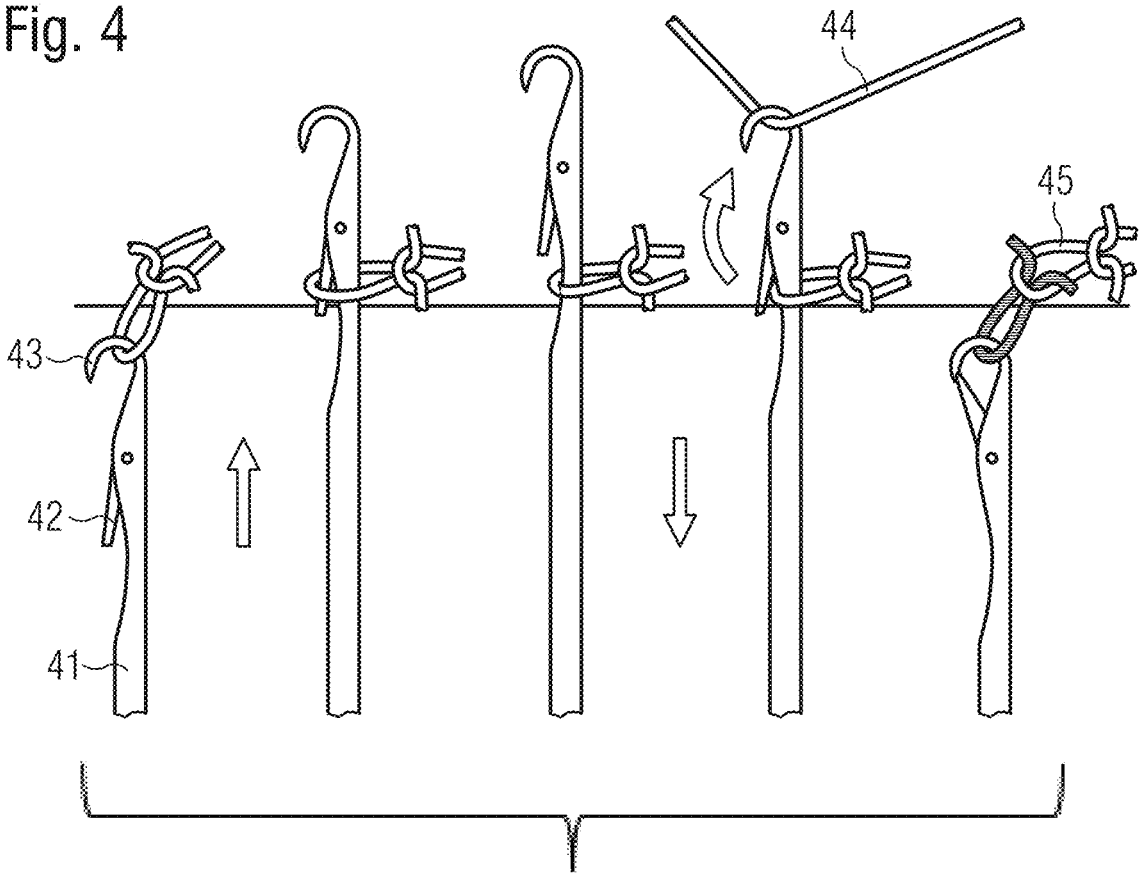

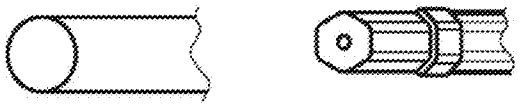
710
Fig. 7a
711
Fig. 7b
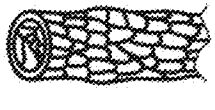
712
Fig. 7c
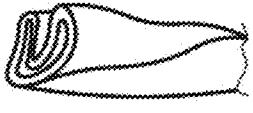
713
Fig. 7d
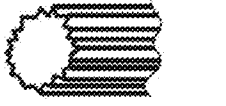
714
Fig. 7e
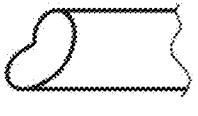
720
Fig. 7f
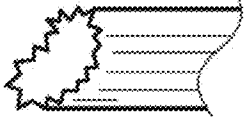
721
Fig. 7g
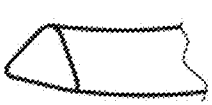
722
Fig. 7h
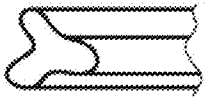
723
Fig. 7i
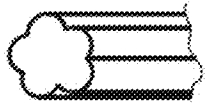
724
Fig. 7j
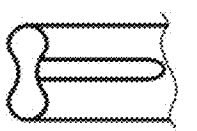
730
Fig. 7k
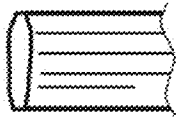
731
Fig. 7l
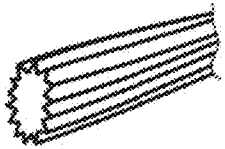
732
Fig. 7m
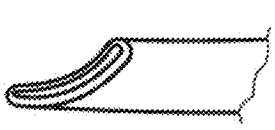
733
Fig. 7n
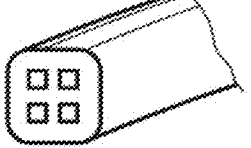
734
Fig. 7o

SHOE

CROSS REFERENCE TO RELATED APPLICATION

This application is a continuation patent application of U.S. application Ser. No. 14/257,737, filed Apr. 21, 2014, entitled SHOE ("the '737 application"), which is related to and claims priority benefits from German Patent Application No. DE 10 2013 207 156.6, filed on Apr. 19, 2013, entitled SHOE, IN PARTICULAR A SPORTS SHOE ("the '156 application"). The '737 and '156 applications are hereby incorporated herein in their entireties by this reference.

FIELD OF THE INVENTION

The present invention relates to a shoe, in particular a sports shoe.

BACKGROUND

In general, a shoe comprises an outer sole and an upper, which is attached to it. In particular, sports shoes further comprise in general a midsole, which is arranged between the upper and the outer sole, which is also called middle sole. The upper, the outer sole, and (as far as existing) the midsole are made of leather in classical shoes, and (as a general rule) are made of synthetic materials in sports shoes. The outer sole may also be made of rubber.

A shoe differs from a sock in that the upper of the shoe provides the foot with much greater stability than a sock does. The foot is fixed much tighter by an upper than it is by a sock. Moreover, the shoe sole protects the foot from injuries and provides cushioning, i.e. the sole absorbs impacts of forces, e.g. during running. By use of a suitable material, e.g. rubber and/or profiling, a shoe sole furthermore provides the necessary static friction with the underground. In many cases, a sock is not able to fulfill the above-described functions of a shoe.

Outer soles and midsoles made from leather are cut out from a piece of leather. Outer soles and midsoles made from rubber or plastic may be cut out from material webs or manufactured in a casting process.

Several aspects of known methods for manufacturing outer soles and midsoles proved to be disadvantageous. So, for instance, there is always a certain amount of waste in the manufacture of leather soles when the soles are cut out of a piece of leather.

In the manufacture of outer soles and midsoles of different materials, the connection of both is often problematic. If, for example, the outer sole is made of rubber and the midsole of polyurethane, then the two cannot be glued together without considerable effort. Very often, the use of an adhesion promoter is inevitable.

The outer sole and the midsole are often provided with functional areas particularly in sports shoes. For example, an outer sole receives zones with different profiles which may even comprise different materials or material mixtures. A midsole is, for example, provided with cushioning elements in specific areas in order to reduce typical strains on the wearer of the shoe during running. The forming of functional areas during the manufacturing process is often time-consuming and causes additional costs and processes and in most cases increases the weight of the shoe.

Hence, the present invention is based on the problem to reduce or avoid the above-mentioned disadvantages of prior art. In particular, the present invention is based on the problem to provide a light shoe, in particular a sports shoe, which may be manufactured in a simple, cost-effective manner and quickly, with little waste production.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a shoe comprises an upper and at least one of an outer sole and a midsole, one or more of the at least one of the outer sole and the midsole connected to the upper, and one or more of the at least one of the outer sole and the midsole comprising knitwear. In some embodiments, the upper comprises knitwear. In certain embodiments, knitwear in an area of the one or more of the at least one of the outer sole and the midsole and the knitwear in an area of the upper are formed as one-piece knitwear.

According to some embodiments, the knitwear in an area of the one or more of the at least one of the outer sole and the midsole comprises a different binding than the knitwear in an area of the upper. In certain embodiments, the knitwear in an area of the upper comprises a first yarn, and the knitwear in an area of the one or more of the at least one of the outer sole and the midsole comprises a second yarn. In various embodiments, the second yarn is thicker than the first yarn, and/or the second yarn is more abrasion-resistant than the first yarn, and/or second yarn is more water-repellent than the first yarn.

According to some embodiments, the knitwear in an area of the upper is more permeable to air than the knitwear in an area of the one or more of the at least one of the outer sole and the midsole.

In certain embodiments, the knitwear in an area of the one or more of the at least one of the outer sole and the midsole is arranged so that wales of the knitwear in the area of the one or more of the at least one of the outer sole and the midsole run substantially transversely to a longitudinal axis of the one or more of the at least one of the outer sole and the midsole.

In various embodiments, the knitwear comprises stability elements in an area of the one or more of the at least one of the outer sole and the midsole. In these embodiments, the stability elements may be at least one of ribs, waves, and knobs. The stability elements may also be arranged substantially transversely to a longitudinal axis.

According to some embodiments, the knitwear is weft-knitted. In other embodiments, the knitwear is warp-knitted.

In some embodiments, the one or more of the at least one of the outer sole and the midsole is reinforced with a polymer material. In certain embodiments, the knitwear comprises a thermoplastic yarn in an area of the one or more of the at least one of the outer sole and the midsole. In further embodiments, the at least one of the outer sole and the midsole comprises at least the outer sole, and the knitwear comprises at least one rubberized yarn in an area of the outer sole.

According to some embodiments, the knitwear in at least an area of the one or more of the at least one of the outer sole and the midsole has been at least partially immersed in at least one of a rubber bath and a polymer bath.

In certain embodiments, the knitwear in an area of the one or more of the at least one of the outer sole and the midsole is a spacer weft-knitted fabric or a spacer warp-knitted fabric. In these embodiments, the layers of the spacer weft-knitted fabric or the spacer warp-knitted fabric may comprise different yarns.

In some embodiments, the at least one of the outer sole and the midsole comprises the outer sole and the midsole, and the knitwear of the outer sole comprises a weft-knitted or a warp-knitted pocket into which the midsole is inserted.

According to certain embodiments of the present invention, a shoe comprises an upper comprising knitwear, and at least one of an outer sole and a midsole comprising knitwear connected to the upper.

According to certain embodiments of the present invention, a method for the manufacture of a shoe comprising an upper and at least one of an outer sole and a midsole, the method comprises providing the upper, manufacturing the at least one of the outer sole and the midsole, wherein one or more of the at least one of the outer sole and the midsole comprises knitwear, and joining one or more of the at least one of the outer sole and the midsole to the upper of the shoe.

BRIEF DESCRIPTION OF THE DRAWINGS

In the following detailed description, embodiments of the invention are described referring to the following figures:

FIGS. 3*a*-3*b* are schematic representations of weft-knitted fabrics, according to certain embodiments of the present invention.

FIG. 4 are illustrations showing a process of stitch forming by latch needles during weft-knitting, according to certain embodiments of the present invention.

FIGS. 7*a*-7*o* are cross-sectional views of fibers for yarns used in knitwear, according to certain embodiments of the present invention.

BRIEF DESCRIPTION

Figure 1A:
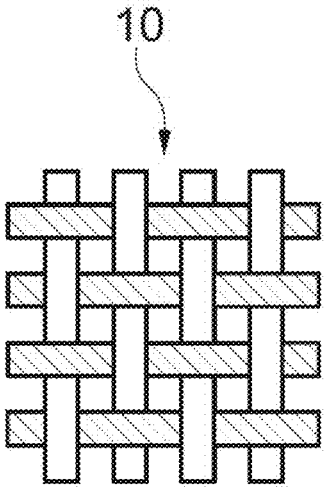
FIGS. 1*a*-1*d* are schematic representations of textile structures, according to certain embodiments of the present invention.
Figure 1B:
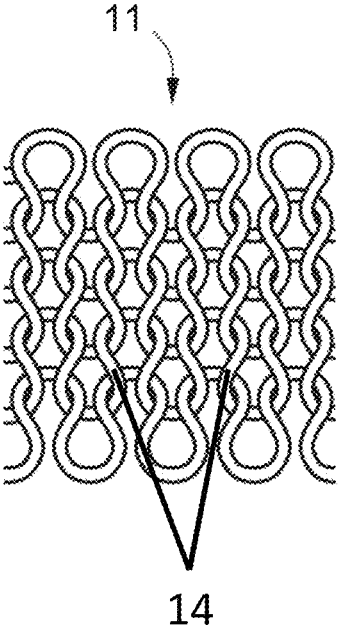
Figure 1C:
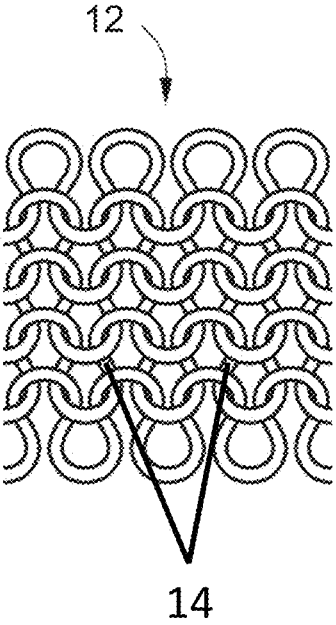
Figure 1D:
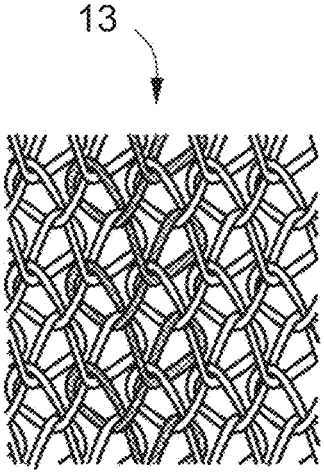

According to certain embodiments of the present invention, a shoe, in particular a sports shoe comprises an upper and an outer sole and/or a midsole that is connected with the upper, whereby the outer sole and/or the midsole comprise knitwear.

When using knitwear for the outer sole and/or the midsole, waste is largely avoided, since the knitwear may be manufactured on a weft-knitting machine or a warp-knitting machine in the required form without the necessity of a subsequent cutting to size.

If the outer sole and/or the midsole comprise knitwear, these may be connected with each other in a particularly easy way. For example, they may be sewn together, so that no adhesive or adhesion promoter is required. The outer sole and the midsole may also be joined by simple heating if the knitwear of the outer sole and/or of the midsole comprises a thermoplastic yarn, which fuses subject to pressure or heat and stiffens when it cools down subsequently.

The use of knitwear for an outer sole and/or a midsole may be beneficial for providing the outer sole and/or the midsole with functional areas. Already during manufacture of the knitwear, for example on a weft-knitting machine or a warp-knitting machine, the corresponding areas may be formed. Flexibility is desired in the area of the forefoot, for example, which may e.g. be achieved by knitting in structures with a joint function. In the midfoot area, in contrast, stability is frequently required, which may e.g. be achieved by correspondingly tighter stitch formation. In the area of the rear foot, in particular in sports shoes, a high degree of cushioning is frequently desired, which may be achieved by thicker knitwear, for example.

In a further example, the thickness of the knitwear may be simply adapted in accordance with the strain in certain areas of the outer sole and/or the midsole by varying the thickness of the yarn, the type of yarn or the yarn material and/or the knit structure. In addition, coarser stitches and/or weft-knitted-in openings in the knitwear may provide air permeability to the foot of a wearer of the shoe from the side of the sole.

The features described above are obtained by using knitwear for an outer sole and/or a midsole of a shoe.

In some embodiments, the upper of the shoe comprises knitwear. Due to this, the upper may be easily joined with the outer sole and/or the midsole, for example by sewing.

In certain embodiments, the upper of the shoe is formed as a one-piece knitwear with the outer sole and/or the midsole. This allows a very simple manufacturing of the whole shoe in one process, for example on a weft-knitting machine or a warp-knitting machine.

In some embodiments, the knitwear has a different binding in the area of the outer sole and/or the midsole than in the area of the upper of the shoe. By the selection of a suitable binding for the upper and the outer sole and/or midsole, respectively, functional areas may be specifically provided. For example, in the area of the outer sole, a more resistant bonding (e.g. the so-called twill weave in non-woven fabrics) could be used, so that the upper adapts easily to the respective foot form. In the upper, hence, a more elastic binding (the so-called tricot binding in warp-knitted fabrics) could be used, so that the upper adapts easily to the respective foot form.

In some embodiments, the upper comprises a first yarn and the knitwear comprises a second yarn in the area of the outer sole and/or the midsole. The selection of suitable yarns allows a functional adaption of the corresponding knitwear. For example, in the area of the outer sole, a rubberized yarn could be used that increases the static friction and hence the traction. In the area of the upper, a yarn that promotes permeability to air, e.g. a yarn with comparatively little volume, could be used.

In some embodiments, the second yarn is thicker than the first yarn. Due to this, the outer sole and/or the midsole becomes thicker as a whole, so that the cushioning characteristics are improved. In the area of the outer sole, in addition, a thicker yarn ensures a longer durability of the outer sole. In contrast, in the area of the upper, a thinner yarn promotes the permeability to air.

In some embodiments, the second yarn is more abrasion-resistant than the first yarn. Thereby, the outer sole and/or the midsole, which are exposed to greater strains as compared to the upper, are rendered more durable and long-lasting. The abrasion-resistant yarn could, for example, be a Kevlar® yarn or other para-aramid synthetic fiber.

In some embodiments, the second yarn is more water-repellent than the first yarn. Thereby, the ingress of water into the outer sole and a midsole that is possibly arranged above is reduced or prevented entirely.

In some embodiments, the knitwear is more permeable to air in the area of the upper than in the area of the outer sole and/or midsole. This promotes the exchange of air between the inside of the shoe and the outside, humid air is transported outwards from the foot and fresh air is supplied to the foot. The outer sole may be weft-knitted or warp-knitted in a more fine-meshed manner, in contrast, in order to keep dirt and water off.

In some embodiments, the knitwear is arranged in the area of the outer sole and/or midsole such that the wales of the knitwear are essentially transverse to a longitudinal axis of the outer sole and/or the midsole. Thereby, the traction is increased in particular in the longitudinal direction, since the transversely arranged wales act like a transversely profiled sole.

In some embodiments, the knitwear comprises stability elements in the area of the outer sole and/or the midsole. Thus, the knitwear comprises stability elements in the area of the outer sole or the midsole. Alternatively, the knitwear comprises stability elements in the area of the outer sole and the midsole. The stability elements may be elements that are directly weft-knitted or warp-knitted into the knitwear and ensure additional stability of the sole.

In some embodiments, the stability elements are ribs, waves or knobs. Ribs, waves or knobs act like a profile and increase the friction and traction of the outer sole. Ribs, waves or knobs in the area of the midsole may engage in corresponding ribs, waves or knobs in the area of the outer sole and so form a particularly stable connection between them. Ribs, waves or nobs on the top of the midsole, i.e. the side facing the foot, may ensure massaging effects of the foot.

In some embodiments, the ribs are arranged essentially transversally to a longitudinal axis of the shoe. Due to this, the traction is increased particularly in the longitudinal direction, since the transverse ribs act like a transversely profiled sole. Moreover, transversely arranged ribs promote the flexing properties of the sole.

In further embodiments of the invention, the knitwear is weft-knitted. Either the knitwear of the outer sole and/or that of the midsole is weft-knitted. Alternatively, the knitwear of the upper is weft-knitted. Further alternatively, the knitwear of the outer sole and/or the knitwear of the midsole as well as the knitwear of the upper is weft-knitted. Knitwear may be weft-knitted in the desired form particularly easily on a suitable machine without producing waste. On flat-knitting machines, the knitwear may furthermore be form-knitted or 3D-knitted.

In further embodiments of the invention, the knitwear is warp-knitted. Either the knitwear of the outer sole and/or that of the midsole is weft-knitted. Alternatively, the knitwear of the upper is warp-knitted. Further alternatively, the knitwear of the outer sole and/or the knitwear of the midsole as well as the knitwear of the upper is warp-knitted. Especially multi-thread warp-knitted fabric allows a particularly fast manufacture due to the use of a plurality of warps.

In some embodiments, the outer sole and/or the midsole are reinforced by a polymer material. Reinforcing polymer material increases the stiffness and stability of the knitwear in the area of the outer sole and/or the midsole. The reinforcing polymer material may be applied in liquid form and dry subsequently. In some embodiments, the polymer material is a thermoplastic polymer material.

In some embodiments, the knitwear comprises a thermoplastic yarn in the area of the outer sole and/or midsole. A thermoplastic yarn may be processed easily and can, for example, be easily weft-knitted into or embroidered onto the knitwear during the manufacture thereof. If the shoe is subsequently heated to above the melting point of the thermoplastic yarn, the latter melts and solidifies during the subsequent cooling. Thereby, the knitwear is reinforced and gains stability.

In certain embodiments, the thermoplastic yarn comprises a low-melting thermoplastic. Due to this, the knitwear may also be adjusted directly to the foot or the cobbler's last.

In some embodiments, a layer of the sole is entirely weft-knitted or warp-knitted from melt yarn. Due to this, a soleplate may be manufactured in an easy manner when this layer is fused and subsequently cools down and hardens. Soleplates are frequently used in shoes in order to distribute forces or to protect the foot from sharp objects such as stones.

In some embodiments, an area of the sole is entirely weft-knitted or warp-knitted from melt yarn. Due to this, a hard element in the sole may be manufactured in an easy manner when the area is fused and subsequently cools down and hardens. For example, the area could be a bone-shaped area that is arranged between the area of the forefoot and the area of the heel and influences torsion of the sole. Such a hard area made from melt yarn may furthermore provide the midfoot area with stability.

In some embodiments, the shoe upper as well as the outer sole or the midsole or both comprise melt yarn.

In some embodiments, the knitwear comprises at least one rubberized yarn in the area of the outer sole. This may e.g. be a full-rubber yarn, a rubber-coated yarn or a rubber-like yarn. Due to this, the abrasion-resistance and the traction of the outer sole is increased.

In some embodiments, the knitwear of the outer sole and/or the midsole was immersed at least partially in a rubber and/or a polymer bath. Through the use of this after-treatment of the knitwear, the friction and the traction (in case of a rubber bath) and the stiffness (in case of a polymer bath) may easily be increased.

In some embodiments, the outer sole and/or the midsole is a spacer weft-knitted fabric or a spacer warp-knitted fabric. A spacer weft-knitted fabric or a spacer warp-knitted fabric shows good cushioning behavior due to its thickness. In some embodiments, the thickness of the spacer weft-knitted fabric may be adapted to the strains expected when wearing the shoe. For example, the spacer weft-knitted fabric or the spacer warp-knitted fabric in the area of the heel could show a greater thickness than in the area of the toes, so as to specifically reduce the strength exerted on the foot when stepping on the ground, e.g. in case of a running shoe. The thickness of the spacer weft-knitted fabric may also vary in the area of the flex lines and e.g. be thinner there so that the foot is able to roll over well. In the midfoot area, the spacer warp-knitted fabric could be rather more fine-meshed so as to achieve higher stiffness.

In some embodiments, the outer sole or the midsole or both comprise a spacer weft-knitted fabric or a spacer warp-knitted fabric only in one area. For example, the outer sole or the midsole or both may comprise a spacer weft-knitted fabric or a spacer warp-knitted fabric only in areas of the heel where high forces are exerted.

In some embodiments, the layers of the spacer weft-knitted fabric or the spacer warp-knitted fabric comprise different yarns. Due to this, the spacer weft-knitted fabric may accomplish different functions within the shoe. For example, the layer facing the foot may comprise moisture-repellent yarn, the layer on the side facing away from the foot may comprise a rubber-like yarn, and the yarn between these layers, i.e. the spacer yarn, may be a strong nylon yarn.

In another area, an intermediate layer of a spacer weft-knitted fabric or spacer warp-knitted fabric comprises stable, e.g. voluminous and/or hollow yarn that may absorb impetuses. The top layer, facing the foot, of the spacer weft-knitted fabric or spacer warp-knitted fabric of the sole, which comes into direct contact with the foot, comprises a humidity-absorbing yarn. The outermost layer of the spacer weft-knitted fabric or the spacer warp-knitted fabric of the sole, which has the function of an outer sole, comprises a hydrophobic yarn.

Alternatively, these three layers of the sole are not manufactured in one piece as a spacer weft-knitted fabric or a spacer warp-knitted fabric but manufactured (e.g. weft-knitted) separately and subsequently joined together (e.g. sewn together).

In certain embodiments, the spaces in the spacer weft-knitted fabric or in the spacer warp-knitted fabric are filled with cushioning materials so as to obtain an additional cushioning. For instance, the spaces could be filled with particle foam, foam inserts and/or additional fibers.

In some embodiments, these cushioning materials are exchangeable, so that the user may adapt the cushioning characteristics to his needs. For example, the knitwear of the midsole could be weft-knitted such that is comprises openings, pouches and/or tunnels that could receive the exchangeable cushioning materials.

In some embodiments, the knitwear of the midsole is weft-knitted so that it comprises at least one pocket. In some embodiments, a material insert is inserted into the at least one pocket. The material insert could e.g. be a foam insert, an air cushion or a gel insert. The at least one pocket may fully or partially surround the material insert. A pocket that fully surrounds the material insert prevents or reduces shifting of the material insert. A material insert inserted into a pocket is environmentally friendly, since it may be disposed of separately from the remainder of the shoe.

In certain embodiments, the thickness and the used yarns of the spacer weft-knitted fabric or the spacer warp-knitted fabric are adapted to the wearer and the purpose of use of the shoe. For example, for a heavier wearer, thicker yarns might also be used and the spacer weft-knitted fabric or spacer warp-knitted fabric could be thicker than in case of a lighter wearer.

In further embodiments, certain materials are weft-knitted or warp-knitted in specific areas of the outer sole and/or the midsole. For example, a rubber yarn or a melt yarn could be weft-knitted or warp-knitted in only in those areas of the outer sole that are most stressed in case of contact with the ground, depending on the rolling-over movement.

In some embodiments, the knitwear of the outer sole comprises a weft-knitted or a warp-knitted pocket on the top, into which the midsole may be inserted. The pocket may e.g. be formed in once piece with the outer sole during weft-knitting or warp-knitting.

According to certain embodiments of the present invention, a method for manufacturing an advantageous shoe as described above, comprising the following steps: a.) providing an upper; b.) manufacturing an outer sole and/or a midsole comprising knitwear; and c.) joining the outer sole and/or the midsole to the upper of the shoe.

In some embodiments, the outer sole or the midsole or both are connected to the upper already during weft-knitting or warp-knitting. For example, the outer sole or the midsole or both may be formed in one piece with the upper. The outer sole or the midsole or both may be weft-knitted or warp-knitted in one piece together with the upper on a weft-knitting machine, e.g. a flat-knitting machine, or a warp-knitting machine.

In other embodiments of the invention, the outer sole or the midsole or both are manufactured separately from the upper and connected to it. For example, the outer sole or the midsole or both may be sewn, glued or welded to the upper or connected to it by linking.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following, embodiments and variations of the present invention are described in more detail on the basis of an upper for a shoe, in particular a sports shoe.

The use of knitwear allows products such as an upper or a sole of a shoe, such as an insole, strobel sole, midsole and/or outer sole to be equipped with areas having different characteristics and providing different functions with low production effort. The properties include bendability, stretchability (expressed as Young's modulus, for example), permeability to air and water, thermoconductivity, thermal capacity, moisture absorption, static friction, abrasion resistance, hardness, and thickness, for example.

Various techniques are applied in order to achieve such characteristics or functions, which will be described in the following. Such suitable techniques in manufacturing knitwear include knitting techniques, the selection of fibers and yarns, coating the fibers, yarns or knitwear with polymer or other materials, the use of monofilaments, the combination of monofilaments and polymer coating, the application of fuse/melt yarns, and multi-layer textile material. In general, the yarns used for the manufacture of knitwear may be equipped, i.e. coated accordingly. In addition or alternatively, the finished knitwear may be equipped accordingly.

Another aspect of providing functions concerns the specific use of knitwear for certain areas of a product, for example of an upper or a sole, and the connection of different parts by suitable connection techniques. The mentioned aspects and techniques as well as other aspects and techniques will be explained in the following.

The described techniques may be used individually or they may be combined in any manner.

Knitwear

Knitwear used in the present invention is divided into weft-knitted fabrics and single-thread warp-knitted fabrics on the one hand and multi-thread warp-knitted fabrics on the other hand. The distinctive characteristic of knitwear is that it is formed of interlocking yarn or thread loops. These thread loops are also referred to as stitches and may be formed of one or several yarns or threads.

Yarn or thread are terms for a structure of one or several fibers which is long in relation to its diameter. A fiber is a flexible structure which is rather thin in relation to its length. Very long fibers, of virtually unlimited length with regard to their use, are referred to as filaments. Monofilaments are yarns formed of one single filament, that is, one single fiber.

In weft-knitted fabrics and single-thread warp-knitted fabrics, the stitch formation requires at least one thread or yarn, with the thread running in longitudinal direction of the product, i.e. substantially at a right angle to the direction in which the product is made during the manufacturing process. In multi-thread warp-knitted fabrics, the stitch formation requires at least one warp sheet, i.e. a plurality of so-called warps. These stitch-forming threads run in longitudinal direction, i.e. substantially in the direction in which the product is made during the manufacturing process.

FIGS. 1*a*-1*d* show the basic difference between a woven fabric 10, weft-knitted fabrics 11 and 12, and a warp-knitted fabric 13. A woven fabric 10 has at least two thread sheets that are usually arranged at a right angle to one another. In this regard, the threads are placed above or underneath each other and do not form stitches. Weft-knitted fabrics 11 and 12 are created by knitting with one thread from the left to the right by interlocking stitches. View 11 shows a front view (also referred to as the front loop fabric side) and view 12 a back view (also referred to as the back loop fabric side) of a weft-knitted fabric 11, 12. The front loop and back loop product sides differ in the run of the legs 14. On the back loop fabric side 12, the legs 14 are covered in contrast to the front loop fabric side 11.

Figure 1E:
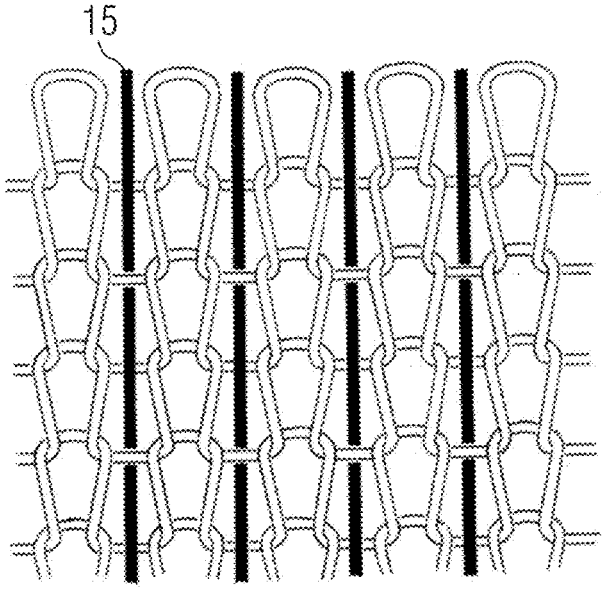
FIG. 1*e* is a schematic representation of a weft-knitted fabric with a filler yarn, according to certain embodiments of the present invention.

Certain embodiments of a weft-knitted fabric that may be used for the present invention with a filler yarn 15 is shown in FIG. 1*e*. A filler yarn 15 is a length of a thread placed between two wales in longitudinal direction, which is held by transverse threads of other weave elements. By the combination of the filler yarn 15 with other weave elements, the properties of the weft-knitted fabric are influenced or various pattern effects are achieved. Stretchability of the weft-knitted fabric in the direction of the wales may for example be reduced by a filler yarn 15.

Multi-thread warp-knitted fabric 13 is created by warp-knitting with many threads from top down, as shown in FIGS. 1*a*-1*d*. In doing so, the stitches of a thread are interlocked with the stitches of the neighboring threads. Depending on the pattern according to which the stitches of the neighboring threads are interlocked, one of the seven basic connections (also referred to as "interlaces" in multi-thread warp-knitting) pillar, tricot, 2×1 plain, satin, velvet, atlas and twill are created, for example.

Figure 2A:
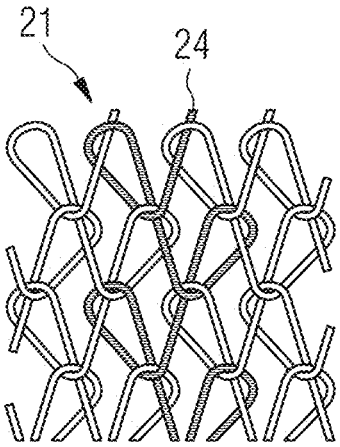
FIGS. 2*a*-2*c* are schematic representations of various interlaces of a warp-knitted fabric, according to certain embodiments of the present invention.
Figure 2B:
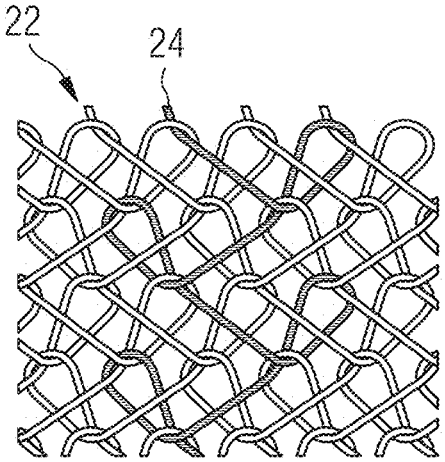
Figure 2C:
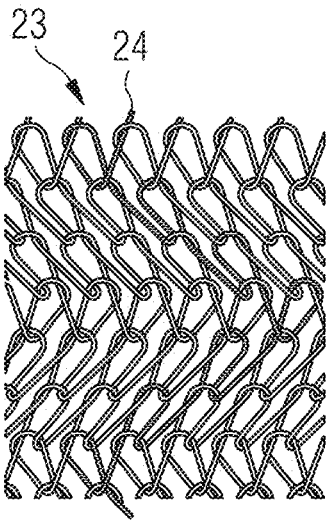

By way of example, the interlaces tricot 21, 2×1 plain 22, and atlas 23 are shown in FIGS. 2*a*-2*c*. A different interlocking results depending on how the stitches of thread 24, which is highlighted by way of example, are interlocked in the stitches of neighboring threads. In the tricot interlace 21, the stitch-forming thread zigzags through the knitwear in the longitudinal direction and binds between two neighboring wales. The 2×1 plain interlace 22 binds in a manner similar to that of the tricot interlace 21, but each stitch-forming warp skips a wale. In the atlas interlace 23, each stitch-forming warp runs to a turning point in a stairs-shape and then changes direction.

Stitches arranged above each other with joint binding sites are referred to as wales. FIGS. 3*a*-3*b* show a wale as an example of a weft-knitted fabric 31. The term wale is also used analogously in warp-knitted fabrics. Accordingly, wales run vertically through the mesh fabric. Rows of stitches arranged next to one another, as shown by way of example for a weft-knitted fabric 32 in FIGS. 3*a*-3*b* are referred to as courses. The term course is also used analogously in warp-knitted fabrics. Accordingly, courses run through the mesh fabric in the lateral direction.

Three basic weft-knitted structures are known in weft-knitted fabrics, which may be recognized by the run of the stitches along a wale. With plain, single Jersey, only back loops may be recognized along a wale on one side of the fabric and only back loops may be recognized along the other side of the product. This structure is created on one row of needles of a knitting machine, i.e. an arrangement of neighboring knitting needles, and also referred to as single Jersey. With rib fabric, front and back loops alternate within a course, i.e. either only front or back loops may be found along a wale, depending on the side of the product from which the wale is considered. This structure is created on two rows of needles with needles offset opposite each other. With purl fabric, front and back loops alternate in one wale. Both sides of the product look the same. This structure is manufactured using latch needles as illustrated in FIG. 4 by stitch transfer. The transfer of stitches may be avoided if double latch needles are used, which comprise both a hook and a latch at each end.

In many embodiments, a variety of structures and surfaces that may be created with knitwear, which may or may not also be possible with weaving. It is possible to manufacture both very heavy and/or stiff knitwear and very soft, transparent and/or stretchable knitwear with substantially the same manufacturing technique. The parameters by which the properties of the material may be influenced substantially are the pattern of weft-knitting or warp-knitting, the used yarn, the needle size or the needle distance, and the tensile strain subject to which the yarn is placed on the needles.

In certain embodiments of weft-knitting, yarns may be weft-knitted in at freely selectable places. In this manner, selected zones may be provided with certain properties. For example, an upper for a soccer shoe may be provided with zones made from rubberized yarn in order to achieve higher static friction and thus enable the player to better control the ball. With certain yarns being weft-knitted in at selected places, no additional elements have to be applied.

Knitwear is manufactured on machines in the industrial context. These machines usually comprise a plurality of needles. In weft-knitting, latch needles 41 are usually used, which may comprise a moveable latch 42, as illustrated in FIG. 4. This latch 42 closes the hook 43 of the needle 41 so that a thread 44 may be pulled through a stitch 45 without the needle 41 being caught on the stitch 45. In weft-knitting, the latch needles 41 are usually moveable individually, so that every single needle 41 may be controlled so that it catches a thread for stitch formation.

A differentiation is made between flat-knitting and circular-knitting machines. In flat-knitting machines, a thread feeder feeds the thread back and forth along a row of needles. In a circular-knitting machine, the needles are arranged in a circular manner and the thread feeding correspondingly takes place in a circular movement along one or more round rows of needles.

Instead of a single row of needles, it is also possible for a knitting machine to comprise two parallel rows of needles. When looked at from the side, the needles of the two rows of needles may, for example, be opposite each other at a right angle. This enables the manufacture of more elaborate structures or weaves. The use of two rows of needles allows the manufacture of a one-layered or two-layered weft-knitted fabric. A one-layered weft-knitted fabric is created when the stitches generated on the first row of needles are enmeshed with the stitches generated on the second row of needles. Accordingly, a two-layered weft-knitted fabric is created when the stitches generate on the first row of needles are not or only selectively enmeshed with the stitches generated on the second row of needles and/or if they are merely enmeshed at the end of the weft-knitted fabric. If the stitches generated on the first row of needles are loosely enmeshed only selectively with the stitches generated on the second row of needles by an additional yarn, this is also referred to as spacer weft-knitted fabric. The additional yarn, for example a monofilament, is thus guided back and forth between two layers, so that a distance between the two layers is created. The two layers may e.g. be connected to each other via a so-called tuck stitch.

Generally, the following weft-knitted fabrics may thus be manufactured on a weft-knitting machine: If only one row of needles is used, a one-layered weft-knitted fabric may be created. When two rows of needles are used, the stitches of both rows of needles may consistently be connected to each other so that the resulting knitwear comprises a single layer. If the stitches of both rows of needles are not connected or only connected at the edge when two rows of needles are used or are only selectively connected in certain locations, two layers are created. If the stitches of both rows of needles are connected selectively in turns by an additional thread, a spacer weft-knitted fabric is created. The additional thread is also referred to as spacer thread and it may be fed via a separate yarn feeder.

In certain embodiments, single-thread warp-knitted fabrics may be manufactured by jointly moved needles. In other embodiments, single-thread warp-knitted fabrics needles may be manufactured by fixing the needles and moving the fabric to create the relative motion between the needles and the fabric. In contrast to weft-knitting, the needles are typically not moved individually. Similar to weft-knitting, there are flat single thread warp-knitting and circular single thread warp-knitting machines.

In multi-thread warp-knitting, one or several coiled threads, i.e. threads which are coiled next to one another, are used. In stitch formation, the individual warps are placed around the needles and the needles are moved jointly.

The techniques described herein as well as further aspects of the manufacture of knitwear may be found in "Fachwissen Bekleidung", 6th ed. by H. Eberle et al. (published with the title "Clothing Technology" in English), in "Textil-und Modelexikon", 6th ed. by Alfons Hofer and in "Maschenlexikon", 11th ed. by Walter Holthaus, for example.

Three-Dimensional Knitwear

Three-dimensional (3D) knitwear may also be manufactured on weft-knitting machines and warp-knitting machines, particularly on flat-knitting machines. This is knitwear comprises a spatial structure although it is weft-knitted or warp-knitted in a single process. A three-dimensional weft-knitting or warp-knitting technique allows for spatial knitwear to be manufactured without seams, cut or manufacture in one piece and in a single process.

Three-dimensional knitwear may, for example, be manufactured by varying the number of stitches in the direction of the wales by partial courses being formed. The corresponding mechanical process is referred to as "needle parking". Depending on the requirement, this technique may be combined with structural variations and/or variations of the number of stitches in the direction of the course. When partial courses are formed, stitch formation temporarily occurs only along a partial width of the weft-knitted fabric or warp-knitted fabric. The needles which are not involved in the stitch formation keep the half stitches ("needle parking") until weft-knitting occurs again at this position. In this way, it is possible to form bulges, for example.

By three-dimensional weft-knitting or warp-knitting, an upper may be adjusted to the cobbler's last or the foot and a sole may be profiled, for example. The tongue of a shoe may e.g. be weft-knitted into the right shape. Contours, structures, knobs, curvatures, notches, openings, fasteners, loops and pockets may be integrated into the knitwear in a single process.

Three-dimensional knitwear may be used for the present invention in an advantageous manner.

Functional Knitwear

According to certain embodiments of the present invention, knitwear and particularly weft-knitted fabric may be provided with a range of functional properties and used in the present invention.

It is possible using a weft-knitting technique to manufacture knitwear having different functional areas and simultaneously maintaining its contours. The structures of knitwear may be adjusted to functional requirements in certain areas, by the stitch pattern, the yarn, the needle size, the needle distance or the tensile strain subject to which the yarn is placed on the needles being selected accordingly.

It is possible, for example, to include structures with large stitches or openings within the knitwear in areas in which airing is desired. In contrast, in areas in which support and stability are desired, fine-meshed stitch patterns, stiffer yarns or even multi-layered weft-knitting structures may be used, which will be described in the following. In the same manner, the thickness of the knitwear is variable.

Knitwear having more than one layer provides numerous possible constructions for the knitwear, which provide many advantages. Knitwear with more than one layer, e.g. two, may be weft-knitted or warp-knitted on a weft-knitting machine or a warp-knitting machine with several rows of needles, e.g. two, in a single stage, as described in the section "knitwear" above. Alternatively, several layers, e.g. two, may be weft-knitted or warp-knitted in separate stages and then placed above each other and connected to each other if applicable, e.g. by sewing, gluing, welding or linking.

Several layers fundamentally increase solidness and stability of the knitwear. In this regard, the resulting solidness depends on the extent to which and the techniques by which the layers are connected to each other. The same yarn or different yarns may be used for the individual layers. For example, it is possible in a weft-knitted fabric for one layer to be weft-knitted from multi-fiber yarn and one layer to be weft-knitted from monofilament, whose stitches are enmeshed. In particular, stretchability of the weft-knitted layer is reduced due to this combination of different yarns. In this construction, a layer made from monofilament may be arranged between two layers made from multi-fiber yarn in order to reduce stretchability and increase solidness of the knitwear. This results in a pleasant surface made from multi-fiber yarn on both sides of the knitwear.

An alternative of two-layered knitwear is referred to as spacer weft-knitted fabric or spacer warp-knitted fabric, as explained in the section "knitwear". In this regard, a spacer yarn is weft-knitted or warp-knitted more or less loosely between two weft-knitted or warp-knitted layers, interconnecting the two layers and simultaneously serving as a filler. The spacer yarn may comprise the same material as the layers themselves, e.g. polyester or another material. The spacer yarn may also be a monofilament which provides the spacer weft-knitted fabric or spacer warp-knitted fabric with stability.

Such spacer weft-knitted fabrics or spacer warp-knitted fabrics, respectively, which are also referred to as three-dimensional weft-knitted fabrics, which are differentiated from the formative 3D weft-knitted fabrics or 3D warp-knitted fabrics mentioned in the section "three-dimensional knitwear" above, may be used wherever additional cushioning or protection is desired, e.g. at the upper or the tongue of an upper or in certain areas of a sole. Three-dimensional structures may also serve to create spaces between neighboring textile layers or also between a textile layer and the foot and thus ensure airing. Moreover, the layers of a spacer weft-knitted fabric or a spacer warp-knitted fabric may comprise different yarns depending on the position of the spacer weft-knitted fabric on the foot.

The thickness of a spacer weft-knitted fabric or a spacer warp-knitted fabric may be set in different areas depending on the function or the wearer. Various degrees of cushioning may be achieved with areas of various thicknesses, for example. Thin areas may increase bendability, for example, thus fulfilling the function of joints or flex lines.

Moreover, the layers of a spacer weft-knitted fabric may comprise different yarns depending on the position of the spacer weft-knitted fabric on the foot. In this way, knitwear may be provided with two different colors for the front and the back, for example. An upper made from such knitwear may then comprise a different color on the outside than on the inside.

Other multi-layered constructions may include pockets or tunnels, in which two textile layers or knitwear weft-knitted or warp-knitted on two rows of needles are connected to each other only in certain areas so that a hollow space is created. Alternatively, items of knitwear weft-knitted or warp-knitted in two separate processes are connected to each other such that a void is created, e.g. by sewing, gluing, welding or linking. It is then possible to introduce a cushioning material such as a foam material, eTPU (expanded thermoplastic urethane), ePP (expanded polypropylene), expanded EVA (ethylene vinyl acetate) or particle foam, an air or gel cushion for example, through an opening, e.g. at the tongue, the upper, the heel, the sole or in other areas. Alternatively or additionally, the pocket may also be filled with a filler thread or a spacer knitwear. It is furthermore possible for threads to be pulled through tunnels, for example as reinforcement in case of tension loads in certain areas of an upper. Moreover, it is also possible for the laces to be guided through such tunnels. Moreover, loose threads may be placed into tunnels or pockets for padding, for example in the area of the ankle. However, it is also possible for stiffer reinforcing elements, such as caps, flaps or bones to be inserted into tunnels or pockets. These may be manufactured from plastic such as polyethylene, TPU, polyethylene or polypropylene, for example.

A further possibility for a functional design of knitwear is the use of certain variations of the basic weaves. In weft-knitting, it is possible for bulges, ribs or waves to be weft-knitted in certain areas, for example, in order to achieve reinforcement in these places. A wave may, for example, be created by stitch accumulation on a layer of knitwear. This means that more stitches are weft-knitted or warp-knitted on one layer than on another layer. Alternatively, different stitches are weft-knitted fabric on the one layer than on the other layer, e.g. by being weft-knitted fabric tighter, wider or using a different yarn. Thickening is caused in both alternatives.

Ribs, waves, or similar patterns may, for example, also be used at the bottom of a weft-knitted outer sole of a shoe in order to provide a tread and provide the shoe with better non-slip properties. In order to obtain a rather thick weft-knitted fabric, for example, it is possible to use the weft-knitting techniques "tuck" or "half cardigan", which are described in "Fachwissen Bekleidung", 6th ed. by H. Eberle et al., for example.

Waves may be weft-knitted or warp-knitted such that a connection is created between two layers of a two-layered knitwear or such that no connection is created between the two layers. A wave may also be weft-knitted as a right-left wave on both sides with or without a connection of the two layers. A structure in the knitwear may be achieved by an uneven ration of stitches on the front or the back of the knitwear.

A further possibility of functionally designing knitwear within the framework of the present invention is providing openings in the knitwear already during weft-knitting or warp-knitting. Embodiments in the course of the present invention, which may be combined with other embodiments, refer to an insole that comprises knitwear. The embodiments may also be applied to a strobel sole, however. The embodiments may equally be applied to an outer sole. An insole, strobel sole, or outer sole is generally arranged above a midsole. The midsole may comprise cushioning properties. The midsole may e.g. comprise a foam material. Other suitable materials are eTPU (expanded thermoplastic urethane), ePP (expanded polypropylene), expanded EVA (ethylene vinyl acetate) or particle foam, for example.

The knitwear of the insole, strobel sole, or outer sole comprises at least one opening which is weft-knitted or warp-knitted in already during weft-knitting or warp-knitting of the knitwear, respectively. The at least one opening enables the foot of a wearer of a shoe to be able to directly touch the midsole. This improves the cushioning properties of the shoe on the whole, so that the thickness of the midsole may be reduced.

In some embodiments, the at least one opening is arranged in the area of the calcaneus. An arrangement in this position has a particularly positive effect on the cushioning properties. A different position of the at least one opening is also possible.

In certain embodiments, functionally designing knitwear within the framework may include forming laces integrally with the knitwear of an upper. In these embodiments, the upper comprises knitwear and the laces are warp-knitted or weft-knitted as one piece with the knitwear already when the knitwear of the upper is weft-knitted or warp-knitted. In this regard, a first end of a lace is connected to the knitwear, while a second end is free.

In some embodiments, the first end is connected to the knitwear of the upper in the area of the transition from the tongue to the area of the forefoot of the upper. In these embodiments, a first end of a first lace may be connected to the knitwear of the upper at the medial side of the tongue and a first end of a second lace is connected to the knitwear of the upper at the lateral side of the tongue. The respective second ends of the two laces may then be pulled through lace eyelets for tying the shoe.

A possibility of speeding up the integral weft-knitting or warp-knitting of laces is having all yarns used for weft-knitting or warp-knitting knitwear end in the area of the transition from the tongue to the area of the forefoot of the upper. In some embodiments, the yarns may end in the medial side of the upper on the medial side of the tongue and form the lace connected on the medial side of the tongue. In certain embodiments, the yarns may end in the lateral side of the upper on the lateral side of the tongue and form the lace connected to the lateral side of the tongue. The yarns may then be cut off at a length that is sufficiently long for forming laces. The yarns may be twisted or intertwined, for example. The respective second end of the laces may be provided with a lace clip. Alternatively, the second ends are fused or provided with a coating.

The knitwear is particularly stretchable in the direction of the stitches (longitudinal direction) due to its construction. This stretching may be reduced e.g. by subsequent polymer coating of the knitwear. The stretching may also be reduced during manufacture of the knitwear itself. One possibility is reducing the mesh openings, that is, using a smaller needle size. Smaller stitches generally result in less stretching of the knitwear. Fine-meshed knitwear may e.g. be used at an upper (also referred to as shoe upper). Moreover, the stretching of the knitwear may be reduced by weft-knitted reinforcements, e.g. three-dimensional structures. Such structures may be arranged on the inside or the outside of an upper. Furthermore, non-stretchable yarn, e.g. made from nylon, may be laid in a tunnel along the knitwear in order to limit stretching to the length of the non-stretchable yarn.

Colored areas with several colors may be created by using a different thread and/or by additional layers. In transitional areas, smaller mesh openings (smaller needle sizes) are used in order to achieve a fluent passage of colors.

Further effects may be achieved by weft-knitted insets (inlaid works) or Jacquard knitting. Inlaid works are areas which only provide a certain yarn, e.g. in a certain color. Neighboring areas which may comprise a different yarn, for example in a different color, are then connected to each other by a so-called tuck stitch.

During Jacquard knitting, two rows of needles are used and two different yarns run through all areas, for example. However, in certain areas only one yarn appears on the visible side of the product and the respective other yarn runs invisibly on the other side of the product.

A product manufactured from knitwear may be manufactured in one piece on a weft-knitting machine or a warp-knitting machine. Functional areas may then already be manufactured during weft-knitting or warp-knitting by corresponding techniques as described here.

Alternatively, the product may be combined from several parts of knitwear and it may also comprise parts that are not manufactured from knitwear. In this regard, the parts of knitwear may each be designed separately with different functions, for example regarding thickness, isolation, transport of moisture, etc.

An upper and/or a sole may, for example, be generally manufactured from knitwear as a whole or it may be put together from different parts of knitwear. A whole upper or parts of that may, for example, be separated, e.g. punched, from a larger piece of knitwear. The larger piece of knitwear may, for example, be a circular weft-knitted fabric or a circular warp-knitted fabric or a flat weft-knitted fabric or a flat warp-knitted fabric.

For example, a tongue may be manufactured as a continuous piece and connected with the upper subsequently, or it may be manufactured in one piece with the upper. With regard to their functional designs, ridges on the inside may e.g. improve flexibility of the tongue and ensure that a distance is created between the tongue and the foot, which provides additional airing. Laces may be guided through one or several weft-knitted tunnels of the tongue. The tongue may also be reinforced with polymer in order to achieve stabilization of the tongue and e.g. prevent a very thin tongue from convolving. Moreover, the tongue may then also be fitted to the shape of the cobbler's last or the foot.

In an upper, it is possible for only the front part to be manufactured from knitwear, for example. The remainder of the upper may comprise a different textile and/or material, such as a woven fabric, for example. The front part may e.g. be located only in the area of the toes, extend beyond the toe joints or into the midfoot area. Alternatively, the back part of an upper may be manufactured from knitwear in the area of the heel, for example, and e.g. be additionally reinforced with polymer coating. In general, any desired areas of an upper or a sole may be manufactured as knitwear.

Applications such as polyurethane (PU) prints, thermoplastic polyurethane (TPU) ribbons, textile reinforcements, leather, etc., may be applied to knitwear subsequently. Thus, in an upper which comprises knitwear in its entirety or in parts, a plastic heel or toe cap as reinforcement or logos and eyelets for laces may be applied on the upper, for example by sewing, gluing or welding, as described below.

Sewing, gluing or welding, for example, constitute suitable connection techniques for connecting individual knitwear with other textiles or with other knitwear. Linking is another possibility for connecting two pieces of knitwear. Therein, two edges of knitwear are connected to each other according to the stitches (usually stitch by stitch).

A possibility for welding textiles, particularly ones made from plastic yarns or threads, is ultrasonic welding. Therein, mechanical oscillations in the ultrasonic frequency range are transferred to a tool referred to as a sonotrode. The oscillations are transferred to the textiles to be connected by the sonotrode under pressure. Due to the resulting friction, the textiles are heated up, softened and ultimately connected in the area of the place of contact with the sonotrode. Ultrasonic welding allows rapidly and cost-effectively connecting particularly textiles with plastic yarns or threads. It is possible for a ribbon to be attached, for example glued, to the weld seam, which additionally reinforces the weld seam and is optically more appealing. Moreover, wear comfort is increased since skin irritations—especially at the transition to the tongue—are avoided.

Figure 5A:
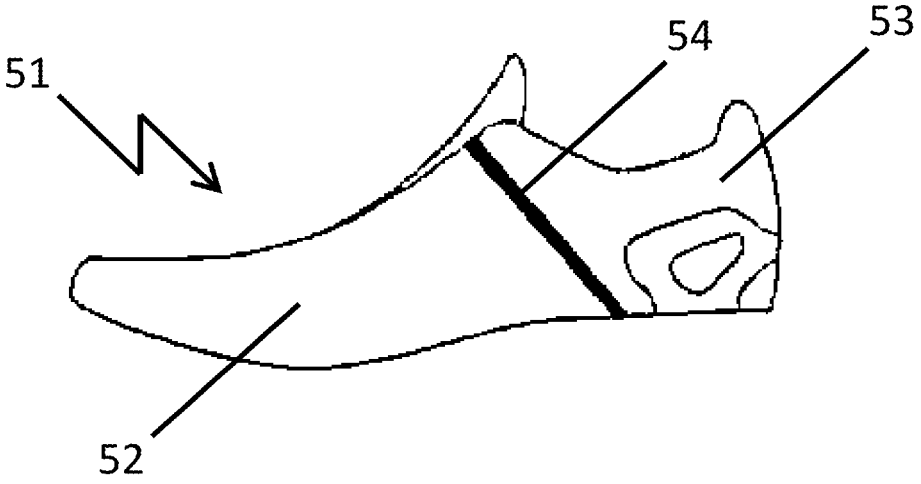
FIG. 5*a* is a side view of an upper with two connected textile areas, according to certain embodiments of the present invention.
Figure 5B:
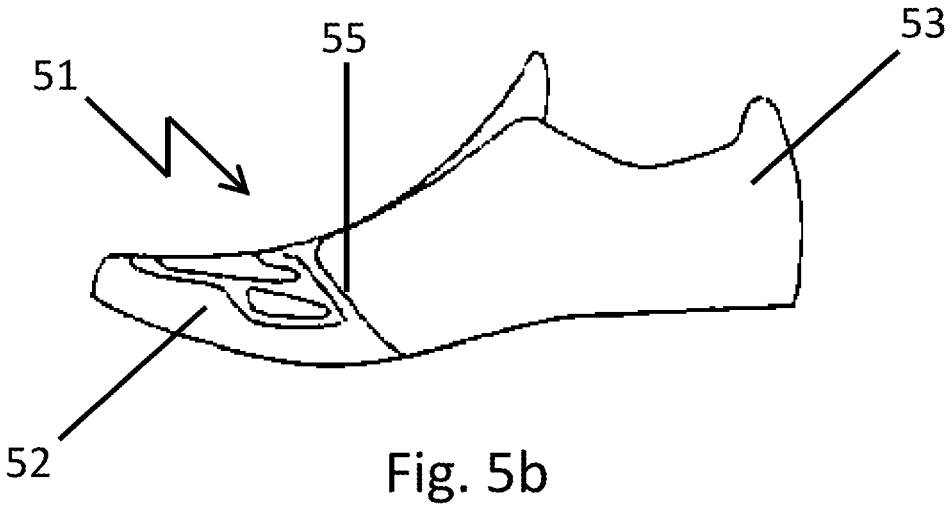
FIG. 5*b* is a side view of an upper with two connected textile areas, according to certain embodiments of the present invention.

Connecting various textile areas may occur at quite different locations. For example, the seams for connecting various textile areas of an upper may be arranged at various positions, as shown in FIGS. 5*a* and 5*b*. An upper 51 is shown in FIG. 5*a* which comprises two textile areas 52 and 53. They are sewn to each other. The seam 54 which connects the two textile areas 52 and 53 runs diagonally from an instep area of the upper to an area of the sole in the transition area from the midfoot to the heel. In FIG. 5*b* the seam 55 also runs diagonally, but it is arranged more to the front in the direction of the toes. Other arrangements of seams and connecting places in general are conceivable. The seams shown in FIGS. 5*a* and 5*b* may each be a thread seam, a glued seam, a welded seam or a linking seam. The two seams 54 and 55 may each be mounted only on one side of the upper 51 or on both sides of the upper.

In certain embodiments, adhesive tape may be used to connect textile areas. This feature may also be used in addition to an existing connection, e.g. over a sewn seam or a welded seam. An adhesive tape may fulfill further functions in addition to the function of connecting, such as e.g. protection against dirt or water. An adhesive tape may comprise properties which change over its length.

Figure 6A:
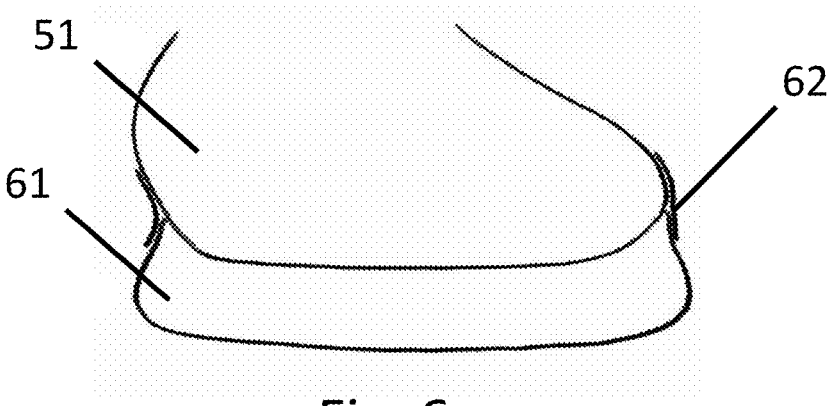
FIGS. 6*a*-6*c* are cross-sectional views of an upper connected to a shoe sole via adhesive tape, according to certain embodiments of the present invention.
Figure 6B:
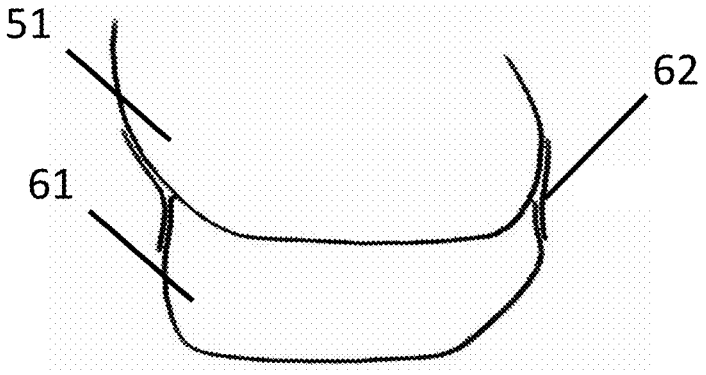
Figure 6C:
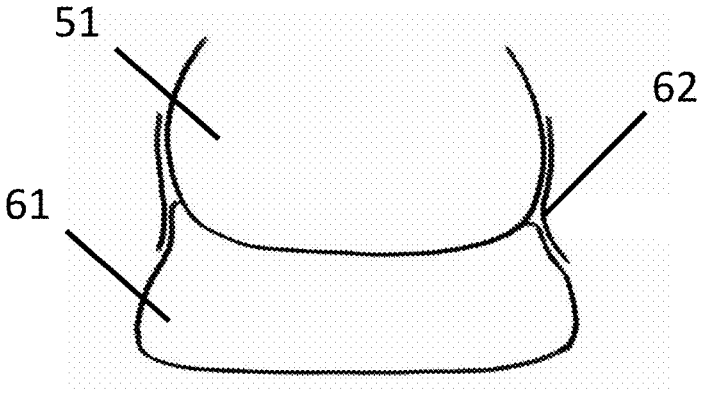

Embodiments of an upper 51 connected to a shoe sole 61 using adhesive tape are shown in FIGS. 6*a*, 6*b*, and 6*c*. Each of FIGS. 6*a*, 6*b*, and 6*c* shows a cross-section of a shoe depicting different positions of the foot and the resulting deformation of the shoe. For example, tensile forces work on the right side of the shoe in FIG. 6*a*, whereas compression forces work on the left side.

The shoe sole 61 may be an outer sole or a midsole. The upper 51 and the shoe sole 61 are connected to each other by a surrounding adhesive tape 62. The adhesive tape 62 may be of varying flexibility along its length. For example, the adhesive tape 62 might be particularly rigid and not very flexible in the shoe's heel area in order to provide the shoe with the necessary stability in the heel area. This may be achieved by varying the width and/or the thickness of the adhesive tape 62, for example. The adhesive tape 62 may generally be constructed such that it is able to receive certain forces in certain areas along the tape. In this way, the adhesive tape 62 does not only connect the upper to the sole but simultaneously fulfills the function of structural reinforcement.

Fibers

The yarns or threads, respectively, used for knitwear of the present invention usually comprise fibers. As was explained above, a flexible structure which is rather thin in relation to its length is referred to as a fiber. Very long fibers, of virtually unlimited length with regard to their use, are referred to as filaments. Fibers are spun or twisted into threads or yarns. Fibers may also be long, however, and twirled into a yarn. Fibers may include natural or synthetic materials. Natural fibers are environmentally friendly, since they are compostable. Natural fibers include cotton, wool, alpaca, hemp, coconut fibers or silk, for example. Among the synthetic fibers are polymer-based fibers such as nylon, polyester, elastane, or spandex, respectively, or Kevlar® or other para-aramid synthetic fiber, which may be produced as classic fibers or as high-performance fibers or technical fibers.

It is conceivable that a shoe be assembled from various parts, with a weft-knitted or a warp-knitted part comprising natural yarn made from natural fibers and a removable part, e.g. the insole, comprising plastic, for example. In this manner, both parts may be disposed of separately. In this example, the weft-knitted part could be directed to compostable waste, whereas the insole could be directed to recycling of reusable materials, for example.

The mechanical and physical properties of a fiber and the yarn manufactured therefrom are also determined by the fiber's cross-section, as illustrated in FIGS. 7*a*-7*o*. These different cross-sections, their properties and examples of materials having such cross-sections will be explained in the following.

A fiber having the circular cross-section 710 may either be solid or hollow. A solid fiber is the most frequent type, it allows easy bending and is soft to the touch. A fiber as a hollow circle with the same weight/length ratio as the solid fiber has a larger cross-section and is more resistant to bending. Examples of fibers with a circular cross-section are nylon, polyester, and Lyocell.

A fiber having the bone-shaped cross-section 730 has the property of wicking moisture. Examples for materials for such fibers are acrylic and spandex. The concave areas in the middle of the fiber support moisture being passed on in the longitudinal direction, with moisture being rapidly wicked from a certain place and distributed.

The following further cross-sections are illustrated in FIGS. 7*a*-7*o:*

- polygonal cross-section 711 with nodes; example: flax;
- oval to round cross-section 712 with overlapping portions; example: wool;
- flat, oval cross-section 713 with expansion and convolution; example: cotton;
- circular, serrated cross-section 714 with partial striations; example: rayon;
- lima bean cross-section 720; smooth surface;
- serrated lima bean cross-section 721; example: Avril™ rayon;
- triangular cross-section 722 with rounded edges; example: silk;
- trilobal star cross-section 723; like triangular fiber with shinier appearance;
- clubbed cross-section 724 with partial striations; sparkling appearance; example: acetate;
- flat and broad cross-section 731; example: acetate in another design;
- star-shaped or concertina cross section 732;
- cross-section 733 in the shape of a collapsed tube with a hollow center; and
- Square cross-section 734 with voids; example: AnsoIV™ nylon.

Individual fibers with their properties which are relevant for the manufacture of knitwear for the present invention will be described in the following:

- aramid fibers: good resistance to abrasion and organic solvents; non-conductive; temperature-resistant up to 500° C.
- para-aramid fibers: known under trade names Kevlar®, Techova™, and Twaron™; outstanding strength-to-weight properties; high Young's modulus and high tensile strength (higher than with meta-aramides); low stretching and low elongation at break (approx. 3.5%); difficult to dye.
- meta-aramides: known under trade names Numex™, Teijinconex™, New Star™ X Fiper™.

dyneema fibers: highest impact strength of any known thermoplastics; highly resistant to corrosive chemicals, with exception of oxidizing acids; extremely low moisture absorption; very low coefficient of friction, which is significantly lower than that of nylon and acetate and comparable to Teflon®; self-lubricating; highly resistant to abrasion (15 times more resistant to abrasion than carbon steel); nontoxic.

carbon fiber: an extremely thin fiber about 0.005-0.010 mm in diameter, composed substantially of carbon atoms; highly stable with regard to size; one yarn is formed from several thousand carbon fibers; high tensile strength; low weight; low thermal expansion; very strong when stretched or bent; thermal conductivity and electric conductivity.

glass fiber: high ratio of surface area to weight; by trapping air within them, blocks of glass fibers provide good thermal insulation; thermal conductivity of 0.05 W/(m×K); the thinnest fibers are the strongest because the thinner fibers are more ductile; the properties of the glass fibers are the same along the fiber and across its cross-section, since glass has an amorphous structure; correlation between bending diameter of the fiber and the fiber diameter; thermal, electrical and sound insulation; higher stretching before it breaks than carbon fibers.

Yarns

A plurality of different yarns may be used for the manufacture of knitwear according to certain embodiments in the present invention. As was already defined, a structure of one or several fibers which is long in relation to its diameter is referred to as a yarn.

Functional yarns are capable of transporting moisture and thus of absorbing sweat and moisture. They may be electrically conducting, self-cleaning, thermally regulating and insulating, flame resistant, and UV-absorbing, and may enable infrared radiation. They may be suitable for sensors. Antibacterial yarns, such as silver yarns, for example, prevent odor formation.

Stainless steel yarn contains fibers made of a blend of nylon or polyester and steel. Its properties include high abrasion resistance, high cut resistance, high thermal abrasion, high thermal and electrical conductivity, higher tensile strength and high weight.

In textiles made from knitwear, electrically conducting yarns may be used for the integration of electronic devices. These yarns may, for example, forward impulses from sensors to devices for processing the impulses, or the yarns may function as sensors themselves, and measure electric streams on the skin or physiological magnetic fields, for example. Examples for the use of textile-based electrodes may be found in European patent application EP 1 916 323.

Melt yarns may be a mixture of a thermoplastic yarn and a non-thermoplastic yarn. There are substantially three types of melt yarns: a thermoplastic yarn surrounded by a non-thermoplastic yarn; a non-thermoplastic yarn surrounded by thermoplastic yarn; and pure melt yarn of a thermoplastic material. After being heated to the melting temperature, thermoplastic yarn fuses with the non-thermoplastic yarn (e.g. polyester or nylon), stiffening the knitwear. The melting temperature of the thermoplastic yarn is determined accordingly and it is usually lower than that of the non-thermoplastic yarn in case of a mixed yarn.

A shrinking yarn is a dual-component yarn. The outer component is a shrinking material, which shrinks when a defined temperature is exceeded. The inner component is a non-shrinking yarn, such as polyester or nylon. Shrinking increases the stiffness of the textile material.

A further yarn for use in knitwear are luminescent or reflecting yarns and so-called "intelligent" yarns. Examples of intelligent yarns are yarns which react to humidity, heat or cold and alter their properties accordingly, e.g. contracting and thus making the stitches smaller or changing their volume and thus increasing permeability to air. Yarns made from piezo fibers or yarn coated with a piezo-electrical substance are able to convert kinetic energy or changes in pressure into electricity, which may provide energy to sensors, transmitters or accumulators, for example.

Yarns may furthermore generally be reworked, e.g. coated, in order to maintain certain properties, such as stretching, color or humidity resistance.

Polymer Coating

Due to its structure, weft-knitted or warp-knitted knitwear is considerably more flexible and stretchable than weaved textile materials. For certain applications and requirements, e.g. in certain areas of an upper or a sole according to the present invention, it is therefore necessary to reduce flexibility and stretchability in order to achieve sufficient stability.

For that purpose, a polymer layer may be applied to one side or both sides of knitwear (weft-knit or warp-knit goods), but generally also to other textile materials. Such a polymer layer causes a reinforcement and/or stiffening of the knitwear. In an upper it may e.g. serve the purpose of supporting and/or stiffening and/or reducing elasticity in the toe area, in the heel area, along the lace eyelets, on lateral and/or medial surfaces or in other areas. Furthermore, elasticity of the knitwear and particularly stretchability are reduced. Moreover, the polymer layer protects the knitwear against abrasion. Furthermore, it is possible to give the knitwear a three-dimensional shape using the polymer coating by compression-molding.

In the first step of polymer coating, the polymer material may applied to one side of the knitwear. It may also be applied on both sides, however. The material may be applied by spraying, knife coating, laying, printing, sintering, ironing or spreading. If it is polymer material in the form of a film, the latter is placed on the knitwear and connected with the knitwear by heat and pressure, for example. Spraying may be carried out by a tool similar to a hot glue gun. Spraying enables the polymer material to be applied evenly in thin layers. Moreover, spraying is a fast method. Effect pigments such as color pigments, for example, may be mixed into the polymer coating.

According to certain embodiments, the polymer is applied in at least one layer with a thickness of 0.2-1 mm. One or several layers may be applied, with it being possible for the layers to be of different thicknesses and/or colors. Between neighboring areas with polymer coating of various thicknesses there may be continuous transitions from areas with a thin polymer coating to areas with a thick polymer coating. In the same manner, different polymer materials may be used in different areas, as will be described in the following.

During application, polymer material attaches itself to the points of contact or points of intersection, respectively, of the yarns of the knitwear, on the one hand, and to the gaps between the yarns, on the other hand, forming a closed polymer surface on the knitwear after the processing steps described in the following. However, in case of larger mesh openings or holes in the textile structure, this closed polymer surface may also be intermittent, e.g. so as to enable airing. This also depends on the thickness of the applied material: The more thinly the polymer material is applied, the easier it is for the closed polymer surface to be intermittent. Moreover, the polymer material may also penetrate the yarn and soak it and thus contributes to its stiffening.

After application of the polymer material, the knitwear is pressed in a press under heat and pressure. The polymer material liquefies in this step and fuses with the yarn of the textile material.

In a further optional step, the knitwear may be pressed into a three-dimensional shape in a machine for compression-molding. For example, the area of the heel or the area of the toes of an upper may be shaped three-dimensionally over a cobbler's last. Alternatively, the knitwear may also be directly fitted to a foot.

After pressing and molding, the reaction time until complete stiffening may be one to two days, depending on the used polymer material.

The following polymer materials may be used: polyester; polyester-urethane pre-polymer; acrylate; acetate; reactive polyolefins; co-polyester; polyamide; co-polyamide; reactive systems (mainly polyurethane systems reactive with $H_2O$ or $O_2$); polyurethanes; thermoplastic polyurethanes; and polymeric dispersions.

A suitable range for viscosity of the polymer material is 50-80 Pa s (pascal second) at 90-150° C., which may further include a range of 15-50 Pa s (pascal second) at 110-150° C.

A suitable range for the hardness of the hardened polymer material is 40-60 Shore D. Depending on the application, other ranges of hardness are also conceivable.

The described polymer coating may be used sensibly wherever support functions, stiffening, increased abrasion resistance, elimination of stretchability, increase of comfort and/or fitting to prescribed three-dimensional geometries are desired. It is also conceivable to fit e.g. an upper to the individual shape of the foot of the person wearing it, by polymer material being applied to the upper and then adapting to the shape of the foot under heat.

Monofilaments for Reinforcement

As was already defined, a monofilament is a yarn formed by one single filament, that is, one single fiber. Therefore, in certain embodiments, stretchability of monofilaments is considerably lower than that of yarns which are manufactured from many fibers. This also reduces the stretchability of knitwear that is manufactured from monofilaments or include monofilaments and which are used in the present invention. Monofilaments are typically made from polyamide. However, other materials, such as polyester or a thermoplastic material, would also be conceivable.

So whereas knitwear made from a monofilament is considerably more rigid and less stretchable, this knitwear may not include the desired surface properties, such as e.g. smoothness, colors, transport of moisture, outer appearance and variety of textile structures as usual knitwear has. This disadvantage is overcome by the knitwear described in the following.

Figure 8:
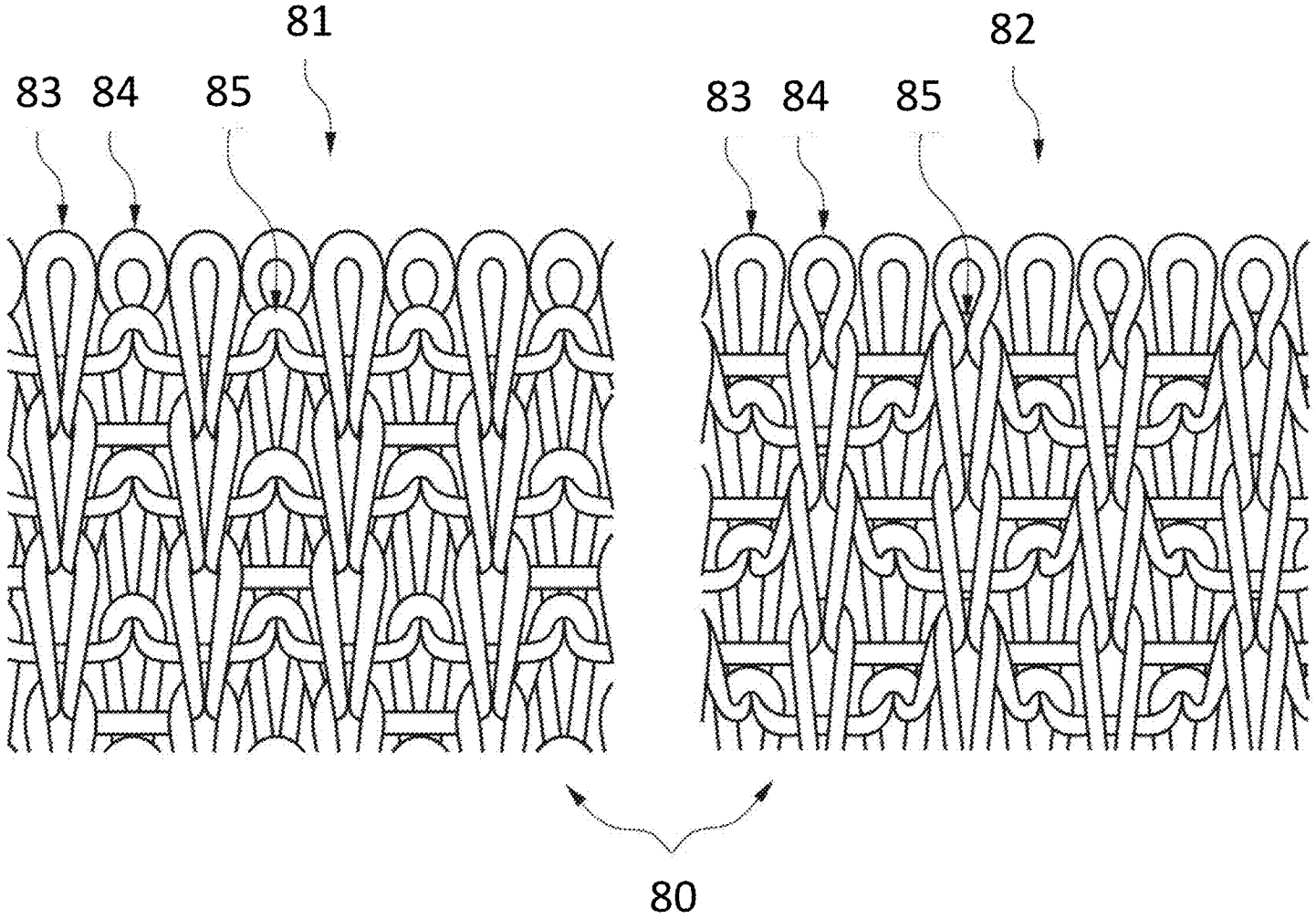
FIG. 8 is a front view and a back view of a knitwear, according to certain embodiments of the present invention.

FIG. 8 depicts a weft-knitted fabric having a weft-knitted layer made from a first yarn, such as a multi-fiber yarn, for example, and a weft-knitted layer made from monofilament. The layer of monofilament is weft-knitted into the layer of the first yarn. The resulting two-layered knitwear is considerably more solid and less stretchable than the layer made from yarn alone. If a monofilament melts slightly, the monofilament fuses with the first yarn even better.

FIG. 8 particularly depicts a front view 81 and a back view 82 of a two-layered knitwear 80. Both views show a first weft-knitted layer 83 made from a first yarn and a second weft-knitted layer 84 made from monofilament. The first weft-knitted layer 83 made from a first yarn is connected to the second weft-knitted layer 84 by stitches 85. Thus, the greater solidness and smaller stretchability of the second weft-knitted layer 84 made from the monofilament is transferred to the first weft-knitted layer 83 made from the first yarn.

A monofilament may also be melted slightly in order to connect with the layer of the first yarn and limit stretching even more. The monofilament then fuses with the first yarn at the points of contact and fixates the first yarn with respect to the layer made from monofilament.

Combination of Monofilaments and Polymer Coating

The weft-knitted fabric having two layers described in the preceding section may additionally be reinforced by a polymer coating as was already described in the section "polymer coating". The polymer material is applied to the weft-knitted layer made from monofilament. In doing so, it does not connect to the material (e.g. polyamide material) of the monofilament, since the monofilament has a very smooth and round surface, but substantially penetrates the underlying first layer of a first yarn (e.g. polyester yarn). During subsequent pressing, the polymer material therefore fuses with the yarn of the first layer and reinforces the first layer. In doing so, the polymer material has a lower melting point than the first yarn of the first layer and the monofilament of the second layer. The temperature during pressing is selected such that only the polymer material melts but not the monofilament or the first yarn.

Melt Yarn

For reinforcement and for the reduction of stretching, the yarn of the knitwear which is used according to the invention may additionally or alternatively also be a melt yarn that fixes the knitwear after pressing. There are substantially three types of melt yarns: a thermoplastic yarn surrounded by a non-thermoplastic yarn; a non-thermoplastic yarn surrounded by thermoplastic yarn; and pure melt yarn of a thermoplastic material. In order to improve the bond between thermoplastic yarn and the non-thermoplastic yarn, it is possible for the surface of the non-thermoplastic yarn to be texturized.

In certain embodiments, pressing takes place at a temperature ranging from 110 to 150° C., and may further be approximately 130° C. The thermoplastic yarn melts at least partially in the process and fuses with the non-thermoplastic yarn. After pressing, the knitwear is cooled, so that the bond is hardened and fixed. The melt yarn may be arranged in the upper and/or the sole.

In some embodiments, the melt yarn is weft-knitted into the knitwear. In case of several layers, the melt yarn may be weft-knitted into one, several or all layers of the knitwear.

In certain embodiments, the melt yarn may be arranged between two layers of knitwear. In doing so, the melt yarn may simply be placed between the layers. Arrangement between the layers has the advantage that the mold is not stained during pressing and molding, since there is no direct contact between the melt yarn and the mold.

Thermoplastic Textile for Reinforcement

A further possibility for reinforcing knitwear that is used for the present invention, for example in an upper and/or a sole, is the use of a thermoplastic textile. This is a thermoplastic woven fabric or thermoplastic knitwear. A thermoplastic textile melts at least partially when subjected to heat and stiffens as it cools down. A thermoplastic textile may, for example, be applied to the surface of an upper or a sole, which may comprise knitwear, for example, by applying pressure and heat. When it cools down, the thermoplastic textile stiffens and specifically reinforces the upper or the sole in the area in which it was placed, for example.

The thermoplastic textile may be specifically manufactured for the reinforcement in its shape, thickness and structure. Additionally, its properties may be varied in certain areas. The stitch structure, the knitting stitch, and/or the yarn used may be varied such that different properties are achieved in different areas.

According to certain embodiments, a thermoplastic textile is a weft-knitted fabric or warp-knitted fabric made from thermoplastic yarn. Additionally, the thermoplastic textile may also comprise a non-thermoplastic yarn. The thermoplastic textile may be applied to an upper or a sole of a shoe, for example, by pressure and heat.

A woven fabric whose wefts and/or warps are thermoplastic are other embodiments of a thermoplastic textile. Different yarns may be used in the weft direction and the warp direction of the thermoplastic woven fabric, so as to achieve different properties, such as stretchability, in the weft direction and the warp direction.

A spacer weft-knitted fabric or spacer warp-knitted fabric made from thermoplastic material are other embodiments of a thermoplastic textile. In this regard, e.g. only one layer may be thermoplastic, e.g. so as to be attached to an upper or a sole. Alternatively, both layers are thermoplastic, e.g. in order to connect the sole to the upper.

A thermoplastic weft-knitted fabric or warp-knitted fabric may be manufactured using the manufacturing techniques for knitwear described in the section "knitwear".

A thermoplastic textile may be connected with the surface to be reinforced only partially subject to pressure and heat so that only certain areas or only a certain area of the thermoplastic textile connects to the surface. Other areas or another area do not connect, so that the permeability for air and/or humidity is maintained there, for example. The function and/or the design of e.g. an upper or a sole may be modified by this.

Shoe Comprising Knitwear

Figure 9:
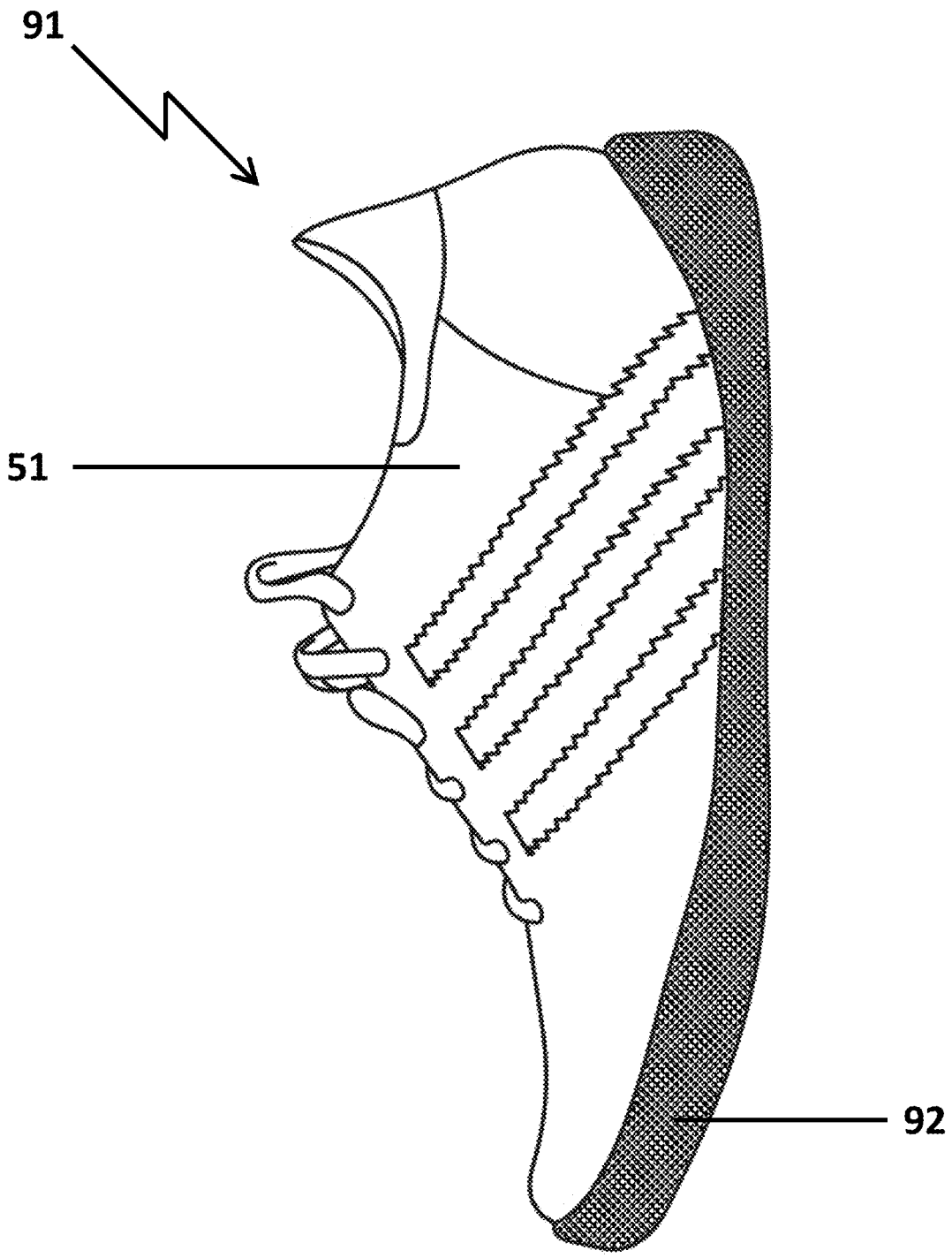
FIG. 9 is a side view of a shoe, according to certain embodiments of the present invention.

FIG. 9 shows a shoe 91 according to certain embodiments of the present invention. The shoe 91 shown in FIG. 9 comprises an upper 51 which may comprise leather, canvas, or synthetic material. The upper 51 is attached to an outer sole 92 comprising knitwear. The knitwear may be weft-knitted or warp-knitted, for example, on a machine, as described in the section "knitwear" above. The upper 51 may be glued, welded (using ultrasound, as described in the section "functional knitwear" above, using high frequency or laser), or sewn to the outer sole 92.

The shoe 91 may, in addition, comprise a midsole (not shown in FIG. 9) that may also comprise knitwear. Alternatively, only the midsole may comprise knitwear, but not the outer sole 92. The midsole may be glued, welded (ultrasonic, as described above, high frequency or laser), or sewn to the outer sole 92 or the upper 51, respectively. Alternatively, a joint may also be provided through linkage.

In further embodiments, the outer sole 92 is formed as one-piece knitwear together with the midsole. Such one-piece knitwear may, for example, be manufactured on a weft-knitting machine or a warp-knitting machine with two rows of needles, whereby the outer sole 92 and the midsole are weft-knitted or warp-knitted on different rows of needles. The outer sole 92 and the midsole may already be joined at the edge or over their entire surface during weft-knitting or warp-knitting.

The outer sole 92 and the midsole may also be a spacer weft-knitted fabric or a spacer warp-knitted fabric, as e.g. described in the sections "knitwear" and "functional knitwear" above, whose first layer represents the outer sole and whose second layer represents the midsole. The yarn between the two layers then provides an additional cushioning and thus assumes the function of a midsole.

Alternatively, the midsole comprises a spacer weft-knitted fabric or a spacer warp-knitted fabric. The outer sole 92 may then be weft-knitted or warp-knitted or it may also not comprise any knitwear. The outer sole 92 may be water-repellent, dirt-repellent, and/or slip-resistant. The first layer of the spacer weft-knitted fabric or spacer warp-knitted fabric of the midsole ensures cushioning depending on its thickness. The second layer of the spacer weft-knitted fabric or spacer warp-knitted fabric of the midsole constitutes the strobel sole or directly the outsole. In these embodiments, the foot stands directly on the second layer of the spacer weft-knitted fabric or the spacer warp-knitted fabric. The second layer may comprise a humidity-absorbing yarn and additionally or alternatively an antibacterial and/or odor-inhibiting yarn, e.g. a silver yarn. Alternatively, the second layer may be formed entirely or almost entirely from melt yarn. When the melt yarn is fused and hardens when subsequently cooling down, the second layer is given the function of a soleplate. The soleplate may be adjusted to the sole of the foot and may thus e.g. evenly distribute pressure and loads over the soleplate.

Channels may be weft-knitted into the spacer weft-knitted fabric of the midsole, e.g. by omitting stitches in certain areas of the knitwear of the midsole. For example, channels might lead from the outsole through the strobel sole and laterally out of the midsole and thus achieve airing. At the same time, the outer sole may be as good as airtight and thus prevent the ingress of dirt and water.

However, the outer sole 92 and/or the midsole may also comprise a spacer weft-knitted fabric or a spacer warp-knitted fabric each, as e.g. described in the sections "knitwear" and "functional knitwear" above. In this case, the outer sole and/or the midsole and the spacer weft-knitted fabric or spacer warp-knitted fabric may comprise a different material, e.g. a different yarn. In principle, the thickness of a spacer weft-knitted fabric or a spacer warp-knitted fabric used for the outer sole 92 and/or the midsole may be adapted to the strains to be expected when the shoe 91 is worn. For example, the spacer weft-knitted fabric or the spacer warp-knitted fabric in the area of the heel could show a greater thickness than in the area of the toes, so as to specifically reduce the strength exerted on the foot when stepping on the ground, e.g. in case of a running shoe. For a heavier wearer, thicker yarns might also be used and the spacer weft-knitted fabric or spacer warp-knitted fabric could be thicker than in case of a lighter wearer.

The layers of a spacer weft-knitted fabric or a spacer warp-knitted fabric used for the shoe 91 may comprise different yarns. For example, the layer facing the foot may comprise a moisture-absorbing yarn, the layer on the side facing away from the foot may comprise rubberized yarn, and the yarn between these layers could be a strong nylon yarn (monofilament).

Spaces in the spacer weft-knitted fabric or the spacer warp-knitted fabric may be filled with damping material in order to obtain an additional cushioning. For instance, the spaces could be filled with particle foam, e.g. made from eTPU (expandable thermoplastic urethane) or ePP (expandable polypropylene), foam inserts and/or additional fibers.

These absorbent materials may be exchangeable, in order to allow the user to adapt the cushioning characteristics to his needs. For example, the knitwear of the outer sole 92 and/or the midsole (not shown in FIG. 9) may be weft-knitted in such a way that it comprises openings, pouches, or tunnels that may receive the exchangeable absorbent materials.

The openings, pockets or tunnels may be accessible from the outside of the shoe. For example, the cushioning material could be inserted into an opening, a pocket or a tunnel in the outer sole and/or the midsole from the outside. Alternatively, the opening, the pocket or the tunnel is accessible from the inside of the shoe. For example, an opening, a pocket or a tunnel could be located in the outer sole and/or the midsole from the outside under the insole. In order to insert the cushioning material, the insole could then be lifted or removed first so that the opening, the pocket or the tunnel becomes accessible.

As a rule, materials may be weft-knitted or warp-knitted in specific areas of the outer sole 92 and/or the midsole. For example, a melt yarn may be weft-knitted or warp-knitted only in those areas that are most stressed by the rolling [of the foot]. In this manner, the most-strained areas are particularly reinforced.

Melt yarn may be weft-knitted into the midfoot area in the form of so-called torsion elements. After fusing and subsequently hardening the melt yarn, a once-piece function element is then created. Melt yarn may also be enmeshed only medially and then serve as a pronation aid, i.e. particularly support the foot on the medial side. A continuous layer made from melt yarn in the outer sole 92 and/or the midsole would have the effect of a continuous soleplate.

Rubberized yarn may e.g. be weft-knitted in or warp-knitted in only in areas that are in contact with the ground the most—in accordance with the rolling-over movement of the foot. A rubberized yarn may be used in the forefoot area of the sole to high up in the toe area. This provides additional stability in the toe area and prevents the upper 51 coming off from the sole due to wear and tear.

Figure 10:
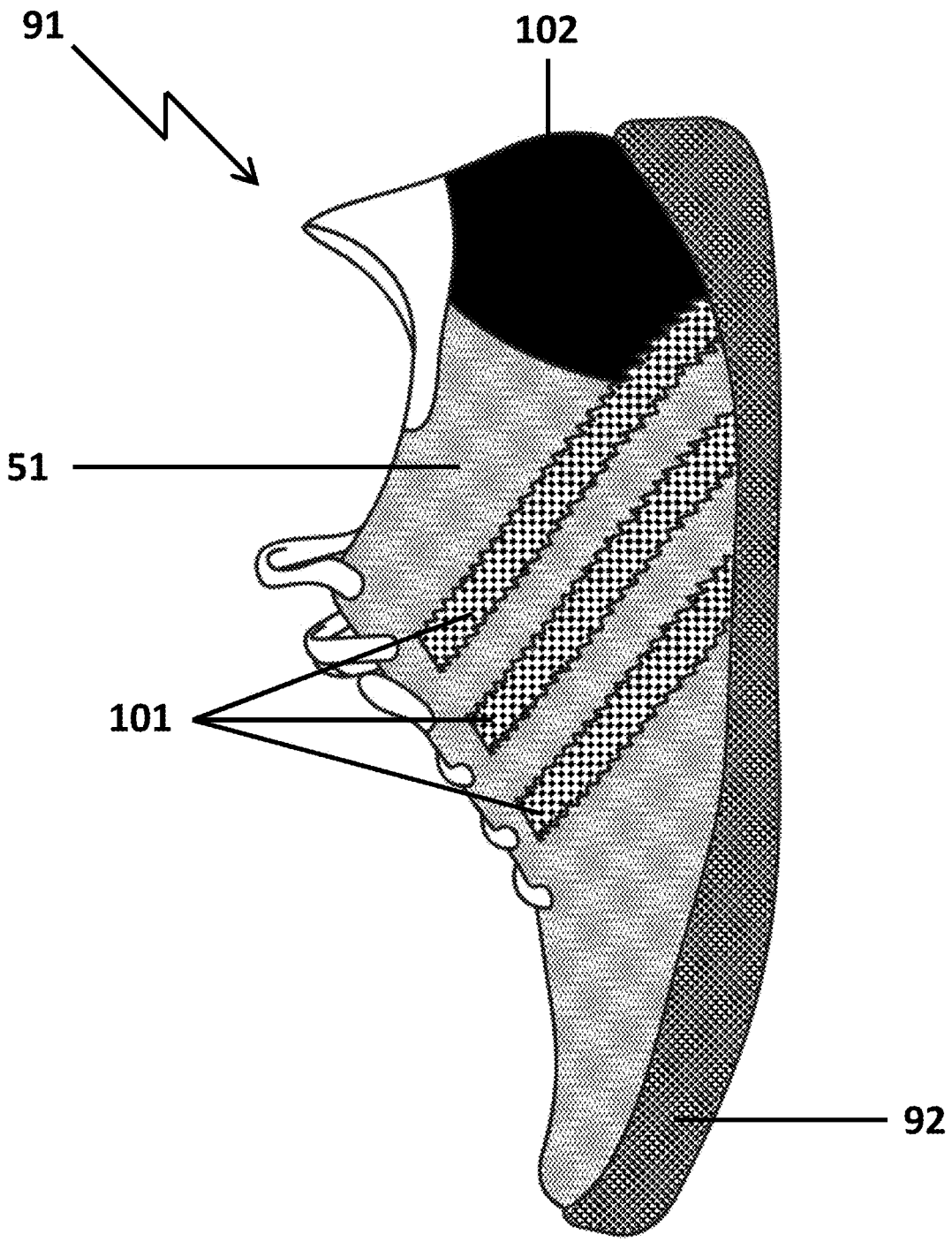
FIG. 10 is a side view of a shoe, according to certain embodiments of the present invention.

FIG. 10 shows a shoe 91 according to further embodiments of the present invention. In the shoe 91 shown in FIG. 10 both the outer sole 92 and the upper 51 comprise knitwear. The knitwear of the upper 51 may be weft-knitted or warp-knitted, for example on a machine, as described above. The upper 51 may be glued, welded (by ultrasound, as described in the section "functional knitwear" above, by high frequency or laser) or sewn to the outer sole 92. Alternatively, the upper 51 may be joined by linking to the outer sole 92 and/or the midsole (not shown in FIG. 10).

In further embodiments of the shoe 91, as shown in FIG. 10, the upper 51 together with the outer sole 92 and/or the midsole is formed as one-piece knitwear. In this case, the subsequent joining of the upper 51 and the outer sole 92 or the midsole, respectively, is not necessary. Such one-piece knitwear can, for example, be manufactured on a circular knitting machine.

The trademark 101 shown in FIG. 10 may be weft-knitted or warp-knitted in the upper 51 directly during the manufacture of the knitwear. Subsequent affixing is not required in this case. Instead of a trademark, this may also be an ornament. Alternatively, the trademark or the ornament may be affixed subsequently, for instance by gluing, welding (by ultrasound, as described in the section "functional knitwear" above, high-frequency welding or laser), sewing or imprinting.

The upper 51 shown in FIG. 10 comprises a reinforcement 102 in the form of a heel cap. The upper 51 may comprise further reinforcements, for example in the area of the toes. These reinforcements can, for example, be an applied polymer coating, as described in the sections "polymer coating" and "combination of monofilaments and polymer coating" above. Alternatively, melt yarn may be used that is weft-knitted or warp-knitted into the knitwear already in the weft-knitting or warp-knitting process and that causes a reinforcement and stabilization after heating and cooling. Alternatively, the melt yarn may be sewed in or embroidered subsequently. Further alternatively, the melt yarn may be weft-knitted in or on and then fused with the knitwear.

The reinforcement 102 shown in FIG. 10 may also be a heel cap made from polyurethane, for example, which was added subsequently and that may be glued, welded (by ultrasound, as described in the section "functional knitwear" above, by high frequency or laser) or sewn to the upper 51. Alternatively, the reinforcement 102 may also be a reinforcement yarn weft-knitted, warp-knitted, sewn or embroidered into the knitwear, for example a monofilament, as described above, or a rubberized yarn. Further alternatively, a reinforcement, e.g. a heel cap, could be inserted or pushed into a weft-knitted or warp-knitted pocket or a weft-knitted or warp-knitted tunnel.

The shoe 91 shown in FIGS. 9 and 10 may have a different binding in the area of the outer sole 92 and/or the midsole than in the area of the upper 51. For example, in the area of the outer sole 92, a more durable binding (e.g. the so called twill weave in warp-knitted fabrics) than in the upper 51 could be used. Accordingly, in the upper 51, a more elastic binding (e.g. the so-called tricot binding in warp-knitted fabrics) could be used, so that the upper 51 adapts easily to the respective foot form.

The shoe 91 shown in FIGS. 9 and 10 may comprise a different yarn in the area of the outer sole 92 and/or the midsole than in the area of the upper 51. For example, in the area of the outer sole 92, a rubber-like yarn could be used that increases the static friction and hence the traction. In the area of the midsole (not shown in FIGS. 9 and 10), a stabilizing or cushioning yarn, e.g. a voluminous and/or hollow yarn could be used, and in the area of the upper 51, a yarn facilitating air permeability, e.g. a yarn with rather little volume, such as a thin yarn, could be used.

In the area of the outer sole 92 and/or the midsole, the shoe 91 could also comprise a thicker, more abrasion-resistant or more water-repellent yarn than in the area of the upper 51. Thereby, the upper 51, the outer sole 92 and/or the midsole may be adapted to the respective functional requirements of the shoe.

The knitwear in the area of the upper 51 may, for example, be more permeable to water than in the area of the outer sole 92 and/or the midsole. For example, the knitwear of the upper 51 could be weft-knitted with larger stitches than the knitwear of the outer sole 92 and/or the midsole. Alternatively, the knitwear of the upper 51 may comprise openings which are already weft-knitted or warp-knitted in the knitwear during manufacture. Alternatively, the knitwear is subsequently provided with openings, e.g. by cutting out, punching out, burning out or lasering. The edges of the subsequently created openings may optionally be fused or glued together, e.g. in order to prevent fraying.

In the area of the outer sole 92 and/or the midsole, the knitwear may be arranged such that the wales of the knitwear are substantially transverse to a longitudinal axis of the outer sole 92 and/or the midsole. Thereby, the traction is increased in particular in the longitudinal direction, since the transversely arranged wales act like a transversely profiled sole. A different arrangement of the knitwear is also imaginable depending on the requirements.

The traction may also be increased by a yarn with a high static friction, e.g. a rubberized yarn, being weft-knitted into the area of outer sole 92 at certain distances. Moreover or alternatively, a yarn with high abrasion-resistance (e.g. Kevlar® or other para-aramid synthetic fiber) may be weft-knitted into the outer sole 92 at certain distances.

In the area of the outer sole 92 and/or the midsole, the knitwear may comprise weft-knitted or warp-knitted ribs and/or knobs. The warp-knitted fabric may be provided with ribs and/or knobs during the weft-knitting or warp-knitting process. Ribs and/or knobs in the area of the midsole may engage in corresponding ribs and/or knobs in the area of the outer sole 92 and so form a particularly stable joint between them. Ribs may e.g. be weft-knitted three-dimensionally, as described in the section "three-dimensional knitwear".

The ribs may be essentially arranged transversely to a longitudinal axis of the shoe. Due to this, the traction is increased particularly in the longitudinal direction, since the transverse ribs act like a transversely profiled sole. A different arrangement of the ribs is also imaginable depending on the requirements.

The outer sole 92 and/or the midsole may be reinforced through a thermoplastic polymer material, as described in the sections "polymer coating" and "combination of monofilaments and polymer coating" above. Alternatively, the outer sole 92 and/or the midsole may also be reinforced by monofilament, as described in the sections "monofilaments for reinforcement" and "combination of monofilaments and polymer coating" above.

The knitwear may comprise a thermoplastic yarn in the area of the outer sole 92 and/or the midsole. A thermoplastic yarn may be weft-knitted or warp-knitted in the knitwear during manufacture of same. If the shoe is subsequently heated to above the melting point of the thermoplastic yarn, the latter melts and solidifies during the subsequent cooling. Thereby, the knitwear is reinforced and gains stability.

The thermoplastic yarn may be weft-knitted or warp-knitted in along the entire surface of the outer sole 92 and/or the midsole. In this case, only certain areas may be heated up and fused as required, e.g. in a customer-specific manner. Alternatively, the thermoplastic is only at hand in certain areas of the outer sole 92 and/or the midsole. In this case, the distribution of the thermoplastic yarn may also be made as required, e.g. in a customer-specific manner.

The knitwear of the outer sole 92 and/or the midsole may be immersed in a rubber, latex, starch or polymer bath so that the yarns and/or the spaces fill with rubber, latex, starch or polymer in order to increase the friction and the traction (in case of a rubber or latex bath) and the rigidity (in case of a starch or polymer bath).

Figure 11:
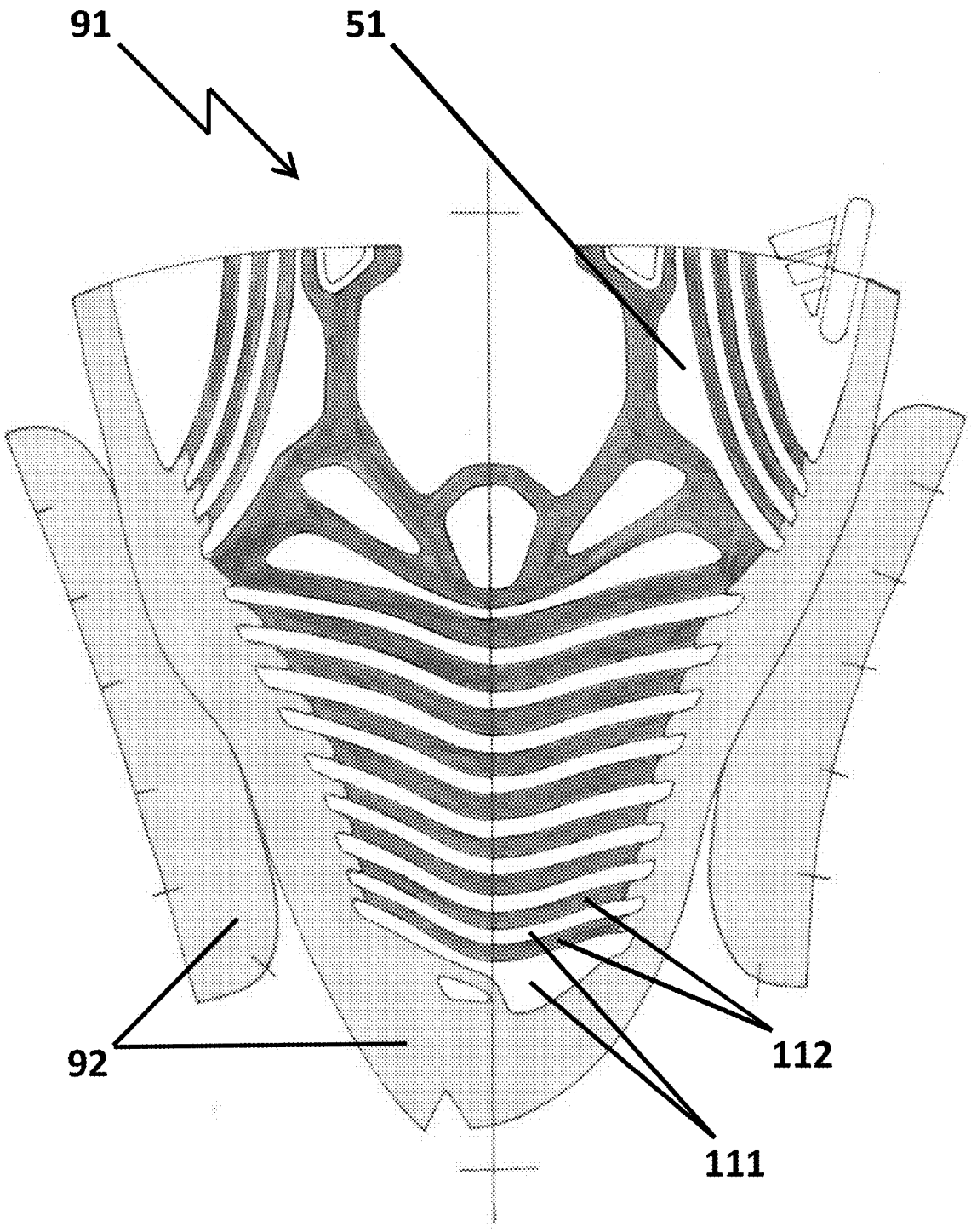
FIG. 11 is a top view of an upper, according to certain embodiments of the present invention.

FIG. 11 shows further embodiments of a shoe 91 according to the invention. In these embodiments, the shoe 91 comprises an upper 51 and an outer sole 92 that are formed from one-piece knitwear. Such a shoe 91 may, for example, be manufactured on a flat-knitting machine. In these embodiments, as shown in FIG. 11, the outer sole 92 comprises a Kevlar® yarn or other para-aramid synthetic fiber which is particularly durable and abrasion-resistant. In general, another durable and abrasion-resistant yarn may also be used.

In these embodiments, as shown in FIG. 11, the upper 51 furthermore comprises two different yarns. In first areas, two of which are labeled with reference numbers 111, the upper 51 comprises a conventional yarn. This yarn may be a soft and flexible yarn, for example a polyester yarn. In first areas, two of which are labeled with reference numbers 112, the upper 51 comprises an elastic yarn. This may be an elastane yarn, for example. Due to the elastic yarn and the arrangement of the first and second areas, the upper 51 adjusts to the shape of the foot particularly well.

Figure 12A:
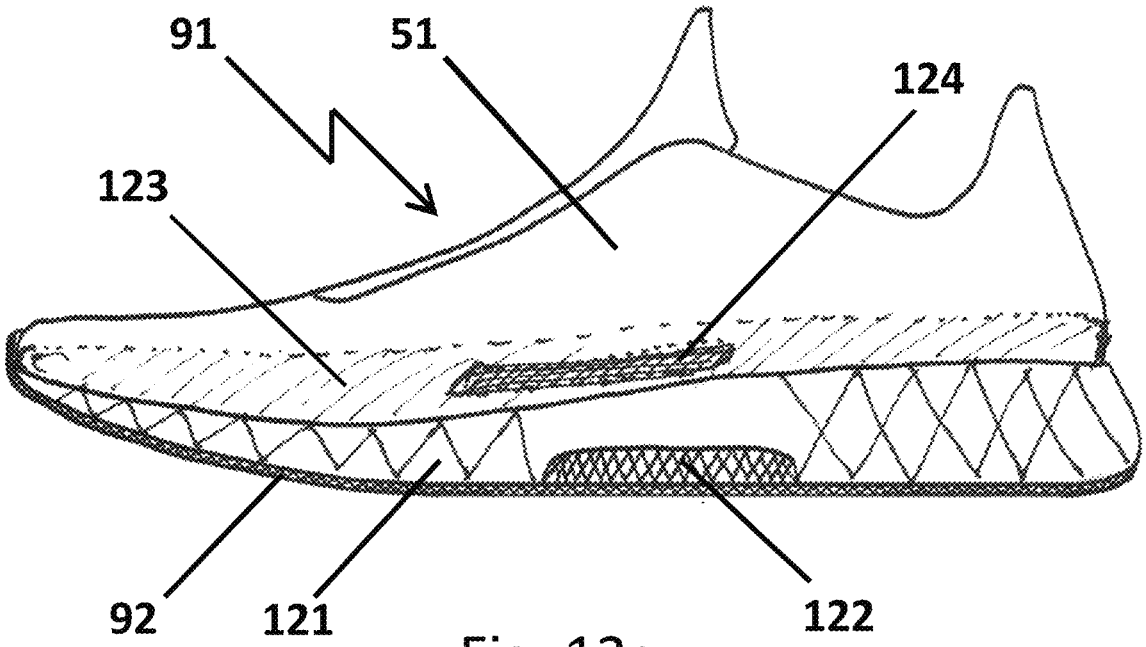
FIG. 12*a* is a side view of a shoe, according to certain embodiments of the present invention.
Figure 12B:
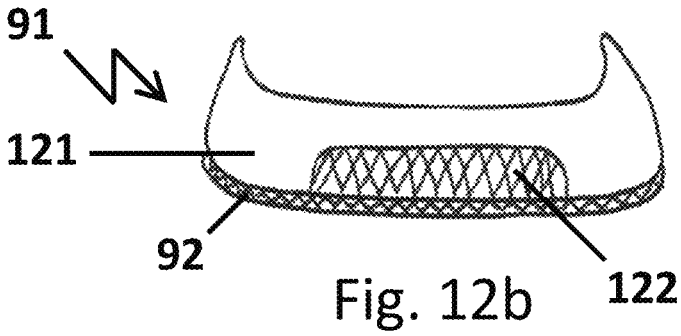
FIG. 12*b* is a cross-sectional view of the shoe of FIG. 12*a*.
Figure 12C:
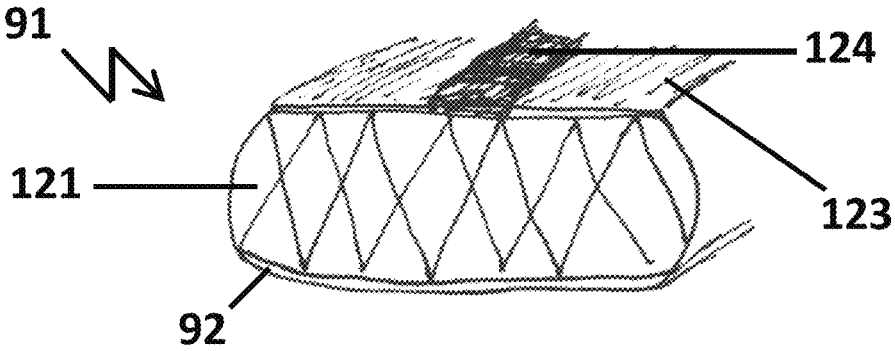
FIG. 12*c* is a cross-sectional view of the shoe of FIG. 12*a*.

FIGS. 12*a*, 12*b*, and 12*c* show a shoe 91, according to certain embodiments of the present invention. As depicted in the side view of FIG. 12*a*, the shoe 91 comprises an upper 51, a midsole 121 and an outer sole 92. The upper 51 may be manufactured from any desired textile, such as a woven fabric or knitwear, for example.

The midsole 121 comprises a spacer weft-knitted fabric, as e.g. described in the sections "knitwear" and "functional knitwear". Alternatively, the midsole is entirely formed from a spacer weft-knitted fabric. The spacer weft-knitted fabric of the midsole 121 may comprise a monofilament as a spacer yarn for example. In the area 122, which is located in the midfoot area, the spacer weft-knitted fabric is weft-knitted more tightly than in other areas. In this manner, additional stability is created in the midfoot area and the midfoot is supported. The spacer weft-knitted fabric may also be weft-knitted more tightly in other areas of the foot, e.g. in accordance with the requirements of a wearer of the shoe 91. The spacer weft-knitted fabric may additionally or alternatively also be weft-knitted thicker in certain areas. For example, the spacer weft-knitted fabric could be weft-knitted thicker in the area of the arch of the foot in order to support the arch of the foot.

The top layer 123 of a spacer weft-knitted fabric of the midsole 121 fulfills the function of an outsole, a strobel sole or a flat sole. The outsole directly touches the foot. The upper layer 123 of the spacer weft-knitted fabric of the midsole 121 may comprise a humidity-absorbing yarn.

An area 124 comprising melt yarn may optionally be weft-knitted into the spacer weft-knitted fabric of the midsole 121. For example, a melt yarn may be weft-knitted into the inner layer of the spacer weft-knitted fabric or the outer layer of the spacer weft-knitted fabric. The melt yarn fuses subject to heat and hardens as it cools down. In this manner, a harder area 124 is created, which may e.g. support torsion of the midsole and simultaneously support the midfoot.

Ventilation channels, that is, notches, (not shown in FIG. 12) may be weft-knitted into the spacer weft-knitted fabric of the midsole 121. They may e.g. be created by three-dimensional weft-knitting. The ventilation channels may create a connection from the top layer 123 of the spacer weft-knitted fabric e.g. to one side of the spacer weft-knitted fabric. Humid and warm air may be transported away from the foot and fresh air may be supplied to the foot through the ventilation channels.

The outer sole 92, which is shown in the side view of FIG. 12*a* and the cross sectional view of FIG. 12*b*, is connected to the midsole 121 e.g. by gluing, sewing or welding (by ultrasound, as described in the section "functional knitwear" above, by high-frequency welding or laser). The outer sole 92 may be made of rubber or plastic, for example. The outer sole 92 may also be a coating, e.g. Kevlar® or other para-aramid synthetic fiber.

In further embodiments, as shown in FIG. 12*c*, the outer sole 92 is formed by the bottom layer of the spacer weft-knitted fabric of the midsole 121. For this purpose, the bottom layer of the spacer weft-knitted fabric may comprise a rubberized yarn in order to increase traction. Additionally or alternatively, the bottom layer may also comprise a particularly durable and abrasion-resistant yarn, e.g. Kevlar® or other para-aramid synthetic fiber.

Figure 13A:
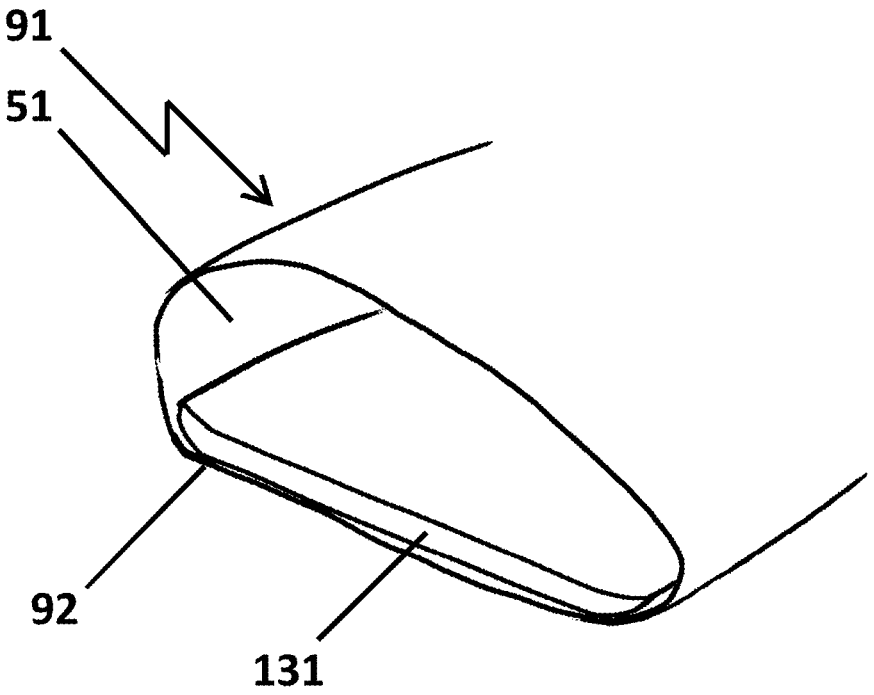
FIG. 13*a* is a cross-sectional view of a shoe, according to certain embodiments of the present invention.
Figure 13B:
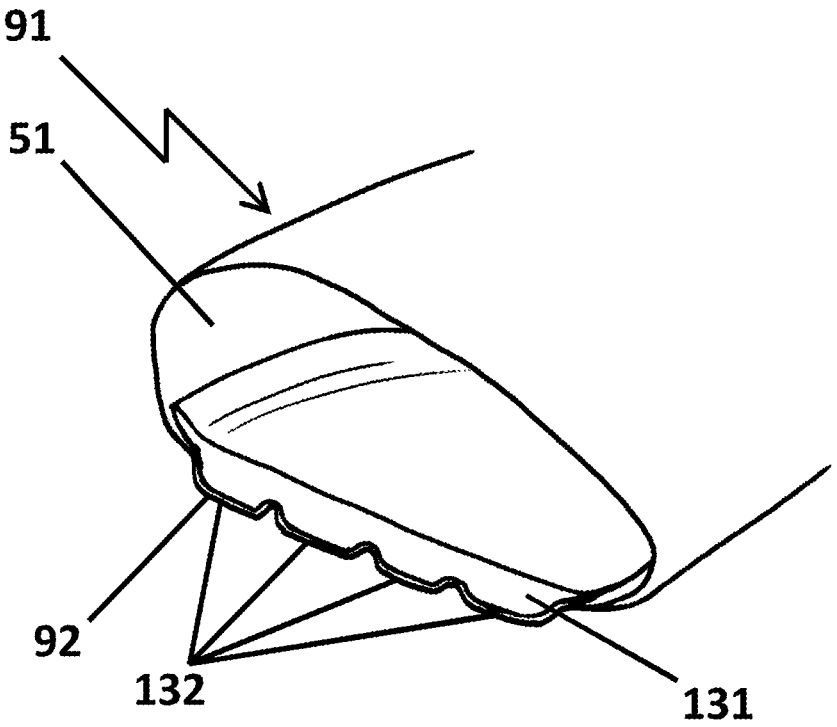
FIG. 13*b* is a cross-sectional view of a shoe, according to certain embodiments of the present invention.

FIGS. 13*a* and 13*b* show perspective cross sections of two further embodiments of a shoe 91 according to the invention. In both Figures, the upper 51 and the outer sole 92 are formed as knitwear. The upper 51 and the outer sole 92 may be manufactured as one-piece knitwear, e.g. on a circular knitting machine.

A midsole in the form of an insert 131 is placed inside the shoe 91. The insert 131 may be tightly connected to the upper 51 and/or the outer sole 92, e.g. sewn, glued or welded (by ultrasound, as described in the section "functional knitwear" above, by high-frequency welding or laser) to the outer sole 92. Alternatively, the insert 131 may be removable from the shoe. It is also conceivable that the knitwear of the outer sole 92 comprises a weft-knitted or a warp-knitted pocket on the top (not shown in the Figures), into which the insert, e.g. a midsole comprising knitwear, may be inserted.

The insert 131 may comprise knitwear so that it is a midsole comprising knitwear. Alternatively, the midsole may comprise no knitwear and be manufactured from foam material or ethylene vinyl acetate (EVA), for example. The insert 131 may be entirely surrounded by weft-knitted or warp-knitted material of the upper 51 and/or the outer sole 92, e.g. in the form of the above-described pocket, in order to reduce or prevent shifting.

The knitwear of the outer sole 92 may comprise a more durable yarn, e.g. a Kevlar® yarn or other para-aramid synthetic fiber. Alternatively or additionally, the outer sole 92 may be coated with a durable coating, e.g. Kevlar® or other para-aramid synthetic fiber.

In further embodiments, as shown in FIG. 13*b*, the insert 131 additionally comprises knobs 132. If the insert 131 is an insert that comprises knitwear, the knobs 132 may e.g. be manufactured by corresponding weft-knitted or warp-knitted structures. For example, the knobs 132 may be three-dimensionally weft-knitted structures. The knobs 132 of the insert 131 ensure a structuring of the outer sole 92 corresponding to the knobs. In this manner the outer sole 92 is provided with a profile that increases traction. The knitwear of the outer sole 92 could additionally be provided with structuring corresponding to the knobs, e.g. by three-dimensional weft-knitting. In this case, the outer sole 92 would comprise recesses in which the knobs 132 could mesh.

The knitwear of the outer sole 92 may comprise rubberized yarn in the area of the knobs in order to increase traction. The rubberized yarn may be weft-knitted into the knitwear for example in the type of binding or "floating". In this regard, the rubberized yarn may be weft-knitted in with a herringbone pattern. Due to this, the rubberized yarn may move freely to a certain extent and adjust the floor in order to achieve better traction.

In various embodiments (not shown in FIGS. 13*a* and 13*b*), the outer sole 92 exhibits opening through which the knobs 132 of the insert 131 may protrude and touch the floor. In this case, the knobs 131 constitute a part of the outer sole 92. The knobs 131 could then be manufactured from a more resistant and durable material, e.g. rubber or Kevlar® or other para-aramid synthetic fiber.

Figure 14A:
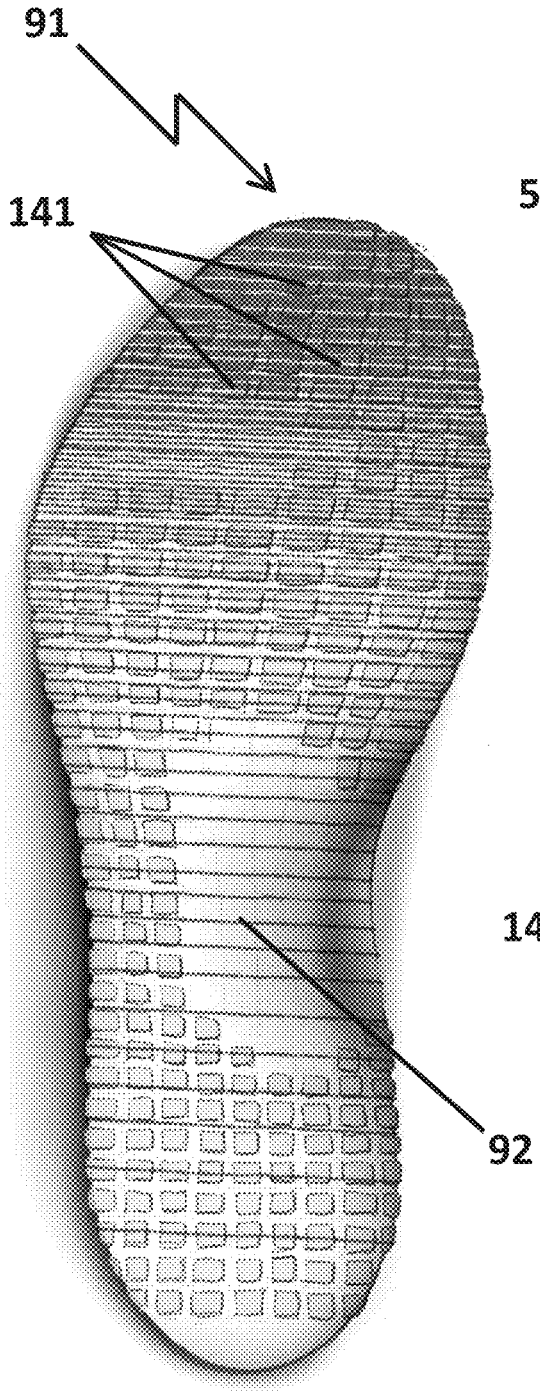
FIGS. 14*a*-14*b* are top and views of a shoe, according to certain embodiments of the present invention.
Figure 14B:
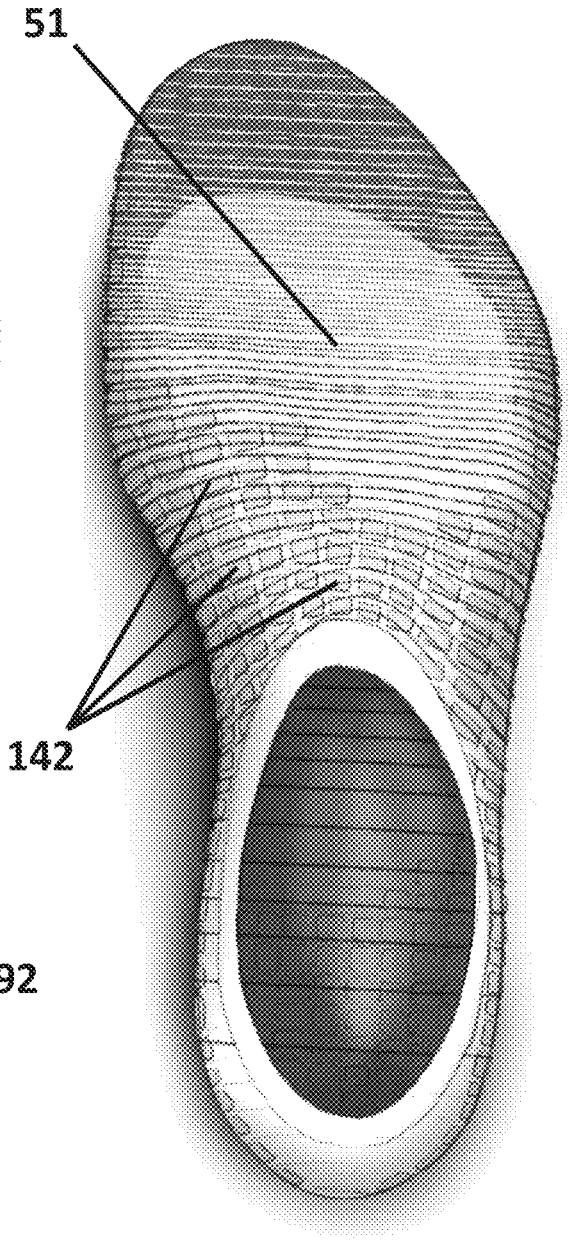

FIG. 14 shows further embodiments of the present invention. In this regard, the left side of FIGS. 14*a*-14*b* show the shoe 91 from the bottom, whereas the right side shows the shoe 91 from the top. The outer sole 92 comprises knitwear with a first yarn. This first yarn may be a polyester yarn, for example. The knitwear furthermore comprises a second yarn. This second yarn may be a rubber yarn. In further embodiments, it may also be a rubberized yarn. The second yarn is arranged in rectangular structures in the embodiments of FIGS. 14*a*-14*b*, three of which are labeled with reference number 141 by way of example. The structures do not have to be rectangular and may be of any desired shape and be round, for example. Due to the fact that the second yarn (rubber yarn or rubberized yarn) is formed in structures on the outer sole 92, traction, abrasion-resistance and stability are increased.

The arrangement of the structures with the second yarn may correspond to a human footprint, as is shown in the embodiments of FIGS. 14*a*-14*b*. Alternatively, the structures with the second yarn are arranged there on the outer sole 92 where the highest abrasion occurs when the shoe is worn. In general, the structures with the second yarn may be arranged on the outer sole 92 as desired. For example, no structures with the second yarn are arranged in the area of the arch of the foot in the embodiments of FIGS. 14*a*-14*b*. No structures with the second yarn are also arranged in the area of the flexing zone of the toes.

In the embodiments of FIGS. 14*a*-14*b*, the outer sole 92 may also be formed entirely of knitwear, that is, be weft-knitted or warp-knitted as one piece.

The upper 51 may also comprise knitwear in the embodiments of FIGS. 14*a*-14*b*, as is shown on the right side of FIGS. 14*a*-14*b*. The knitwear of the upper 51 may comprise a first yarn. This first yarn may be a polyester yarn, for example, as the first yarn or the outer sole 92. The knitwear of the upper 51 comprises a second yarn in the embodiments of FIGS. 14*a*-14*b*. The second yarn may be a rubber yarn or a rubberized yarn. As in the outer sole 92, the second yarn is arranged in rectangular structures on the upper 51. By way of example, three of these structures are labeled with reference number 142. However, the structures may be of any desired shape, e.g. be round. The structures with the second yarn are mainly arranged in the midfoot area on the embodiments of FIGS. 14*a*-14*b*. In this manner, stability is achieved in the midfoot area. The structures with the second yarn may generally be distributed across the upper 51 as desired. No structures with the second yarn are arranged in the forefoot area, for example.

In the embodiments of FIGS. 14*a*-14*b*, the upper 51 may also be formed entirely of knitwear, that is, be weft-knitted or warp-knitted as one piece. It is also possible that the knitwear of the upper 51 is formed as one piece with the knitwear of the outer sole 92. In this case, the first yarn of the outer sole 92 and the first yarn of the upper 51 could be identical and the second yarn of the outer sole 92 could be identical to the second yarn of the upper 51.

If the outer sole 92 is manufactured as one-piece knitwear with the upper 51, the knitwear may be manufactured on a circular weft-knitting machine or a circular warp-knitting machine. Alternatively, the one-piece knitwear may be manufactured on a flat-knitting machine. In this case, a seam could be provided for along the sole, in a manner similar to a moccasin construction, in order to obtain the desired shape of the shoe.

In all embodiments of the invention, the outer sole 92 and/or the midsole 121 may comprise at least one pocket (not shown in the Figures) into which a material insert may be inserted. The pocket may be manufactured with the knitwear of the outer sole 92 and/or the midsole 121 as one piece during weft-knitting or warp-knitting. The material insert may e.g. be a foam insert, an air cushion or a gel insert, which provides cushioning, for example. The pocket may fully or partially surround the material insert.

In the following, further examples are described to facilitate the understanding of the invention:

1. Shoe (71), in particular a sports shoe, comprising:
   a. an upper (72); and
   b. an outer sole (73) and/or a midsole (121) which is connected to the upper (72), the outer sole (73) and/or the midsole (121) comprising knitwear.
2. Upper (71) according to example 1, wherein the upper (72) comprises knitwear.

3. Shoe (71) according to example 2, wherein the upper (72) together with the outer sole (73) and/or the midsole (121) are formed as one-piece knitwear.
4. Shoe (71) according to example 2 and/or 3, wherein the knitwear comprises a different binding in the area of the outer sole (73) and/or the midsole (121) than in the area of the upper (72).
5. Shoe (71) according to one of examples 2 to 4, wherein the upper 72) comprises a first yarn and the knitwear comprises a second yarn in the area of the outer sole (73) and/or the midsole (121).
6. Shoe (71) according to any one of the preceding examples, wherein the second yarn is thicker than the first yarn.
7. Shoe (71) according to any one of the preceding examples, wherein the second yarn is more abrasion-resistant than the first yarn.
8. Shoe (71) according to one of examples 5 to 7, wherein the second yarn is more water-repellent than the first yarn.
9. Shoe (71) according to any one of the preceding examples, wherein the knitwear is more permeable to air in the area of the upper (72) than in the area of the outer sole (73) and/or the midsole (121).
10. Shoe (71) according to any one of the preceding examples, wherein the knitwear is arranged such in the area of the outer sole (73) and/or the midsole (121) that the wales (31) of the knitwear run essentially transversely to a longitudinal axis of the outer sole (73) and/or the midsole (121).
11. Shoe (71) according to any one of the preceding examples, wherein the knitwear comprises stability elements in the area of the outer sole (73) and/or the midsole (121).
12. Shoe (71) according to example 11, wherein the stability elements are ribs, waves or knobs.
13. Shoe (71) according to example 12, wherein the ribs are arranged essentially transversely to a longitudinal axis.
14. Upper (71) according to any one of the preceding examples, wherein the knitwear is weft-knitted.
15. Upper (71) according to any one of the preceding examples, wherein the knitwear is warp-knitted.
16. Shoe (71) according to any one of the preceding examples, wherein the outer sole (73) and/or the midsole (121) is reinforced with a polymer material.
17. Shoe (71) according to any one of the preceding examples, wherein the knitwear comprises a thermoplastic yarn in the area of the outer sole (73) and/or the midsole (121).
18. Shoe (71) according to any one of the preceding examples, wherein the knitwear comprises at least one rubberized yarn in the area of the outer sole (73).
19. Shoe (71) according to any one of the preceding examples, wherein the knitwear has been immersed in a rubber and/or a polymer bath at least partially in the area of the outer sole (73) and/or the midsole (121).
20. Shoe (71) according to any one of the preceding examples, wherein the outer sole (73) and/or the midsole (121) is a spacer weft-knitted fabric or a spacer warp-knitted fabric.
21. Shoe (71) according to example 20, wherein the layers of the spacer weft-knitted fabric or the spacer warp-knitted fabric comprise different yarns.
22. Shoe (71) according to any one of the preceding examples, wherein the knitwear of the outer sole (73) comprises a weft-knitted or a warp-knitted pocket on the top, into which the midsole can be inserted.
23. Method for the manufacture of a shoe according to any one of the preceding examples with the following steps:
    a. providing an upper;
    b. manufacturing an outer sole and/or a midsole comprising knitwear; and
    c. joining the outer sole and/or the midsole to the upper of the shoe.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A shoe comprising:

a knitted fabric comprising an upper and an outer sole, the knitted fabric including an at least partially melted fusible yarn in an area of the knitted fabric that includes the outer sole, wherein the at least partially melted fusible yarn provides hardening where the at least partially melted fusible yarn is present; and an insert having a profile with a plurality of knobs extending away from a bottom surface of the insert, wherein the insert is positioned within the knitted fabric and adjacent to the outer sole;

wherein the plurality of knobs of the insert engage with a plurality of recesses extending away from an outsole bottom surface of the outer sole;

wherein the plurality of knobs have no direct contact with a surface of an object or ground contacted by the outer sole;

wherein the plurality of knobs and the plurality of recesses are separately constructed prior to the engagement; and wherein the at least partially melted fusible yarn conforms to a non-planar contour of the plurality of recesses that is shaped by a three-dimensional knit profile of the knitted fabric to form traction elements in the outer sole, and wherein the insert is covered by the outer sole.

2. The shoe of claim 1, wherein the insert is manufactured from foam material or ethylene vinyl acetate.

3. The shoe of claim 1, further comprising a polymer material applied to at least a portion of the outer sole.

4. The shoe of claim 3, further comprising the polymer material applied to at least the portion of the outer sole such that an abrasion resistance of the knitted fabric is increased.

5. The shoe of claim 3, further comprising the polymer material applied to at least the portion of the outer sole such that a stiffness and stability of the knitted fabric is increased.

6. The shoe of claim 3, wherein the polymer material is absorbed into yarn of the outer sole.

7. The shoe of claim 3, wherein the polymer material fills spaces in yarn of the outer sole.

8. The shoe of claim 1, wherein at least a portion of the insert is connected to the outer sole.

9. The shoe of claim 1, wherein the insert is positioned between layers of the knitted fabric.

10. The shoe of claim 1, wherein the insert is connected to the outer sole by being fused to the at least partially melted fusible yarn.

11. The shoe of claim 1, wherein the knitted fabric includes a fiber-based yarn in an area of the upper.

12. The shoe of claim 1, wherein the knitted fabric includes a rubberized yarn where the traction elements contact the ground.

13. The shoe of claim 1, wherein the knitted fabric includes a monofilament in the area of the outer sole, wherein the monofilament reinforces the outer sole and reduces stretchability of the outer sole.

14. The shoe of claim 1, wherein the knitted fabric includes a spacer knit in a second area of the outer sole.

15. The shoe of claim 1, wherein the knitted fabric is substantially seamless.

* * * * *